US005534831A

United States Patent [19]

Yabuki et al.

[11] Patent Number: 5,534,831

[45] Date of Patent: Jul. 9, 1996

[54] PLANE TYPE STRIP-LINE FILTER IN WHICH STRIP LINE IS SHORTENED AND DUAL MODE RESONATOR IN WHICH TWO TYPES MICROWAVES ARE INDEPENDENTLY RESONATED

[75] Inventors: Hiroyuki Yabuki; Michiaki Matsuo, both of Kawasaki; Morikazu Sagawa, Tokyo; Mitsuo Makimoto, Yokohama, all of Japan

[73] Assignee: Matsushita Industrial Electric Co., Ltd., Osaka, Japan

[21] Appl. No.: 317,505

[22] Filed: Oct. 4, 1994

[30] Foreign Application Priority Data

| | | | |
|---|---|---|---|
| Oct. 4, 1993 | [JP] | Japan | 5-247845 |
| Dec. 22, 1993 | [JP] | Japan | 5-325070 |
| Aug. 11, 1994 | [JP] | Japan | 6-189496 |

[51] Int. Cl.[6] ..... H01P 1/203; H01P 7/08

[52] U.S. Cl. ..... 333/204; 333/219

[58] Field of Search ..... 333/204, 205, 333/202, 219, 235, 246

[56] References Cited

U.S. PATENT DOCUMENTS

| | | | |
|---|---|---|---|
| 4,180,787 | 12/1979 | Pfitzenmaier | 333/212 |
| 4,327,342 | 4/1982 | De Ronde | 333/204 |
| 5,017,897 | 5/1991 | Ooi et al. | 333/204 |

FOREIGN PATENT DOCUMENTS

| | | |
|---|---|---|
| 0573985A1 | 12/1993 | European Pat. Off. . |
| 2248621 | 5/1975 | France . |
| 2284402 | 9/1991 | Japan . |
| 2222312 | 2/1990 | United Kingdom . |

OTHER PUBLICATIONS

IEEE PROCEEDINGS, H. MICROWAVES, ANTENNAS & PROPAGATION, vol. 138, No. 4, Aug. 1991, STEVENAGE GB, pp. 383–385, S. H. AL–CHARCHAFCHI et al., "Study of varactor tuned microstrip rhombic resonators".

"MINIATURE DUAL MODE MICROSTRIP FILTERS" by Curtis et al; 1991 IEEE MTT–S Digest; pp., 443–446.

"EXCITATION METHODS OF ORTHOGONAL RESONANT MODES FOR THE STRIPLINE RING RESONATOR AND THEIR APPLICATION TO FILTERING DEVICES" by M. Fujimura et al; The Institute of Electronics Information and Communication Engineers; Technical Report of IEICE. MW92–115(1992–12); pp., 15–22.

20TH EUROPEAN MICROWAVE CONFERENCE–PROCEEDINGS 10–13 Sep. 1990, Budapest, HU, MICROWAVE EXHIBITIONS AND PUBLISHERS LTD., Tunbridge Wells, GB, 1990; pp. 901–906, M. GUGLIELMI et al.: "Experimental investigation of dual–mode Microstrip ring resonators".

*Primary Examiner*—Benny T. Lee
*Assistant Examiner*—David H. Vu
*Attorney, Agent, or Firm*—Rossi & Associates

[57] ABSTRACT

A strip-line filter is provided with upper- and lower-stage resonators having the same electromagnetic characteristics. Each of the resonators has a one-wavelength square-shaped strip line and four open-end transmission lines connected to four coupling points A,C,B and D (or E,G,F and H) of each resonator which are spaced 90 degrees in electric length in that order. The square-shaped strip lines have a pair of parallel coupling lines closely placed in parallel to each other to electromagnetically couple the resonators. Therefore, the filter can be manufactured in a small size. A first microwave resonated in each resonator is electromagnetically influenced by two open-end transmission lines connected to two coupling points A and B (or E and F), and a second microwave resonated in each resonator is electromagnetically influenced by two open-end transmission lines connected to two coupling points C and D (or G and H). Therefore, resonance wavelengths of the microwaves can be longer than a line length of each square-shaped strip line. Also, the resonance wavelengths can be adjusted by trimming the transmission lines. Also, because all constitutional elements are made of strip lines, the filter can be made plane.

14 Claims, 22 Drawing Sheets

PLANE TYPE STRIP-LINE FILTER IN WHICH STRIP LINE IS SHORTENED AND DUAL MODE RESONATOR IN WHICH TWO TYPES MICROWAVES ARE INDEPENDENTLY RESONATED

BACKGROUND OF THE INVENTION

1. Field of the Invention

The present invention relates generally to a strip-line filter utilized to filter microwaves in a communication apparatus or a measuring apparatus operated in frequency bands ranging from an ultra high frequency (UHF) band to a super high frequency (SHF) band, and more particularly to a strip-line filter in which a strip line is shortened and is made plane at low cost. Also, the present invention relates generally to a dual mode resonator utilized for an oscillator or a strip-line filter, and more particularly to a dual mode resonator in which two types microwaves are independently resonated.

2. Description of the Related Art 2.1 First Previously Proposed Art

A strip-line resonating filter is manufactured by serially arranging a plurality of one-wavelength type of strip line ring resonators to reduce radiation loss of microwaves transmitting through a strip line of the resonating filter. However, there is a drawback in the strip-line resonating filter that the resonating filter cannot be downsized. Therefore, a dual mode strip-line filter in which microwaves in two orthogonal modes are resonated and filtered has been recently proposed. A conventional dual mode strip-line filter is described with reference to FIGS. 1 and 2.

FIG. 1 is a plan view of a conventional dual mode strip-line filter. FIG. 2A is a sectional view taken generally along the line II—II of FIG. 1. FIG. 2B is another sectional view taken generally along the line II—II of FIG. 1 according to a modification.

As shown in FIG. 1, a conventional dual mode strip-line filter 11 comprises an input terminal 12 excited by microwaves, a one-wavelength strip line ring resonator 13 in which the microwaves are resonated, an input coupling capacitor 14 connecting the input terminal 12 and a coupling point A of the ring resonator 13 to couple the input terminal 12 excited by the microwaves to the ring resonator 13 in capacitive coupling, an output terminal 15 which is excited by the microwaves resonated in the ring resonator 13, an output coupling capacitor 16 connecting the output terminal 15 and a coupling point B in the ring resonator 13 to couple the output terminal 15 to the ring resonator 13 in capacitive coupling, a phase-shifting circuit 17 coupled to a coupling point C and a coupling point D of the ring resonator 13, a first coupling capacitor 18 for coupling a connecting terminal 20 of the phase-shifting circuit 17 to the coupling point C in capacitive coupling, and a second coupling capacitor 19 for coupling another connecting terminal 21 of the phase-shifting circuit 17 to the coupling point D in capacitive coupling.

The ring resonator 13 has a uniform line impedance and an electric length which is equivalent to a resonance wavelength $\lambda_o$. In this specification, the electric length of a closed loop-shaped strip line such as the ring resonator 13 is expressed in an angular unit. For example, the electric length of the ring resonator 13 equivalent to the resonance wavelength $\lambda_o$ is called 360 degrees.

The input and output coupling capacitors 14, 16 and first and second coupling capacitors 18, 18 are respectively formed of a plate capacitor.

The coupling point B is spaced 90 degrees in the electric length (or a quarter-wave length of the microwaves) apart from the coupling point A. The coupling point C is spaced 180 degrees in the electric length (or a half-wave length of the microwaves) apart from the coupling point A. The coupling point D is spaced 180 degrees in the electric length apart from the coupling point B.

The phase-shifting circuit 17 is made of one or more passive or active elements such as a capacitor, an inductor, a strip line, an amplifier, a combination unit of those elements, or the like. A phase of the microwaves transferred to the phase-shifting circuit 17 shifts by a multiple of a half-wave length of the microwaves to produce phase-shift microwaves.

As shown in FIG. 2A, the ring resonator 13 comprises a strip conductive plate 22, a dielectric substrate 23 mounting the strip conductive plate 22, and a conductive substrate 24 mounting the dielectric substrate 23. That is, the ring resonator 13 is formed of a microstrip line. The wavelength of the microwaves depends on a relative dielectric constant $\epsilon_r$ of the dielectric substrate 23 so that the electric length of the ring resonator 13 depends on the relative dielectric constant $\epsilon_r$.

In a modification, the ring resonator 13 is formed of a balanced strip line shown in FIG. 2B. As shown in FIG. 2B, the ring resonator 13 comprises a strip conductive plate **22*m*, a dielectric substrate 23*m* surrounding the strip conductive plate 22*m*, and a pair of conductive substrates 24*m* sandwiching the dielectric substrate 23*m***.

In the above configuration, when the input terminal 12 is excited by microwaves having various wavelengths around the resonance wavelength $\lambda_o$, electric field is induced around the input coupling capacitor 14 so that the intensity of the electric field at the coupling point A of the ring resonator 13 is increased to a maximum value. Therefore, the input terminal 12 is coupled to the ring resonator 13 in the capacitive coupling, and the microwaves are transferred from the input terminal 12 to the coupling point A of the ring resonator 13. Thereafter, the microwaves are circulated in the ring resonator 13 in clockwise and counterclockwise directions. In this case, the microwaves having the resonance wavelength $\lambda_o$ are selectively resonated according to a first resonance mode.

The intensity of the electric field induced by the microwaves resonated is minimized at the coupling point B spaced 90 degrees in the electric length apart from the coupling point A because the intensity of the electric field at the coupling point A is increased to the maximum value. Therefore, the microwaves are not directly transferred to the output terminal 15. Also, the intensity of the electric field is minimized at the coupling point D spaced 90 degrees in the electric length apart from the coupling point A so that the microwaves are not transferred from the coupling point D to the phase-shifting circuit 17. In contrast, because the coupling point C is spaced 180 degrees in the electric length apart from the coupling point A, the intensity of the electric field at the coupling point C is maximized, and the connecting terminal 20 is excited by the microwaves circulated in the ring resonator 13. Therefore, the microwaves are transferred from the coupling point C to the phase-shifting circuit 17 through the first coupling capacitor 18.

In the phase-shifting circuit 17, the phase of the microwaves shifts to produce phase-shift microwaves. For example, the phase of the microwaves shifts by a half-wave length thereof. Thereafter, the connecting terminal 21 is excited by the phase-shift microwaves, and the phase-shift microwaves are transferred to the coupling point D through the second coupling capacitor 19. Therefore, the intensity of the electric field at the coupling point D is increased to the maximum value. Thereafter, the phase-shift microwaves are circulated in the ring resonator 13 in the clockwise and counterclockwise directions so that the phase-shift microwaves are resonated according to a second resonance mode.

Thereafter, because the coupling point B is spaced 180 degrees in the electric length apart from the coupling point D, the intensity of the electric field is increased at the coupling point B. Therefore, electric field is induced around the output coupling capacitor 16, so that the output terminal 15 is coupled to the coupling point B in the capacitive coupling. Thereafter, the phase-shift microwaves are transferred from the coupling point B to the output terminal 15. In contrast, because the coupling points A, C are respectively spaced 90 degrees in the electric length apart from the coupling point D, the intensity of the electric field induced by the phase-shift microwaves is minimized at the coupling points A, C. Therefore, the phase-shift microwaves are transferred to neither the input terminal 12 nor the connecting terminal 20.

Accordingly, the microwaves having the resonance wavelength $\lambda_o$ are selectively resonated in the ring resonator 13 and are transferred to the output terminal 15. Therefore, the conventional dual mode strip-line filter 11 functions as a resonator and filter.

The microwaves transferred from the input terminal 12 are initially resonated in the ring resonator 13 according to the first resonance mode, and the phase-shift microwaves are again resonated in the ring resonator 13 according to the second resonance mode. Also, the phase of the phase-shift microwaves shifts by 90 degrees as compared with the microwaves. Therefore, two orthogonal modes formed of the first resonance mode and the second resonance mode independently coexist in the ring resonator 13. Therefore, the conventional dual mode strip-line filter 11 functions as a two-stage filter.

2.2 Problems of the First Previously Proposed Art to be solved by the Invention

However, passband characteristics of the filter 11 is determined by the electric length of the ring resonator 13, so that a microwave having a fixed wavelength such as $\lambda_o$ is only resonated. Therefore, because the electric length of the ring resonator 13 is unadjustable, there is a drawback that the adjustment of the resonance wavelength is difficult.

Also, because it is required that the electric length of the strip line ring resonator 13 is equal to the one wavelength $\lambda_o$ of the resonance microwave and because the phase-shifting circuit 17 is formed of a concentrated constant element such as a coupling capacitor or a transmission line such as a strip line, there is another drawback that it is difficult to manufacture the filter 11 in a small-size and plane shape.

2.3. Second Previously Proposed Art

FIG. 3 is a plan view of another conventional dual mode strip-line filter.

As shown in FIG. 3, another conventional dual mode strip-line filter 31 comprises two dual mode strip-line filters 11 arranged in series. An inter-stage coupling capacitor 32 is connected between the coupling point D of the filter 11 arranged at an upper stage and the coupling point A of the filter 11 arranged at a lower stage. The phase-shifting circuit 17 of the filter 11 arranged at the upper stage is composed of a coupling capacitor 33, and the phase-shifting circuit 17 of the filter 11 arranged at the lower stage is composed of a coupling capacitor 34.

In the above configuration, when the input terminal 12 is excited by a signal (or a microwave) having a resonance wavelength $\lambda_o$, the signal is resonated according to the first and second resonance modes in the same manner, and the signal is transferred to the coupling point A of the filter 11 arranged at the lower stage through the inter-stage coupling capacitor 32. Thereafter, the signal is again resonated according to the first and second resonance modes in the filter 11 arranged at the lower stage, and the signal is output from the coupling point D to the output terminal 15. In this case, the resonance wavelength $\lambda_o$ is determined according to an electric length of the ring resonator 13.

Therefore, the conventional dual mode strip-line filter 31 functions as a four-stage filter in which the signal is resonated at four stages arranged in series.

2.4 Problems of the Second Previously Proposed Art to be solved by the Invention However, it is required that the electric length of the strip line ring resonator 13 is equal to the one wavelength of a resonance microwave, and it is required to increase the number of filters 11 for the purpose of improving attenuation characteristics of the resonance microwave. Therefore, there is a drawback that a .small sized filter cannot be manufactured.

Also, the phase-shifting circuit 17 is formed of a concentrated constant element such as a coupling capacitor or a transmission line such as a strip line, there is another drawback that it is difficult to manufacture the filter 31 in a small-size and plane shape.

2.5. Third Previously Proposed Art

A quarter-wavelength strip line resonator made of a balanced strip line or a micro-strip line has been broadly utilized in a high frequency band as an oscillator or a resonator utilized for a strip-line filter because the quarter-wavelength strip line resonator can be made in a small size. However, because ground processing in a high-frequency is performed for the quarter-wavelength strip line resonator, there are drawbacks that characteristics of a resonance frequency and a no-loaded Q factor ($Q=\omega_o/2\Delta\omega$, $\omega_o$ denotes a resonance angular frequency and $\Delta\omega$ denotes a full width at half maximum) vary. To solve the drawbacks, a dual mode resonator in which two types microwaves having two different frequencies are resonated or a microwave is resonated in two stages by utilizing two independent resonance modes occurring in a ring-shaped resonator not grounded in high-frequency has been proposed for the purpose of downsizing a resonator. The dual mode resonator is, for example, written in a technical Report MW92-115 (1992-12) of Microwave Research in the Institute of Electronics. Information and Communication Engineers.

A conventional dual mode resonator is described with reference to FIG. 4.

FIG. 4 is an oblique view of a conventional dual mode resonator.

As shown in FIG. 4, a conventional dual mode resonator 41 comprises a rectangular-shaped strip line 42 for resonating two microwaves having two different frequencies f1 and f2, a lumped constant capacitor 43 connected to connecting points A, B of the rectangular-shaped strip line 42 for electromagnetically influencing the microwave having the frequency f1, a dielectric substrate 44 mounting the strip line 42, and a grounded conductive plate 45 mounting the dielectric substrate 44. Electric characteristics of the rectangular-shaped strip line 42 is the same as those of a ring-shaped strip line. The strip line 42 is made of a microstrip line. However, it is applicable that the strip line 42 be made of a balanced strip line.

In the above-configuration, when a first input terminal (not shown) connected to the connecting point A is excited by a first signal (or a first microwave) having a frequency f1, an electric voltage at the connecting point A is increased to a maximum value. Therefore, the first signal is transferred from the first input terminal to the connecting point A of the strip line 42. Thereafter, the first signal is circulated in the strip line 42 in clockwise and counterclockwise directions in a first resonance mode. In this case, electric voltages at connecting points C and D spaced 90 degrees in the electric length (or a quarter-wave length of the first signal) apart from the connecting point A are respectively reduced to a minimum value, so that the first signal is not output from the connecting point C or D to a terminal (not shown) connected to the connecting point C or D. Also, an electric voltage at the connecting point B spaced 180 degrees in the electric length (or a half-wave length of the first signal) apart from the connecting point A is increased to the maximum value, so that the first signal is output from the connecting point B to a first output terminal (not shown) connected to the connecting point B.

In contrast, when a second input terminal (not shown) connected to the connecting point C is excited by a second signal (or a second microwave) having a frequency f2, an electric voltage at the connecting point C is increased to a maximum value. Therefore, the second signal is transferred from the second input terminal to the connecting point C of the strip line 42. Thereafter, the second signal is circulated in the stripline 42 in clockwise and counterclockwise directions in a second resonance mode. In this case, electric voltages at the connecting points A and B spaced 90 degrees in the electric length apart from the connecting point C are respectively reduced to a minimum value, so that the second signal is not output from the connecting point A or B to the first input or output terminal connected to the connecting point A or B. Also, an electric voltage at the connecting point D spaced 180 degrees in the electric length apart from the connecting point C is increased to the maximum value, so that the second signal is output from the connecting point B to a second output terminal (not shown) connected to the connecting point D.

Because any lumped constant capacitor connected to the connecting points C and D is not provided, the frequency f1 differs from the frequency f2. However, in cases where a capacitor having the same capacity as that of the capacitor 43 is provided to be connected between the connecting points C and D, the frequency f2 is equal to the frequency f1. Also, in cases where the capacitor 43 is removed, the frequency f1 is equal to the frequency f2. Therefore, the frequencies f1 and f2 resonated in the first and second resonance modes independent each other are the same. In other words, the conventional dual mode resonator 41 functions as a two-stage resonator in which two microwaves having the same frequency are resonated in two stages arranged in parallel.

Accordingly, the resonator 41 comprising the strip line 42 and the capacitor 43 functions as a dual mode resonator in which two microwaves are resonated in two resonance modes independent each other. Because the resonator 41 is not grounded in high-frequency as a special feature of a dual mode resonator and because radiation loss of the microwave is lessened because of a closed-shape strip line as another special feature of the dual mode resonator, the resonator 41 can be manufactured in a small size without losing the special features of a one-wavelength ring-shaped dual mode resonator.

2.6. Problems of the Third Previously Proposed Art to be solved by the Invention However, it is required to accurately set a lumped capacity of the capacitor 43 for the purpose of obtaining a resonance frequency of a microwave at a good reproductivity. In actual manufacturing of the dual mode resonator 41, it is difficult to accurately set a lumped capacity of the capacitor 43. In cases where a frequency adjusting element is additionally provided for the dual mode resonator 41 to accurately set a lumped capacity of the capacitor 43, the number of constitutional parts of the dual mode resonator 41 is increased. Therefore, there are drawbacks that resonating functions of the resonator 41 are degraded and a manufacturing cost of the resonator 41 is increased.

SUMMARY OF THE INVENTION

A first object of the present invention is to provide, with due consideration to the drawbacks of such a conventional dual mode strip-line filter, a strip-line filter in which frequency adjustment of a microwave is easily performed and a small sized filter is manufactured in a plane shape.

A second object of the present invention is to provide a strip-line filter in which attenuation characteristics of a microwave in the neighborhood of a passband of the microwave is improved and a small sized filter is manufactured in a plane shape.

A third object of the present invention is to provide a dual mode resonator in which a resonance frequency of a microwave is accurately set at a good reproductivity, frequency adjustment of the microwave is easily performed, and a small sized resonator having a high Q factor is manufactured at a low cost.

The first object of the present invention is achieved by the provision of a strip-line filter in which two microwaves are resonated and filtered, comprising:

first one-wavelength loop-shaped strip line resonator having a uniform line impedance for selectively resonating a first microwave according to a first resonance mode and selectively resonating a second microwave according to a second resonance mode orthogonal to the first resonance mode, the first one-wavelength loop-shaped strip line resonator having a first coupling strip line, and a first coupling point A, a second coupling point B spaced 180 degrees in electric length apart from the first coupling point A, a third coupling point C spaced 90 degrees in electric length apart from the first coupling point A and a fourth coupling point D spaced 180 degrees in electric length apart from the third coupling point C being placed in the first one-wavelength loop-shaped strip line resonator;

a first microwave inputting element for inputting the first microwave to the first one-wavelength loop-shaped strip line resonator to maximize a first electric voltage induced in the first one-wavelength loop-shaped strip line resonator by the first microwave at the coupling points A and B;

a second microwave inputting element for inputting the second microwave to the first one-wavelength loop-shaped strip line resonator to maximize a second electric voltage induced in the first one-wavelength loop-shaped strip line resonator by the second microwave at the coupling points C and D;

a pair of first open-end transmission lines connected to the coupling points A and B of the first one-wavelength loop-shaped strip line resonator for electromagnetically influencing the first microwave resonated in the first one-wavelength loop-shaped strip line resonator, the first open-end transmission lines having the same electromagnetic characteristics, and a first wavelength of the first microwave being determined by the line impedance of the first one-wavelength loop-shaped strip line resonator and the electromagnetic characteristics of the first open-end transmission lines;

a second one-wavelength loop-shaped strip line resonator having the same uniform line impedance as that of the first one-wavelength loop-shaped strip line resonator for selectively resonating the first microwave resonated in the first one-wavelength loop-shaped strip line resonator according to the first resonance mode and selectively resonating the second microwave resonated in the first one-wavelength loop-shaped strip line resonator according to the second resonance mode, the second one-wavelength loop-shaped strip line resonator having a second coupling strip line which faces the first coupling strip line of the first one-wavelength loop-shaped strip line resonator in parallel through a parallel coupling space to couple the second one-wavelength loop-shaped strip line resonator to the first one-wavelength loop-shaped strip line resonator, and a fifth coupling point E, a sixth coupling point F spaced 180 degrees in electric length apart from the fifth coupling point E, a seventh coupling point G spaced 90 degrees in electric length apart from the fifth coupling point E and an eighth coupling point H spaced 180 degrees in electric length apart from the seventh coupling point G being placed in the second one-wavelength loop-shaped strip line resonator;

a pair of second open-end transmission lines connected to two coupling points selected from among the coupling points E,F,G,H of the second one-wavelength loop-shaped strip line resonator for electromagnetically influencing the first microwave resonated in the second one-wavelength loop-shaped strip line resonator, the second open-end transmission lines respectively having the same electromagnetic characteristics as those of the first open-end transmission lines;

a first microwave outputting element for outputting the first microwave resonated in the second one-wavelength loop-shaped strip line resonator from a coupling point at which one of the second open-end transmission lines is connected; and a second microwave outputting element for outputting the second microwave resonated in the second one-wavelength loop-shaped strip line resonator from another coupling point at which any second open-end transmission line is not connected.

In the above configuration, a first microwave is input to the first one-wavelength loop-shaped strip line resonator and is selectively resonated according to a first resonance mode. In this case, a first electric voltage induced by the first microwave is maximized at the coupling points A and B, so that the first microwave is electromagnetically influenced by the first open-end transmission lines connected to the coupling points A and C. Therefore, a first wavelength of the first microwave is determined by the line impedance of the first one-wavelength loop-shaped strip line resonator and the electromagnetic characteristics of the first open-end transmission lines. That is, the first wavelength of the first microwave is longer than a line length of the first one-wavelength loop-shaped strip line resonator.

Thereafter, the first one-wavelength loop-shaped strip line resonator couples to the second one-wavelength loop-shaped strip line resonator because the second coupling strip line of the second one-wavelength loop-shaped strip line resonator faces the first coupling strip line of the first one-wavelength loop-shaped strip line resonator in parallel through a parallel coupling space, and the first microwave is transferred to the second one-wavelength loop-shaped strip line resonator. Thereafter, the first microwave are selectively resonated in the second one-wavelength loop-shaped strip line resonator in the same manner according to the first resonance mode while the second open-end transmission lines electromagnetically influences the first microwave, and the first microwave is output to the first microwave outputting element.

In contrast, a second microwave input to the first one-wavelength loop-shaped strip line resonator is selectively resonated according to a second resonance mode orthogonal to the first resonance mode. In this case, a second electric voltage induced by the second microwave is maximized at the coupling points C and D, so that the second microwave is not influenced by the first open-end transmission lines connected to the coupling points A and C. Thereafter, the second microwave is transferred to the second one-wavelength loop-shaped strip line resonator in the same manner as the first microwave and is selectively resonated without any influence of the second open-end transmission lines. Thereafter, the second microwave is output to the second microwave outputting element.

Accordingly, two microwaves can be independently resonated and filtered in the strip-line filter because the first and second microwaves are selectively resonated according to the different resonance modes orthogonal to each other.

Also, because the first microwave is electromagnetically influenced by the first and second open-end transmission lines, even though a first wavelength of the first microwave is longer than line lengths of the first and second one-wavelength loop-shaped strip line resonators, the first microwave can be filtered in the strip-line filter. Therefore, the line lengths of the first and second one-wavelength loop-shaped strip line resonators can be shortened, and the strip-line filter can be manufactured in a small size.

Also, the first wavelength of the first microwave can be easily adjusted by trimming or overlaying the first and second open-end transmission lines.

It is preferred that the first and second open-end transmission lines be respectively formed of a strip line, the first and second microwave inputting elements be respectively formed of a strip line, and the first and second microwave outputting elements be respectively formed of a strip line.

In the above configuration, because all constitutional elements of the strip-line filter are formed of strip lines, the strip-line filter can be manufactured in a plane shape.

The second object of the present invention is achieved by the provision of a strip-line filter in which a microwave is resonated and filtered, comprising:

a series of one-wavelength loop-shaped strip line resonators respectively having a uniform line impedance for respectively resonating and filtering a microwave according to a first resonance mode in which electric voltages at both a first coupling point and a second coupling point spaced 180 degrees in electric length apart from the first coupling point are maximized and respectively resonating and filtering the microwave according to a second resonance mode in which electric voltages at both a third coupling point spaced 90 degrees in electric length apart from the first coupling point and a fourth coupling point spaced 180 degrees in electric length apart from the third coupling point are maximized, each of the one-wavelength loop-shaped strip line resonators having a first parallel coupling line between the first and third coupling points and a second parallel coupling line between the second and fourth coupling points, the second parallel coupling line of a one-wavelength loop-shaped strip line resonator arranged in an N-th stage (N is an integral number) being electromagnetically coupled to the first parallel coupling line of another one-wavelength loop-shaped strip line resonator arranged in an (N+1)-th stage to transfer the microwave from the one-wavelength loop-shaped strip line resonator arranged in the N-th stage to the one-wavelength loop-shaped strip line resonator arranged in the (N+1)-th stage;

four open-end transmission lines connected to the first, second, third and fourth coupling points of each of the one-wavelength loop-shaped strip line resonators for electromagnetically influencing the microwave resonated in each of the one-wavelength loop-shaped strip line resonators, the open-end transmission lines having the same electromagnetic characteristics;

a microwave inputting element for inputting the microwave to the first coupling point of a one-wavelength loop-shaped strip line resonator arranged in a first stage, the microwave input by the microwave inputting element being resonated according to the first resonance mode by stages and being transferred to a one-wavelength loop-shaped strip line resonator arranged in a final stage;

an inter-stage coupling circuit for transferring the microwave resonated according to the first resonance mode from the second coupling point of the one-wavelength loop-shaped strip line resonator arranged in the final stage to the third coupling point of the one-wavelength loop-shaped strip line resonator arranged in the first stage, the microwave transferred by the inter-stage coupling circuit being resonated according to the second resonance mode by stages and being transferred to the one-wavelength loop-shaped strip line resonator arranged in the final stage; and a microwave outputting element for outputting the microwave resonated according to the second resonance mode in the one-wavelength loop-shaped strip line resonator arranged in the final stage.

In the above configuration, in cases where a microwave resonated according to the firs resonance mode (or the second resonance mode) is transferred to a one-wavelength loop-shaped strip line resonator arranged in an N-th stage, a second parallel coupling line of the one-wavelength loop-shaped strip line resonator arranged in the N-th stage is electromagnetically coupled to a first parallel coupling line of a one-wavelength loop-shaped strip line resonator arranged in an N+1)-th stage. Therefore, the microwave resonated is transferred by stages from a one-wavelength loop-shaped strip line resonator arranged ill a first stage to another one-wavelength loop-shaped strip line resonator arranged in a final stage.

When a microwave is transferred from the microwave inputting means to the first coupling point of the one-wavelength loop-shaped strip line resonator arranged in the first stage, the microwave is resonated and filtered according to the first resonance mode in each of the one-wavelength loop-shaped strip line resonators. In this case, the microwave is influenced by the open-end transmission lines connected to the first and second coupling points. Therefore, the microwave having a wavelength longer than a line length of each of the one-wavelength loop-shaped strip line resonators can be resonated. Finally, the microwave is transferred to the one-wavelength loop-shaped strip line resonator arranged in the final stage. Thereafter, the microwave is transferred from the second coupling point of the, one-wavelength loop-shaped strip line resonator arranged in the final stage to the third coupling point of the one-wavelength loop-shaped strip line resonator arranged in the first stage. Thereafter, the microwave is resonated and filtered according to the second resonance mode in each of the one-wavelength loop-shaped strip line resonators. In this case, the microwave is influenced by the open-end transmission lines connected to the third and fourth coupling points. Finally, the microwave is transferred to the one-wavelength loop-shaped strip line resonator arranged in the final stage. Thereafter, the microwave is output from the fourth coupling point of the one-wavelength loop-shaped strip line resonator arranged in the final stage.

Accordingly, attenuation characteristics of a microwave in the neighborhood of a passband of the microwave can be improved because the microwave is resonated and filtered two times in each of the one-wavelength loop-shaped strip line resonators.

Also, because the open-end transmission lines influence the microwave, a small sized filter can be manufactured.

It is preferred that the one-wavelength loop-shaped strip line resonators be respectively in a rectangular shape, the one-wavelength loop-shaped strip line resonators respectively have two first parallel lines longer than 90 degrees in electric length and two second parallel lines shorter than 90 degrees in electric length, the first and fourth coupling points be placed at the same first parallel line of each of the one-wavelength loop-shaped strip line resonators, the second and third coupling points be placed at the other first parallel line of each of the one-wavelength loop-shaped strip line resonators, and the first and second parallel coupling lines be formed of the second parallel lines of each of the one-wavelength loop-shaped strip line resonators.

In the above configuration, because the fourth coupling point equivalent to a midpoint between the first; and second coupling points is far from the second parallel coupling line and because the third coupling point equivalent to a midpoint between the first and second coupling points is far from the first parallel coupling line, a pair of notches surrounding a passband of the microwave resonated according to the first resonance mode can be formed, and the attenuation characteristics of the microwave can be enhanced.

Also, because the second coupling point equivalent to a midpoint between the third and fourth coupling points is far from the second parallel coupling line and because the first coupling point equivalent to a midpoint between the third and fourth coupling points is far from the first parallel coupling line, the notches surrounding the passband of the microwave resonated according to the second resonance mode can be deepened, and the attenuation characteristics of the microwave can be moreover enhanced.

Also, the second object of the present invention is achieved by the provision of a strip-line filter in which a microwave is resonated and filtered, comprising:

a series of one-wavelength loop-shaped strip line resonators respectively having a uniform line impedance for respectively resonating and filtering a microwave according to a first resonance mode in which electric voltages at both a first coupling point and a second coupling point spaced 180 degrees in electric length apart from the first coupling point are maximized and respectively resonating and filtering the microwave according to a second resonance mode in which electric voltages at both a third coupling point spaced 90 degrees in electric length apart from the first coupling point and a fourth coupling point spaced 180 degrees in electric length apart from the third coupling point are maximized, each of the one-wavelength loop-shaped strip line resonators having a first parallel coupling line between the first and third coupling points and a second parallel coupling line between the second and fourth coupling points, the second parallel coupling line of a one-wavelength loop-shaped strip line resonator arranged in an N-th stage (N is an integral number) being electromagnetically coupled to the first parallel coupling line of another one-wavelength loop-shaped strip line resonator arranged in an (N+1)-th stage to transfer the microwave between the one-wavelength loop-shaped strip line resonator arranged in the N-th stage and the one-wavelength loop-shaped strip line resonator arranged in the (N+1)-th stage;

four open-end transmission lines connected to the first, second, third and fourth coupling points of each of the one-wavelength loop-shaped strip line resonators for electromagnetically influencing the microwave resonated in each of the one-wavelength loop-shaped strip line resonators, the open-end transmission lines having the same electromagnetic characteristics;

a microwave inputting element for inputting the microwave to the first coupling point of a one-wavelength loop-shaped strip line resonator arranged in a first stage, the microwave input by the microwave inputting element being resonated according to the first resonance mode by stages and being transferred to a one-wavelength loop-shaped strip line resonator arranged in a final stage;

an inter-stage coupling circuit for transferring the microwave resonated according to the first resonance mode from the second coupling point of the one-wavelength loop-shaped strip line resonator arranged in the final stage to the fourth coupling point of the one-wavelength loop-shaped strip line resonator arranged in the final stage, the microwave transferred by the inter-stage coupling circuit being resonated according to the second resonance mode by stages and being transferred form the one-wavelength loop-shaped strip line resonator arranged in the final stage to the one-wavelength loop-shaped strip line resonator arranged in the first stage; and a microwave outputting element for outputting the microwave resonated according to the second resonance mode in the one-wavelength loop-shaped strip line resonator arranged in the first stage.

In the above configuration, the microwave resonated according to the first resonance mode by stages is transferred to the one-wavelength loop-shaped strip line resonator arranged in the final stage, in the same manner. Thereafter, the microwave is transferred from the second coupling point to the fourth coupling point of the one-wavelength loop-shaped strip line resonator arranged in the final stage. Thereafter, the microwave is resonated and filtered according to the second resonance mode in each of the one-wavelength loop-shaped strip line resonators, and transferred from the one-wavelength loop-shaped strip line resonator arranged in the final stage to the one-wavelength loop-shaped strip line resonator arranged in the first stage. In this case, the microwave is influenced by the open-end transmission lines connected to the third and fourth coupling points. Thereafter, the microwave is output from the third coupling point of the one-wavelength loop-shaped strip line resonator arranged in the first stage.

Accordingly, attenuation characteristics of a microwave in the neighborhood of a passband of the microwave can be improved because the microwave is resonated and filtered two times in each of the one-wavelength loop-shaped strip line resonators.

Also, because the open-end transmission lines influence the microwave, a small sized filter can be manufactured.

Also, the second object of the present invention is achieved by the provision of a strip-line filter in which a microwave is resonated and filtered, comprising:

a first one-wavelength loop-shaped strip line resonator having a uniform line impedance for resonating and filtering a microwave according to a first resonance mode in which electric voltages at both a first coupling point and a second coupling point spaced 180 degrees in electric length apart from the first coupling point are maximized and respectively resonating and filtering the microwave according to a second resonance mode in which electric voltages at both a third coupling point spaced 90 degrees in electric length apart from the first coupling point and a fourth coupling point spaced 180 degrees in electric length apart from the third coupling point are maximized, the first one-wavelength loop-shaped strip line resonator having a first parallel coupling line between the first and third coupling points and a second parallel coupling line between the second and fourth coupling points;

a microwave inputting element for inputting the microwave to the first coupling point of the first one-wavelength loop-shaped strip line resonator to resonate the microwave according to the first resonance mode in the first one-wavelength loop-shaped strip line resonator;

a second one-wavelength loop-shaped strip line resonator having the same uniform line impedance as that of the first one-wavelength loop-shaped strip line resonator for resonating and filtering the microwave according to the first resonance mode in which electric voltages at both a fifth coupling point and a sixth coupling point spaced 180 degrees in electric length apart from the fifth coupling point are maximized and respectively resonating and filtering the microwave according to the second resonance mode in which electric voltages at both a seventh coupling point spaced 90 degrees in electric length apart from the fifth coupling point and an eighth coupling point spaced 180 degrees in electric length apart from the seventh coupling point are maximized, the second one-wavelength loop-shaped strip line resonator having a third parallel coupling line between the fifth and seventh coupling points and a fourth parallel coupling line between the sixth and eighth coupling points, the third parallel coupling line being electromagnetically coupled to the second parallel coupling line of the first one-wavelength loop-shaped strip line resonator to transfer the microwave resonated according to the first or second resonance mode in the first one-wavelength loop-shaped strip line resonator to the second one-wavelength loop-shaped strip line resonator, and the fourth parallel coupling line being electromagnetically coupled to the first parallel coupling line of the first one-wavelength loop-shaped strip line resonator to transfer the microwave resonated according to the first resonance mode in the second one-wavelength loop-shaped strip line resonator to the first one-wavelength loop-shaped strip line resonator in which the microwave is resonated according to the second resonance mode; and a microwave outputting element for outputting the microwave resonated according to the second resonance mode in the second one-wavelength loop-shaped strip line resonator.

In the above configuration, the microwave input to the first coupling point of the first one-wavelength loop-shaped strip line resonator is resonated according to the first resonance mode, and the microwave is transferred to the second one-wavelength loop-shaped strip line resonator through the second and fourth parallel coupling lines coupled to each other and is resonated according to the first resonance mode. Thereafter, the microwave is transferred to the first one-wavelength loop-shaped strip line resonator through the second and fourth parallel coupling lines coupled to each other and is resonated according to the second resonance mode. Thereafter, the microwave is again transferred to the second one-wavelength loop-shaped strip line resonator through the second and fourth parallel coupling lines coupled to each other and is resonated according to the second resonance mode. Thereafter, the microwave is output from the eighth coupling point.

Accordingly, attenuation characteristics off a microwave in the neighborhood of a passband of the microwave can be improved because the microwave is resonated and filtered two times in each of the one-wavelength loop-shaped strip line resonators.

Also, because the open-end transmission lines influence the microwave, a small sized filter can be manufactured.

The third object of the present invention is achieved by the provision of a dual mode resonator for resonating two microwaves, comprising:

a one-wavelength loop-shaped strip line having a uniform line impedance for resonating a first microwave according to a first resonance mode and resonating a second microwave according to a second resonance mode orthogonal to the first resonance mode, electric voltage induced by the first microwave being maximized at a first coupling point A and a second coupling point B spaced 180 degrees in electric length apart from the first coupling point A, and electric voltage induced by the second microwave being maximized at a third coupling point C spaced 90 degrees in electric length apart from the first coupling point A and a fourth coupling point D spaced 180 degrees in electric length apart from the third coupling point C;

a first open-end coupling strip line for electromagnetically influencing the first microwave, the first open-end coupling strip line being placed in an inside area surrounded by the one-wavelength loop-shaped strip line;

a second open-end coupling strip line having the same electromagnetic characteristics as those of the first open-end coupling strip line for electromagnetically influencing the first microwave, the second open-end coupling strip line being coupled to the first open-end coupling strip line to form a capacitor having a distributed capacity;

a first lead-in strip line for connecting the first open-end coupling strip line to the coupling point A of the one-wavelength loop-shaped strip line to lead the first microwave in the first open-end coupling strip line; and a second lead-in strip line for connecting the second open-end coupling strip line to the coupling point B of the one-wavelength loop-shaped strip line to lead the first microwave in the second open-end coupling strip line.

In the above configuration, a first microwave is circulated in the one-wavelength loop-shaped strip line while the first and second open-end coupling strip lines functioning as a capacitor having a distributed capacity electromagnetically influence the first microwave because electric voltage induced by the first microwave is maximized at the coupling points A and B. Therefore, even though a first wavelength of the first microwave is longer than a line length of the one-wavelength loop-shaped strip line, an electric length of the one-wavelength loop-shaped strip line agrees with the first wavelength, and the first microwave is resonated. A degree of influence of the first and second open-end coupling strip lines on the first microwave is adjusted by trimming or overlaying the the first and second open-end coupling strip lines.

In contrast, a second microwave is circulated in the one-wavelength loop-shaped strip line. In this case, the second microwave is not influenced by the first and second open-end coupling strip lines because electric voltage induced by the second microwave is maximized at the coupling points C and D. Therefore, the second microwave having a second wavelength which agrees with the electric length of the one-wavelength loop-shaped strip line is resonated.

Accordingly, because a degree of influence of the first and second open-end coupling strip lines on the first microwave is adjusted by trimming or overlaying the the first and second open-end coupling strip lines, a resonance frequency of the first microwave can be accurately set at a good reproductivity, and frequency adjustment of the microwave can be easily performed.

Also, because the first and second open-end coupling strip lines influence the first microwave, a small sized resonator can be manufactured at a low cost.

Also, because the first and second open-end coupling strip lines function as a capacitor having a distributed capacity, electric field induced between the first and second open-end coupling strip lines is dispersed. Therefore, loss of the electric field is reduced, and a no-loaded Q factor can be increased.

BRIEF DESCRIPTION OF THE DRAWINGS

The objects, features and advantages of the present invention will be apparent from the following description taken in conjunction with the accompanying drawings, in which:

FIGS. 43A and 48B are respectively a plan view of a dual mode resonator according to a modification of the fifteenth embodiment;

DESCRIPTION OF THE PREFERRED EMBODIMENTS

Preferred embodiments of a strip-line filter according to the present invention are described with reference to drawings.

Figure 1:
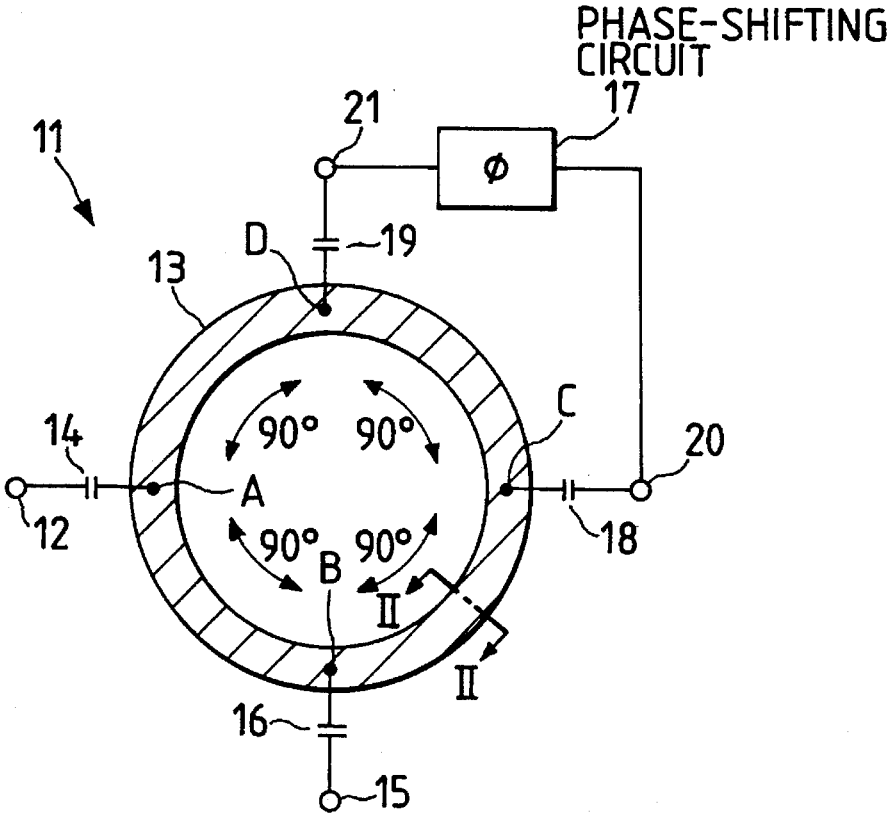
FIG. 1 PRIOR ART
FIG. 1 is a plan view of a conventional dual mode stripline filter.
Figure 2A:
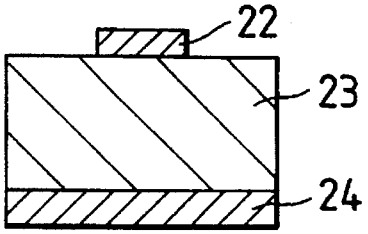
FIG. 2A PRIOR ART
FIG. 2A is a sectional view taken generally along the line II—II of FIG. 1.
Figure 2B:
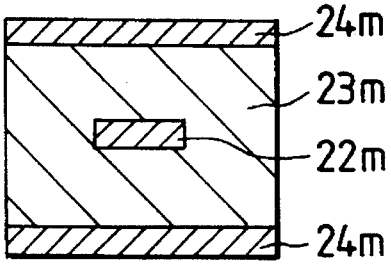
FIG. 2B PRIOR ART
FIG. 2B is another sectional view taken generally along the line II—II of FIG. 1 according to a modification.
Figure 3:
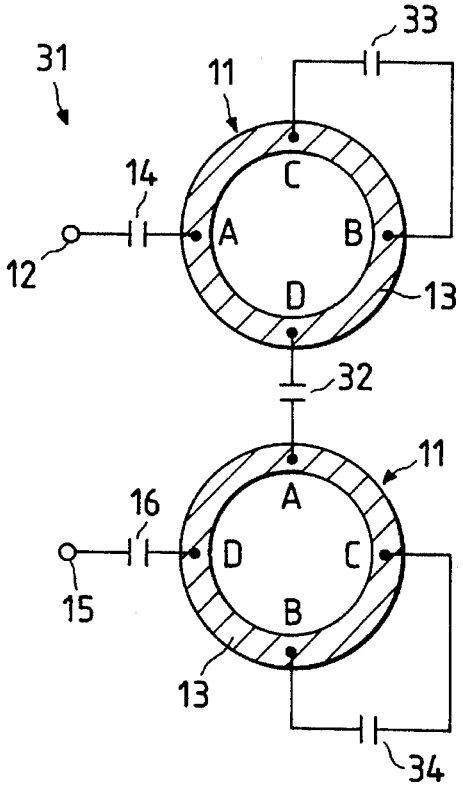
FIG. 3 PRIOR ART
FIG. 3 is a plan view of another conventional dual mode strip-line filter.
Figure 4:
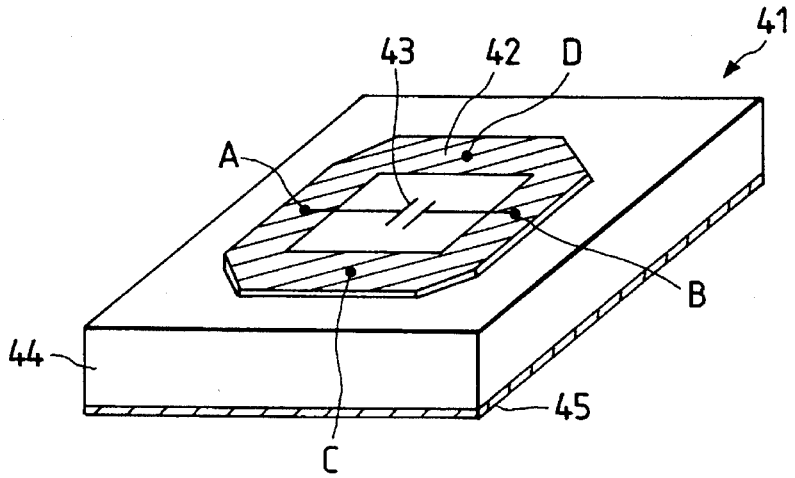
FIG. 4 PRIOR ART
FIG. 4 is an oblique view of a conventional dual mode resonator.
Figure 5:
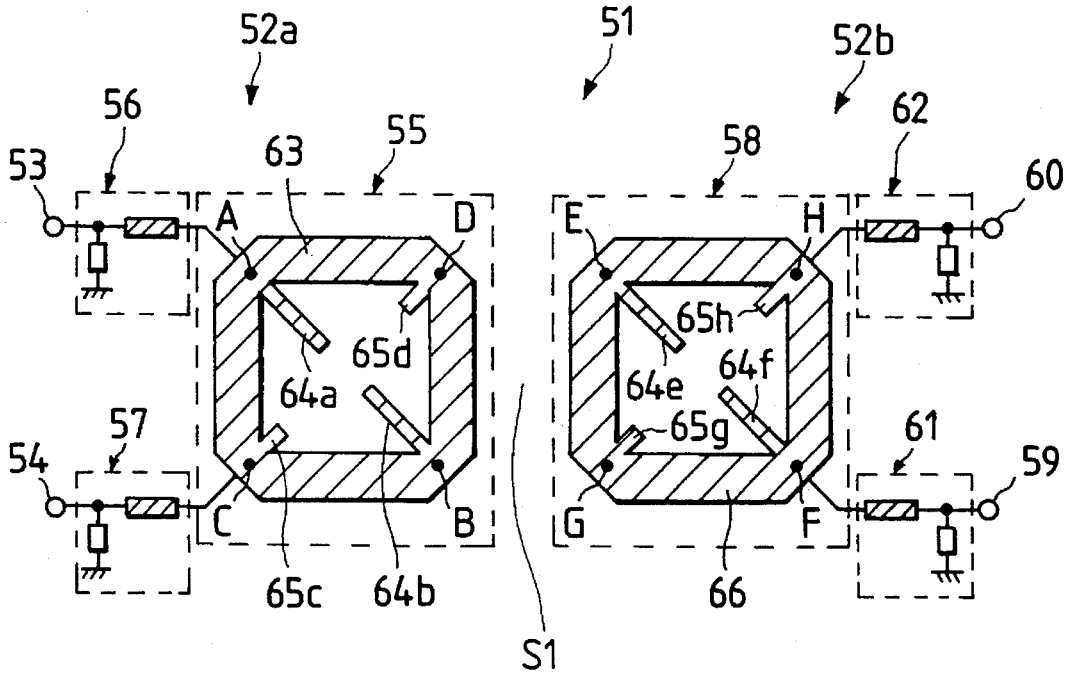
FIG. 5 is a plan view of a strip-line filter according to a first embodiment of the present invention.

FIG. 5 is a plan view of a strip-line filter according to a first embodiment of the present invention.

As shown in FIG. 5, a strip-line filter 51 comprises an upper-stage filter 52*a* and a lower-stage filter 52*b* coupled to the upper-stage filter 52*a* through a parallel coupling space S1 in electromagnetic coupling. The upper-stage filter 52*a* comprises a first input terminal 53 excited by a first signal (or a first microwave) having a first resonance frequency f1, a second input terminal 54 excited by a second signal (or a second microwave) having a second resonance frequency f2, an upper-stage resonator 55 in which the first and second signals are resonated, a first input transmission line 56 connecting the first input terminal 53 with a coupling point A of the resonator 55 to couple the first input terminal 53 to the resonator 55, and a second input transmission line 57 connecting the second input terminal 54 with a coupling point C of the resonator 55 to couple the second input terminal 54 to the resonator 55. The lower-stage filter 52*b* comprises a lower-stage resonator 58 in which the first and second signals are resonated, a first output terminal 59 from which the first signal is output, a second output terminal 60 from which the second signal is output, a first output transmission line 61 connecting the first output terminal 59 with a coupling point F of the resonator 58 to couple the first output terminal 59 to the resonator 58, and a second output transmission line 62 connecting the second output terminal 60 with a coupling point H of the resonator 58 to couple the second output terminal 60 to the resonator 58. The shape of the upper-stage resonator 55 is the same as that of the lower-stage resonator 58.

The upper-stage resonator 55 comprises a one-wavelength square-shaped strip line resonator 63 having a uniform characteristic line impedance, a pair of first open-end transmission lines 64*a*, 64*b* connected to coupling points A and B of the resonator 63 for electromagnetically influencing the first signal, and a pair of second open-end transmission lines 65*c*, 65*d* connected to coupling points C and D of the resonator 63 for electromagnetically influencing the second signal. The one-wavelength square-shaped strip line resonator 63 represents a one-wavelength loop-shaped strip line resonator. The first open-end transmission lines 64*a*, 64*b* have the same electromagnetic characteristics, and the second open-end transmission lines 65*c*, 65*d* have the same electromagnetic characteristics which differ from those of the first open-end transmission lines 64*a*, 64*b*. The coupling points A,C,B and D are placed at four corners of the line resonator 63 in that order. In detail, the coupling point B is spaced 180 degrees in the electric length apart from the coupling point A. The coupling point C is spaced 90 degrees in the electric length apart from the coupling point A. The coupling point D is spaced 180 degrees in the electric length apart from the coupling point C.

The lower-stage resonator 58 comprises a one-wavelength square-shaped strip line resonator 66 having the same uniform characteristic line impedance as that of the resonator 63, first open-end transmission lines 64*e*, 64*f* connected to coupling points E and F of the resonator 66, and second open-end transmission lines 65*g*, 65*h* connected to coupling points G and H of the resonator 66. The one-wavelength square-shaped strip line resonator 66 represents a one-wavelength loop-shaped strip line resonator. The first open-end transmission lines 64*e*, 64*f* have the same electromagnetic characteristics as those of the first open-end transmission lines 64*a*, 64*b*, and the second open-end transmission lines 65*g*, 65*h* have the same electromagnetic characteristics as those of the second open-end transmission lines 65*c*, 65*d*. The coupling points E,G,F and H are placed at flour corners of the line resonator 66 and are spaced 90 degrees in the electric length in that order. A straight strip line of the resonator 63 between the coupling points B and D faces a straight strip line of the resonator 66 between the coupling points G and E in parallel through the parallel coupling space S1 to arrange the first open-end transmission lines 64*a*, 64*b* of the resonator 55 symmetrically to the first open-end transmission lines 64*e*, 64*f* of the resonator 58 with respect to a central point of the parallel coupling space S1.

In the above configuration, when the first input terminal 53 is excited by microwaves having various frequencies in which a first signal having a resonance frequency f1 (or a resonance wavelength $\lambda_1$) is included, the first input terminal 53 is coupled to the coupling point A of the resonator 63 through the first input transmission line 56, and the microwaves including the first signal are transferred to the upper-stage resonator 55. Thereafter, the first signal is selectively resonated in the upper-stage resonator 55 at the resonance frequency f1 according to a first resonance mode. The resonance frequency f1 selectively resonated is determined by a characteristic impedance of the line resonator 63 and electromagnetic characteristics of the first open-end transmission lines 64*a*, 64*b*. In this case, a half-wavelength $\lambda_1/2$ corresponding to the resonance frequency f1 is longer than a line length between the coupling points A and B because of the electromagnetic characteristics of the first open-end transmission lines 64*a*, 64*b*. Thereafter, electric voltages at the coupling points A and B reach a maximum value, and electric currents at the coupling points C and D reach a maximum value. That is, electric voltages at the coupling points C and D are zero. Thereafter, the first signal resonated is transferred to the lower-stage resonator 58 through the parallel coupling space S1 because the upper-stage filter 52*a* is coupled to the lower-stage filter 52*b*. Thereafter, the first signal is selectively resonated in the resonator 58 at the resonance frequency f1 according to the first resonance mode. Electric voltages at the coupling points E and F reach a maximum value, and electric currents at the coupling points G and H reach a maximum value. That is, electric voltages at the coupling points G and H are zero. Thereafter, the first signal resonated in the resonator 58 is transferred to the first output terminal 59 through the first output transmission line 61 because the electric voltage of the coupling point F is maximized.

In contrast, when the second input terminal 54 is excited by microwaves having various frequencies in which a second signal having a resonance frequency f2 (or a resonance wavelength $\lambda_2$) is included, the second input terminal 54 is coupled to the coupling point C of the resonator 55 through the second input transmission line 57, and the microwaves including the second signal are transferred to the resonator 55. Thereafter, the second signal is selectively resonated in the resonator 55 at the resonance frequency f2 according to a second resonance mode. The resonance frequency f2 selectively resonated is determined by a characteristic impedance of the line resonator 63 and electromagnetic characteristics of the second open-end transmission lines 65*c*, 65*d*. In this case, a half-wavelength $\lambda_2/2$ corresponding to the resonance frequency f2 is longer than a line length between the coupling points C and D because of the electromagnetic characteristics of the second open-end transmission lines 65*c*, 65*d*. Thereafter, electric voltages at the coupling points C and D reach a maximum value, and electric currents at the coupling points A and B reach a maximum value. That is, electric voltages at the coupling points A and B are zero. Thereafter, the second signal resonated is transferred to the resonator 66 through the parallel coupling space S1, and the second signal is selectively resonated in the resonator 66 at the resonance frequency f2 according to the second resonance mode. Electric voltages at the coupling points G and H reach a maximum value, and electric currents at the coupling points E and F reach a maximum value. That is, electric voltages at the coupling points E and F are zero. Thereafter, the second signal resonated in the resonator 66 is transferred to the second output terminal 60 through the second output transmission line 62 because the electric voltage of the coupling point H is maximized.

A first phase of the first signal resonated according to the first resonance mode and another phase of the second signal resonated according to the second resonance mode are orthogonal to each other in each of the upper-stage and the lower-stage resonators 55, 58. Therefore, even though an electric voltage of the first signal (or the second signal) is maximized at a first point, because an electric voltage of the first signal (or the second signal) at a second point spaced 90 degrees in the electric length apart from the first point is zero, the first signal does not couple to the second signal at the second point at which an electric voltage of the second signal (or the first signal) is maximized. In other words, the first and second signals having different frequencies f1, f2 coexist independently in the strip-line filter 51.

Accordingly, the upper-stage and lower-stage resonators 55, 58 of the strip-line filter 51 can function as resonators for the first and second signals having different resonance frequencies, and the strip-line filter 51 can function as a filter for the first and second signals.

Also, because the half-wavelength $\lambda_1/2$ corresponding to the resonance frequency f1 is longer than a line length between the coupling points A and B and because the half-wavelength $\lambda_2/2$ corresponding to the resonance frequency f2 is longer than a line length between the coupling points C and D, the resonance frequencies f1, f2 can be lower than an original resonance frequency f0 corresponding to a wavelength $\lambda_o$ of which a half value $\lambda_o/2$ is equal to the line length between the coupling points A and B (that is, the line length between the coupling points C and D). In other words, sizes of the resonators 63, 66 can be smaller than that of a resonator in which any open-end transmission lines do not provided, so that the strip-line filter 51 can be manufactured in a small size.

Also, because a straight strip line of the resonator 63 and another straight strip line of the resonator 66 arranged in parallel to each other are coupled to each other through the parallel coupling space S1, the upper-stage resonator 63 and the lower-stage resonator 66 can be arranged closely to each other. Therefore, the strip-line filter 51 can be manufactured in a small size.

Also, the resonance frequency f1 can be arbitrarily set by setting the first open-end transmission lines 64*a*, 64*b*, 64*e* and 64*f* to a prescribed length and the resonance frequency f2 can be arbitrarily set by setting the second open-end transmission lines 65*c*, 65*d*, 65*g* and 65*h*.

Also, the resonance frequency f1 can be accurately adjusted by trimming or overlaying end portions of the first open-end transmission lines 64*a*, 64*b*, 64*e* and 64*f*, and the resonance frequency f2 can be accurately adjusted by trimming or overlaying end portions of the second open-end transmission lines 65*c*, 65*d*, 65*g* and 65*h*.

Also, because the open-end transmission lines are formed of strip lines, the strip-line filter 51 can be manufactured in a plane shape.

Figure 6:
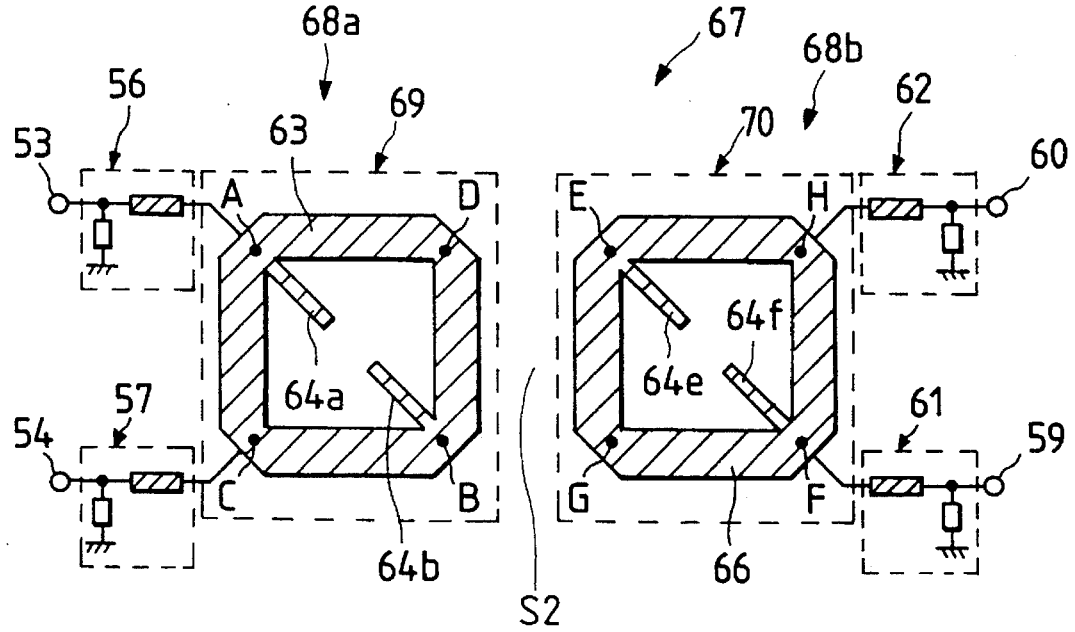
FIG. 6 is a plan view of a strip-line filter according to a modification of the first embodiment.

FIG. 6 is a plan view of a strip-line filter according to a modification of the first embodiment.

As shown in FIG. 6, a strip-line filter 67 comprises an upper-stage filter 68*a* and a lower-stage filter 68*b* coupled to the upper-stage filter 68*a* through a parallel coupling space S2 in electromagnetic coupling. The upper-stage filter 68*a* comprises the first input terminal 53, the second input terminal 54 excited by a third signal (or a third microwave) having an original resonance frequency f0, an upper-stage resonator 69 in which the first and third signals are resonated, the first input transmission line 56 connecting the first input terminal 53 with a coupling point A of the resonator 69, and the second input transmission line 57 connecting the second input terminal 54 with a coupling point C of the resonator 69. The lower-stage filter 68*b* comprises a lower-stage resonator 70 in which the first and third signals are resonated, the first output terminal 59, the second output terminal 60 from which the third signal is output, the first output transmission line 61 connecting the first output terminal 59 with a coupling point F of the resonator 70, and the second output transmission line 62 connecting the second output terminal 60 with a coupling point H off the resonator 70.

The upper-stage resonator 69 comprises the one-wavelength rectangular-shaped strip line resonator 63 and the first open-end transmission lines 64*a*, 64*b*. The lower-stage resonator 70 comprises the one-wavelength rectangular-shaped strip line resonator 66 and the first open-end transmission lines 64*e*, 64*f*. A straight strip line of the resonator 63 between the coupling points B and D faces a straight strip line of the resonator 66 between the coupling points G and E in parallel through the parallel coupling space S2 to arrange the first open-end transmission lines 64*a*, 64*b* of the resonator 69 symmetrically to the first open-end transmission lines 64*e*, 64*f* of the resonator 70 with respect to a central point of the parallel coupling space S2.

In the above configuration, the first signal is resonated and filtered in the strip-line filter 67 in the same manner as in the strip-line filter 51. In contrast, when the second input terminal 54 is excited by microwaves having various frequencies in which a third signal having an original resonance frequency f0 (or an original resonance wavelength $\lambda_o$) is included, the third signal is selectively resonated in the resonator 69 at the original resonance frequency f0 according to an original resonance mode. The original resonance frequency f0 selectively resonated is determined by the characteristic impedance of the line resonator 63. Therefore, the original resonance frequency f0 is higher than the resonance frequency f1. Thereafter, the third signal is transferred to the lower-stage resonator 70 and is resonated and filtered. Thereafter, the third signal is output from the second output terminal 60.

Accordingly, the third signal which has an original resonance frequency f0 determined by the characteristic impedance of the line resonator 63 can be resonated and filtered in the strip-line filter 67 in addition to the resonance and filtering of the first signal.

Also, frequency adjustment of the first signal can be easily performed, and a small sized filter for filtering the first and third signals can be manufactured in a plane shape.

In the first embodiment shown in FIGS. 5 and 6, the open-end transmission lines are integrally formed with the line resonators 63, 66 according to a pattern formation. However, it is applicable that the open-end transmission lines be formed after the line resonators 63, 66 are formed.

Next, a second embodiment is described with reference to FIGS. 7 and 8.

Figure 7:
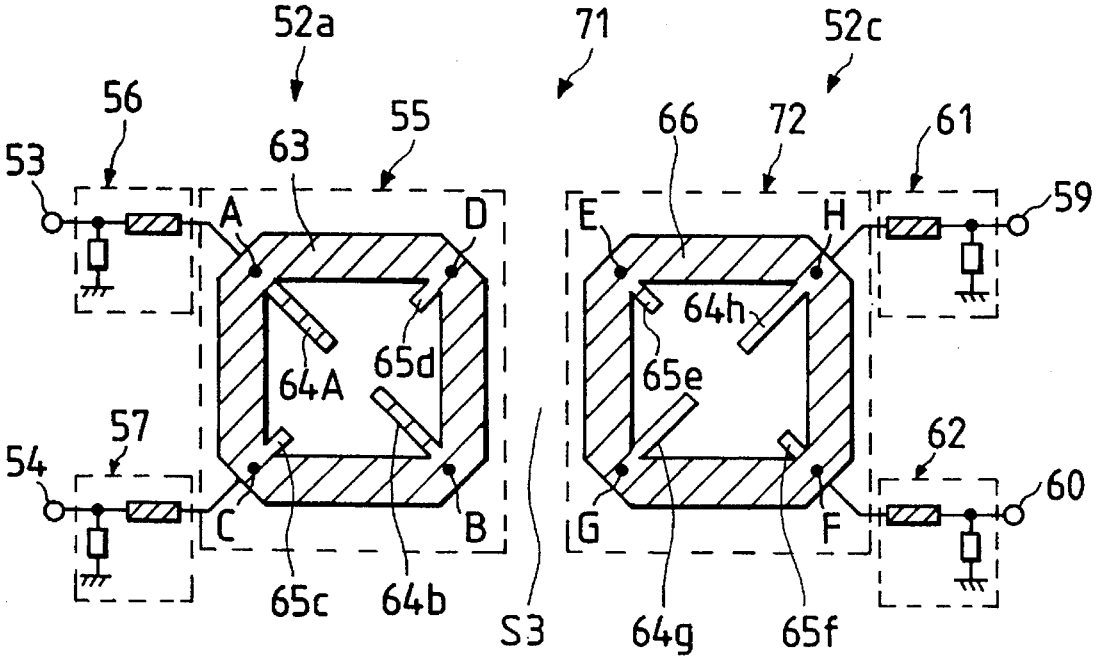
FIG. 7 is a plan view of a strip-line filter according to a second embodiment of the present invention.

FIG. 7 is a plan view of a strip-line filter according to a second embodiment of the present invention.

As shown in FIG. 7, a strip-line filter 71 comprises the upper-stage filter 52*a* and a lower-stage filter 52*c* coupled to the upper-stage filter 52*a* through a parallel coupling space S3 in electromagnetic coupling. The lower-stage filter 52*c* comprises a lower-stage resonator 72 in which the first and second signals having the resonance frequencies f1, f2 are resonated, the first output terminal 59, the second output terminal 60, the first output transmission line 61 connecting the first output terminal 59 with a coupling point H of the resonator 72, and the second output transmission line 62 connecting the second output terminal 60 with a coupling point F of the resonator 72. The lower-stage resonator 72 comprises the one-wavelength rectangular-shaped strip line resonator 66, a pair of first open-end transmission lines 64*g*, 64*h* connected to coupling points G and H of the resonator 66, and a pair of second open-end transmission lines 65*e*, 65*f* connected to coupling points E and F of the resonator 66. The first open-end transmission lines 64*g*, 64*h* have the same electromagnetic characteristics as those of the first open-end transmission lines 64*a*, 64*b*, and the second open-end transmission lines 65*e*, 65*f* have the same electromagnetic characteristics as those of the second open-end transmission lines 65*c*, 65*d*. The coupling points E,F,G and H are spaced 90 degrees in the electric length apart in that order. A straight strip line of the resonator 63 between the coupling points B and D faces a straight strip line of the resonator 66 between the coupling points G and E in parallel through the parallel coupling space S3 to arrange the first open-end transmission lines 64*a*, 64*b* of the resonator 55 symmetrically to the first open-end transmission lines 64*g*, 64*h* of the resonator 72 with respect to a central axis of the parallel coupling space S3.

In the above configuration, a first signal having the resonance frequency f1 (or the resonance wavelength $\lambda_1$) is resonated and filtered in the upper-stage filter 52*a* in the same manner as in the first embodiment. That is, the resonance frequency f1 is determined by the characteristic impedance of the line resonator 63 and the electromagnetic characteristics of the first open-end transmission lines 64*a*, 64*b*, so that the half-wavelength $\lambda_1/2$ corresponding to the resonance frequency f1 is longer than a line length between the coupling points A and B. Thereafter, the first signal is transferred to the lower-stage filter 52*c* through the parallel coupling space S3. Thereafter, the first signal is selectively resonated in the resonator 72 at the resonance frequency f1 according to the first resonance mode. Electric voltages at the coupling points G and H reach a maximum value, and electric currents at the coupling points E and F reach a maximum value. That is, electric voltages at the coupling points E and F are zero. Thereafter, the first signal resonated in the resonator 72 is transferred to the first output terminal 59 through the first output transmission line 61 because the electric voltage of the coupling point H is maximized.

In contrast, a second signal having the resonance frequency f2 (or the resonance wavelength $\lambda_2$) is resonated and filtered in the upper-stage filter 52*a* in the same manner as in the first embodiment. That is, the resonance frequency f2 is determined by the characteristic impedance of the line resonator 63 and the electromagnetic characteristics of the second open-end transmission lines 65*c*, 65*d*, so that the half-wavelength $\lambda_2/2$ corresponding to the resonance frequency f2 is longer than a line length between the coupling points C and D. Thereafter, the second signal is transferred to the lower-stage filter 52*c* through the parallel coupling space S3. Thereafter, the second signal is selectively resonated in the resonator 72 at the resonance frequency f2 according to the second resonance mode. Electric voltages at the coupling points E and F reach a maximum value, and electric currents at the coupling points G and H reach a maximum value. That is, electric voltages at the coupling points G and H are zero. Thereafter, the second signal resonated in the resonator 72 is transferred to the second output terminal 60 through the second output transmission line 62 because the electric voltage of the coupling point F is maximized.

The first phase of the first signal resonated according to the first resonance mode and the second phase of the second signal resonated according to the second resonance mode are orthogonal to each other in each of the upper-stage and the lower-stage resonators 55, 72. Therefore, even though an electric voltage of the first signal (or the second signal) is maximized at a first point, because an electric voltage of the first signal (or the second signal) at a second point spaced 90 degrees in the electric length apart from the first point is zero, the first signal does not couple to the second signal at the second point at which an electric voltage of the second signal (or the first signal) is maximized. In other words, the first and second signals having different frequencies f1, f2 coexist independently in the strip-line filter 71.

Accordingly, the upper-stage and lower-stage resonators 55, 72 of the strip-line filter 71 can function as resonators for the first and second signals having different resonance frequencies, and the strip-line filter 71 can function as a filter for the first and second signals.

Also, because the half-wavelength $\lambda_1/2$ corresponding to the resonance frequency f1 is longer than a line length between the coupling points A and B and because the half-wavelength $\lambda_2/2$ corresponding to the resonance frequency f2 is longer than a line length between the coupling points C and D, the resonance frequencies f1, f2 can be lower than an original resonance frequency f0 corresponding to a wavelength $\lambda_o$ of which a half value $\lambda_o/2$ is equal to the line length between the coupling points A and B (that is, the line length between the coupling points C and D). In other words, sizes of the resonators 63, 66 can be smaller than that of a resonator in which any open-end transmission lines do not provided, so that the strip-line filter 71 can be manufactured in a small size.

Also, because a straight strip line of the resonator 63 and another straight strip line of the resonator 66 arranged in parallel to each other are coupled to each other through the parallel coupling space S3, the upper-stage resonator 63 and the lower-stage resonator 66 can be arranged closely to each other. Therefore, the strip-line filter 71 can be manufactured in a small size.

Also, the resonance frequency f1 can be arbitrarily set by setting the first open-end transmission lines to a prescribed line length, and the resonance frequency f2 can be arbitrarily set by setting the second open-end transmission lines to a prescribed line length.

Also, the resonance frequency f1 can be accurately adjusted by trimming or overlaying end portions of the first open-end transmission lines, and the resonance frequency f2 can be accurately adjusted by trimming or overlaying end portions of the second open-end transmission lines.

Also, because all of the open-end transmission lines are formed of strip lines, the strip-line filter 71 can be manufactured in a plane shape.

Figure 8:
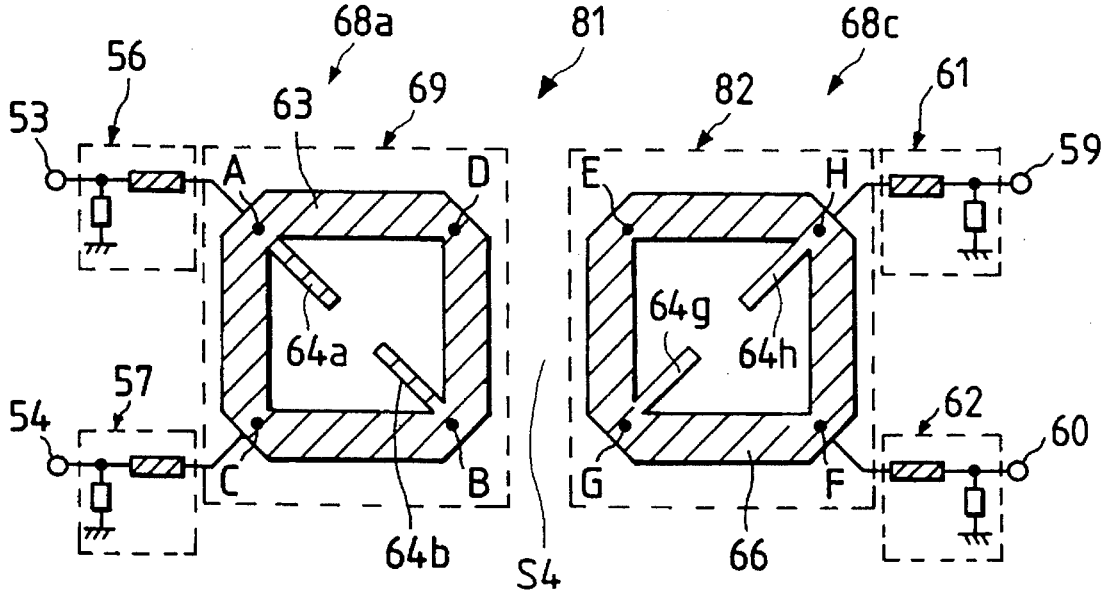
FIG. 8 is a plan view of a strip-line filter according to a modification of the second embodiment.

FIG. 8 is a plan view of a strip-line filter according to a modification of the second embodiment.

As shown in FIG. 8, a strip-line filter 81 comprises the upper-stage filter 68*a* and a lower-stage filter 68*c* coupled to the upper-stage filter 68*a* through a parallel coupling space S4 in electromagnetic coupling. The lower-stage filter 68*c* comprises a lower-stage resonator 82 in which the first and third signals are resonated, the first output terminal 59, the second output terminal 60, the first output transmission line 61 connecting the first output terminal 59 with a coupling point H of the resonator 82, and the second output transmission line 62 connecting the second output terminal 60 with a coupling point F of the resonator 82. The lower-stage resonator 82 comprises the one-wavelength rectangular-shaped strip line resonator 66 and the first open-end transmission lines 64*g*, 64*h* connected to coupling points G and H of the resonator 66. The coupling points E,F,G and H are spaced 90 degrees in the electric length apart in that order. A straight strip line of the resonator 63 between the coupling points B and D faces a straight strip line of the resonator 66 between the coupling points G and E in parallel through the parallel coupling space S4 to arrange the first open-end transmission lines 64*a*, 64*b* of the resonator 69 symmetrically to the first open-end transmission lines 64*g*, 64*h* of the resonator 82 with respect to a central axis of the parallel coupling space S4.

In the above configuration, a first signal having the resonance frequency f1 resonated and filtered in the upper-stage filter 68*a* in the same manner as in the first embodiment is transferred to the lower-stage filter 68*c* through the parallel coupling space S4. Thereafter, the first signal is selectively resonated in the resonator 82 at the resonance frequency f1 according to the first resonance mode. Electric voltages at the coupling points G and H reach a maximum value, and electric voltages at the coupling points E and F are zero. Thereafter, the first signal resonated in the resonator 82 is transferred to the first output terminal 59 through the first output transmission line 61 because the electric voltage of the coupling point H is maximized.

In contrast, a third signal having the original resonance frequency f0 resonated and filtered in the upper-stage filter 68*a* in the same manner as in the first embodiment is transferred to the lower-stage filter 68*c* through the parallel coupling space S4. Thereafter, the third signal is selectively resonated in the resonator 82 at the resonance frequency f0 according to the third resonance mode. Electric voltages at the coupling points E and F reach a maximum value, and electric voltages at the coupling points G and H are zero. Thereafter, the third signal resonated in the resonator 82 is transferred to the second output terminal 60 through tile second output transmission line 62 because the electric voltage of the coupling point F is maximized.

Accordingly, the third signal which has the original resonance frequency f0 determined by the characteristic impedance of the line resonator 63 can be resonated and filtered in the strip-line filter 67 in addition to the resonance and filtering of the first signal.

Also, frequency adjustment of the first signal can be easily performed, and a small sized filter for filtering the first and third signals can be manufactured in a plane shape.

In the second embodiment shown in FIGS. 7 and 8, all of the open-end transmission lines are integrally formed with the line resonators 63, 66 according to a pattern formation. However, it is applicable that the open-end transmission lines be formed after the line resonators 63, 66 are formed.

Next, a third embodiment is described with reference to FIG. 9.

Figure 9:
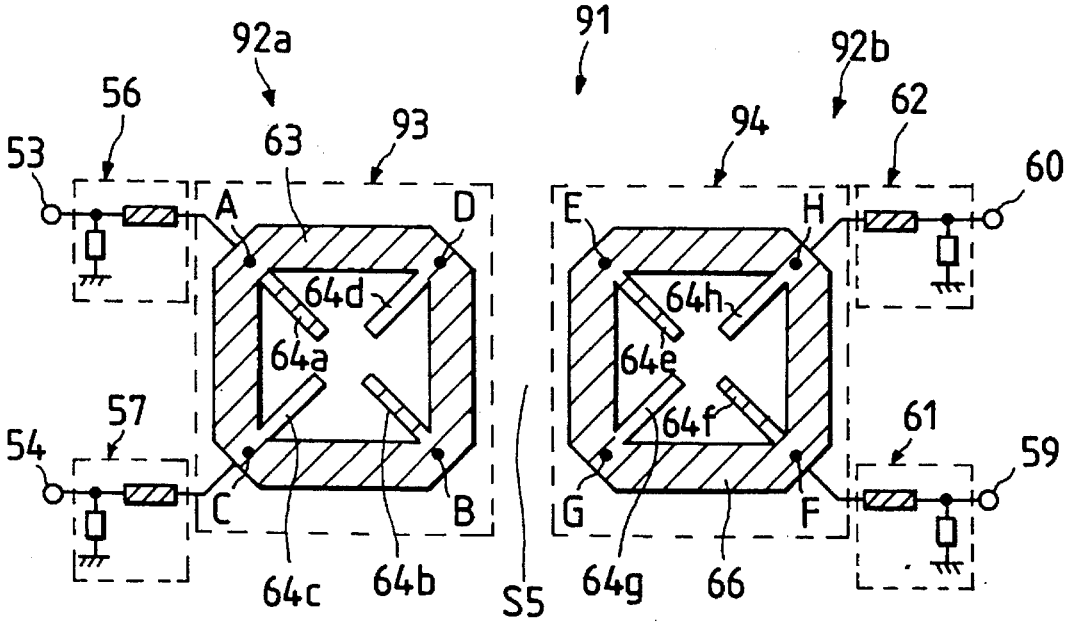
FIG. 9 is a plan view of a strip-line filter according to a third embodiment of the present invention.

FIG. 9 is a plan view of a strip-line filter according to a third embodiment of the present invention.

As shown in FIG. 9, a strip-line filter 91 comprises an upper-stage filter 92*a* arid a lower-stage filter 92*b* coupled to the upper-stage filter 92*a* through a parallel coupling space S5 in electromagnetic coupling. The upper-stage filter 92*a* comprises the first input terminal 53, the second input terminal 54, an upper-stage resonator 93 in which two propagating signals having the same resonance frequency f1 are resonated, the first input transmission line 56, and the second input transmission line 57. The lower-stage filter 92*b* comprises a lower-stage resonator 94 in which the propagating signals are resonated, the first output terminal 59, the second output terminal 60, the first output transmission line 61, and the second output transmission line 62. The upper-stage resonator 93 comprises the one-wavelength rectangular-shaped strip line resonator 63 and four first open-end transmission lines 64*a*, 64*b*, 64*c* and 64*d* connected to the coupling points A to D of the resonator 63. The first open-end transmission lines 64*a*, 64*b*, 64*c* and 64*d* have the same electromagnetic characteristics. The lower-stage resonator 94 comprises the one-wavelength rectangular-shaped strip line resonator 66 and four first open-end transmission lines 64*e*, 64*f*, 64*g* and 64*h* connected to the coupling points E to H of the resonator 66. The first open-end transmission lines 64*e*, 64*f*, 64*g* and 64*h* have the same electromagnetic characteristics as those of the first open-end transmission lines 64*a*, 64*b*, 64*c* and 64*d*. A straight strip line of the resonator 63 between the coupling points B and D faces a straight strip line of the resonator 66 between the coupling points G and E in parallel through the parallel coupling space S5.

In the above configuration, when the first input terminal 53 (or the second input terminal 54) is excited by microwaves having various frequencies in which a propagating signal S1 (or S2) having the resonance frequency f1 is included, the microwaves including the propagating signal are transferred to the upper-stage resonator 93. Thereafter, the propagating signal is selectively resonated in the upper-stage resonator 93 at the resonance frequency f1 according to the first resonance mode. The resonance frequency f1 selectively resonated is determined by the characteristic impedance of the line resonator 63 and electromagnetic characteristics of the first open-end transmission lines 64*a* and 64*b* (or 64*c* and 64*d*). In this case, the half-wavelength $\lambda_1/2$ corresponding to the resonance frequency f1 is longer than a line length between the coupling points A and B (or the coupling points C and D) of the line resonator 63 because of the electromagnetic characteristics of the first open-end transmission lines 64*a* and 64*b* (or 64*c* and 64*d*). Thereafter, electric voltages at the coupling points A and B (or the coupling points C and D) reach a maximum value, and electric voltages at the coupling points C and D (the coupling points A and B) are zero. Thereafter, the propagating signal resonated is transferred to the lower-stage resonator 94 through the parallel coupling space S5, and the propagating signal is selectively resonated in the resonator 94 at the resonance frequency f1 according to the first resonance mode. Electric voltages at the coupling points E and F (or the coupling points G and It) reach a maximum value, and electric voltages at the coupling points G and H (or the coupling points E and F) are zero. Thereafter, the propagating signal resonated in the resonator 94 is transferred to the first output terminal 59 (or the second output terminal 60) through the first output transmission line 61 (or the second output transmission line 62) because the electric voltage of the coupling point H (or the coupling point F) is maximized.

Phases of the propagating signals S1 and S2 resonated according to the first resonance mode are orthogonal to each other in each of the upper-stage and the lower-stage resonators 93, 94. Therefore, even though an electric voltage of the propagating signal S1 is maximized at a first point, because an electric voltage of the propagating signal S1 at a second point spaced 90 degrees in the electric length apart from the first point is zero, the propagating signal S1 does not couple to the propagating signal S2 at the second point at which an electric voltage of the propagating signal S2 is maximized. In other words, the propagating signals S1 and S2 having the same frequency f1 coexist independently in the strip-line filter 91.

Accordingly, the upper-stage and lower-stage resonators 93, 94 of the strip-line filter 91 can function as resonators for the propagating signals having the same resonance frequency, and the strip-line filter 91 can function as a filter for the propagating signals.

Also, because the half-wavelength $\lambda_1/2$ corresponding to the resonance frequency f1 is longer than a line length between the coupling points A and B, the resonance frequency f1 can be lower than an original resonance frequency f0 corresponding to a wavelength $\lambda_o$ of which a half value $\lambda_o/2$ is equal to the line length between the coupling points A and B. In other words, sizes of the resonators 93, 94 can be smaller than that of a resonator in which any open-end transmission lines do not provided, so that the strip-line filter 91 can be manufactured in a small size.

Also, because a straight strip line of the resonator 63 and another straight strip line of the resonator 66 arranged in parallel to each other are coupled to each other through the parallel coupling space S5, the upper-stage resonator 63 and the lower-stage resonator 66 can be arranged closely to each other. Therefore, the strip-line filter 91 can be manufactured in a small size.

Also, the resonance frequency f1 can be arbitrarily set by setting the first open-end transmission lines to a prescribed line length.

Also, the resonance frequency f1 can be accurately adjusted by trimming or overlaying end portions of the first open-end transmission lines.

Also, because all of the open-end transmission lines are formed of strip lines, the strip-line filter 91 can be manufactured in a plane shape.

Next, a fourth embodiment is described with reference to FIG. 10.

In case of the strip-line filters 51, 67, 71, 81 and 91 shown in FIGS. 5 to 9, because the straight strip line of the resonator 63 (or 66) facing the straight strip line of the resonator 66 (or 63) has an electric length of 90 degrees, the coupling between the first-stage filter 52*a*, 68*a* or 92*a* and the second-stage filter 52*b*, 68*b*, 52*c*, 68*c* or 92*b* is strong. Therefore, in cases where the strip-line filter 51, 67, 71, 81 or 91 is utilized in a narrow passband, it is required to widen a distance between the first-stage filter and the second-stage filter. As a result, there is a drawback that it is difficult to lessen unnecessary couplings and make the strip-line filter small. This drawback is solved by the provision of a strip-line filter according to the fourth embodiment.

Figure 10:
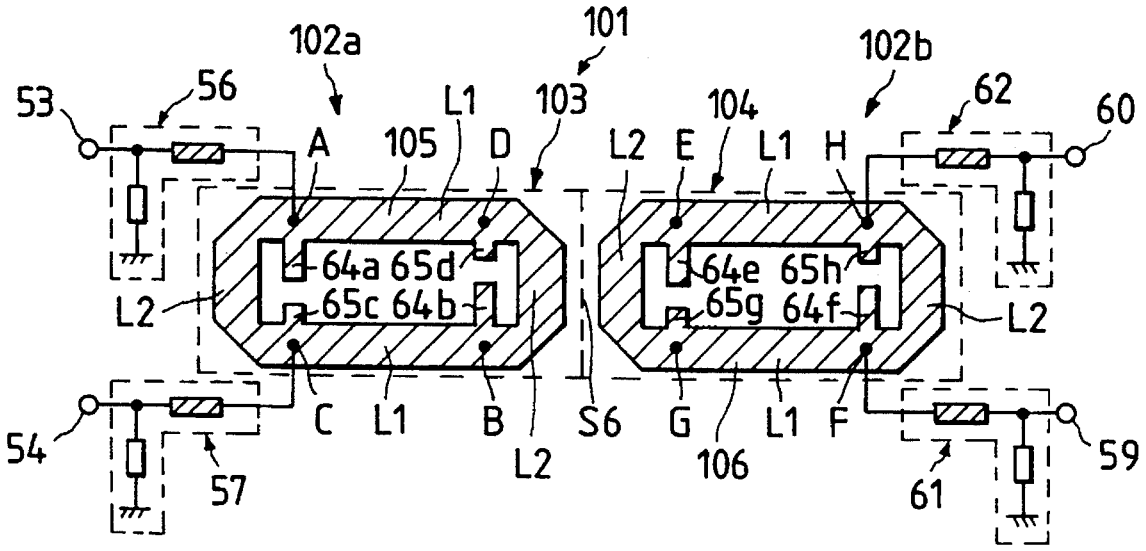
FIG. 10 is a plan view of a strip-line filter according to a fourth embodiment of the present invention.
Figure 11:
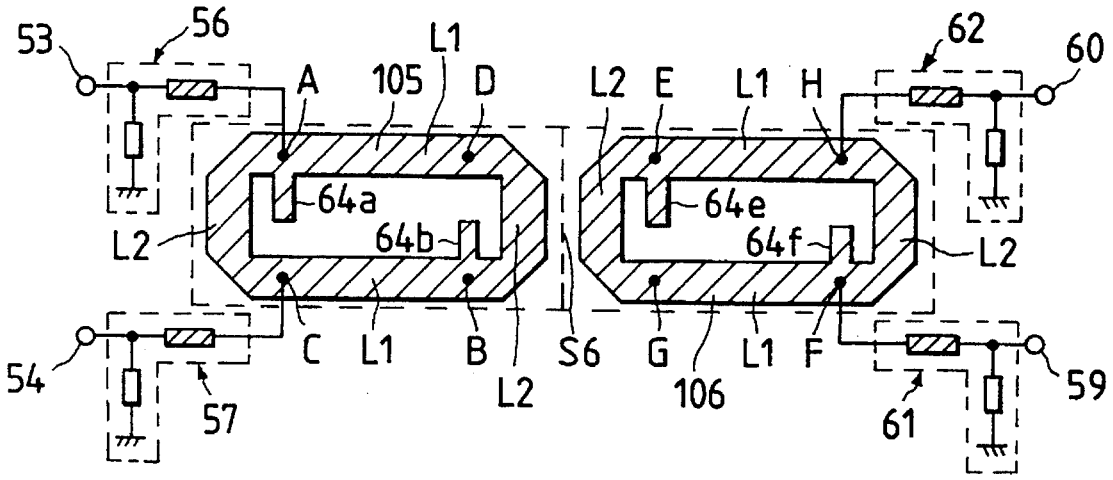
FIG. 11 is a plan view of a strip-line filter according to a modification of the fourth embodiment.
Figure 12:
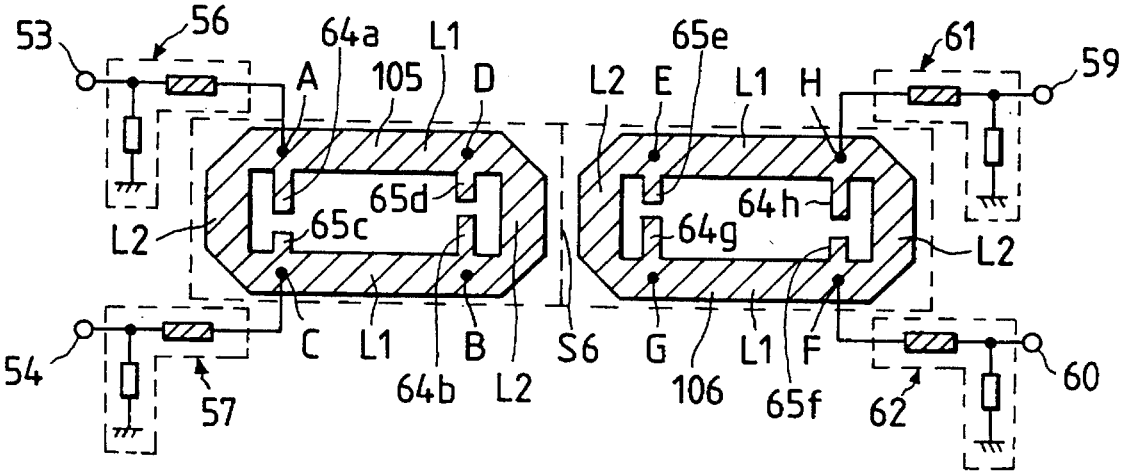
FIG. 12 is a plan view of a strip-line filter according to a modification of the fourth embodiment.
Figure 13:
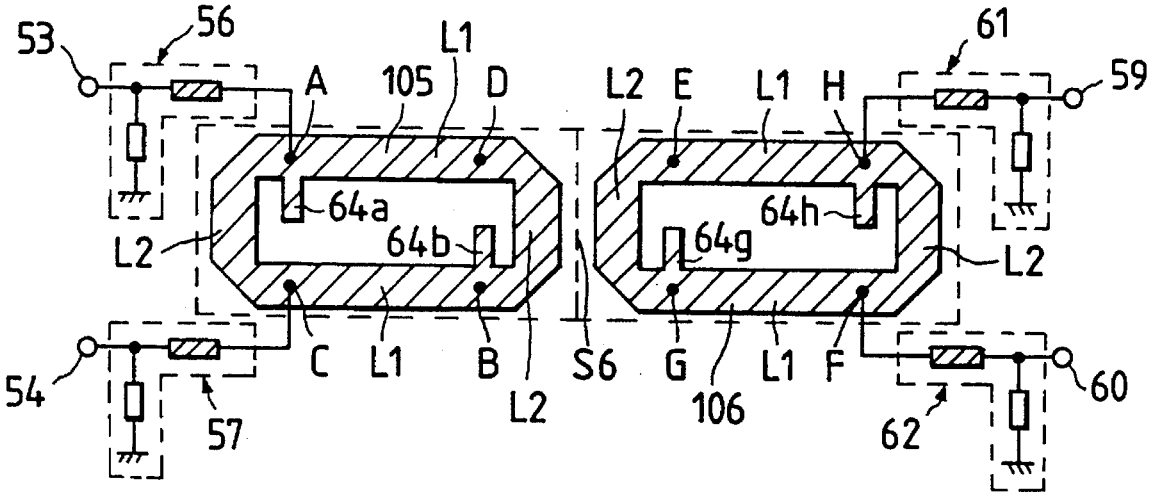
FIG. 13 is a plan view of a strip-line filter according to a modification of the fourth embodiment.
Figure 14:
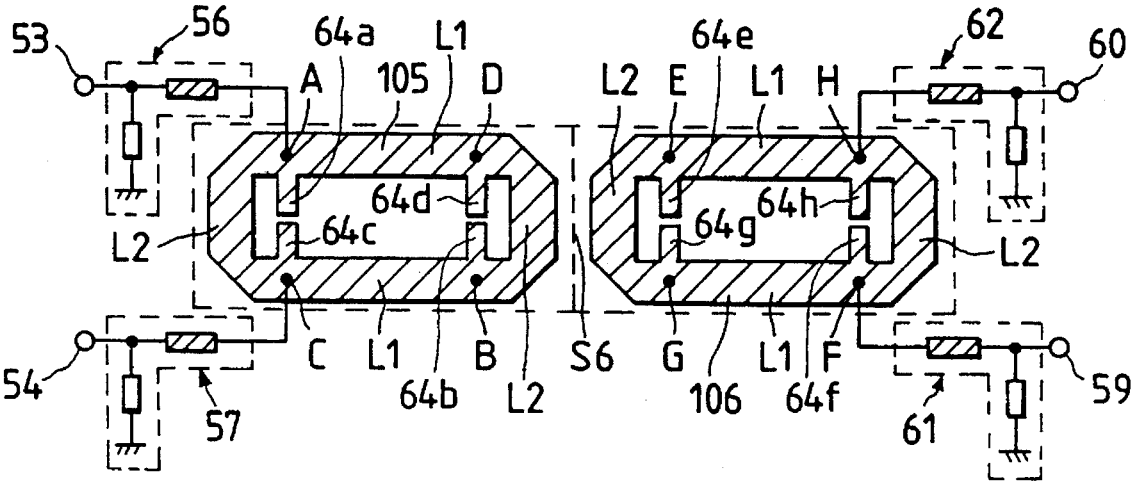
FIG. 14 is a plan view of a strip-line filter according to a modification of the fourth embodiment.

FIG. 10 is a plan view of a strip-line filter according to a fourth embodiment of the present invention.

As shown in FIG. 10, a strip-line filter 101 comprises an upper-stage filter 102*a* and a lower-stage filter 102*b* coupled to the upper-stage filter 102*a* through a parallel coupling space S6 in electromagnetic coupling. The upper-stage filter 102*a* comprises the first input terminal 53, the second input terminal 54, an upper-stage resonator 103 in which first and second signals are resonated, the first input transmission line 56 connecting the first input terminal 53 with a coupling point A of the resonator 103, and the second input transmission line 57 connecting the second input terminal 54 with a coupling point C of the resonator 103. The lower-stage filter 102*b* comprises a lower-stage resonator 104 in which the first and second signals are resonated, the first output terminal 59, the second output terminal 60, the first output transmission line 61 connecting the first output terminal 59 with a coupling point F of the resonator 104, and the second output transmission line 62 connecting the second output terminal 60 with a coupling point H of the resonator 104. The shape of the upper-stage resonator 103 is the same as that of the lower-stage resonator 104.

The upper-stage resonator 103 comprises a one-wavelength rectangular-shaped strip line resonator 105 having a uniform characteristic line impedance, the first open-end transmission lines 64*a*, 64*b* connected to coupling points A and B of the resonator 105, and the second open-end transmission lines 65*c*, 65*d* connected to coupling points C and D of the resonator 105. The one-wavelength rectangular-shaped strip line resonator 105 represents a one-wavelength loop-shaped strip line resonator. The line resonator 105 is composed of two first parallel lines L1 and two second parallel lines L2 shorter than the lines L1. The coupling points A,C,B and D are placed at the first parallel lines L1 of the line resonator 105 and are spaced 90 degrees in the electric length in that order.

The lower-stage resonator 104 comprises a one-wavelength square-shaped strip line 106 having the same uniform characteristic line impedance as that of the resonator 105, the first open-end transmission lines 64*e*, 64*f* connected to coupling points E and F of the line resonator 106, and the second open-end transmission lines 65*g*, 65*h* connected to coupling points G and H of the line resonator 106. The one-wavelength rectangular-shaped strip line resonator 106 represents a one-wavelength loop-shaped strip line resonator. The coupling points E,G,F and H are placed at the first parallel lines L1 of the line resonator 106 and are spaced 90 degrees in the electric length in that order. A second parallel line L2 of the resonator 105 closely faces a second parallel line L2 of the resonator 106 in parallel through the parallel coupling space S6 to arrange the first open-end transmission lines 64*a*, 64*b* of the resonator 103 symmetrically to the first open-end transmission lines 64*e*, 64*f* of the resonator 104 with respect to a central point of the parallel coupling space S6. The second parallel line L2 of the resonator 105 closely facing the resonator 106 is called a parallel coupling line L2, and the second parallel line L2 of the resonator 106 closely facing the resonator 105 is called another parallel coupling line L2.

In the above configuration, electric lengths of the parallel coupling lines L2 of the resonators 105, 106 are respectively less than 90 degrees. Therefore, the coupling between the first-stage filter 102*a* and the second-stage filter 102*b* does not becomes strong even though the first-stage filter 102*a* is arranged closely to the second-stage filter 102*b*.

The operation in the strip-line filter 101 is the same as that in the strip-line filter 51, so that the description of the operation is omitted.

Accordingly, the first-stage filter 102*a* can be arranged closely to the second-stage filter 102*b*, and unnecessary couplings and area occupied by the strip-line filter 101 can be reduced in addition to effects obtained in the first embodiment.

An inventive idea in the fourth embodiment is shown as compared with the strip-line filter 51. However, strip-line filters shown in FIGS. 11 to 14 are also applicable.

Next, a fifth embodiment is described with reference to FIG. 15.

Figure 15:
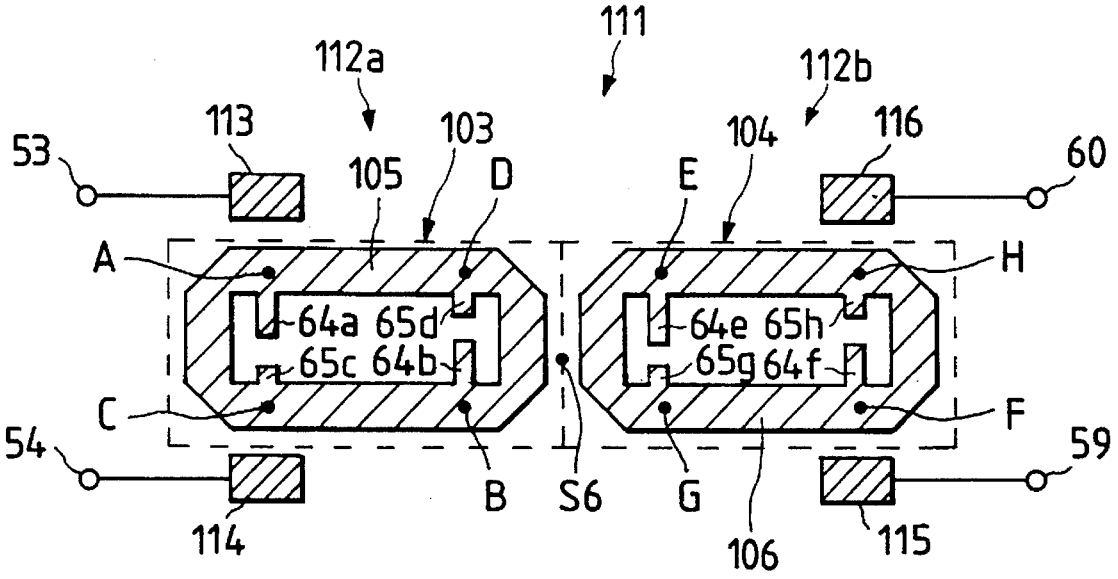
FIG. 15 is a plan view of a strip-line filter according to a fifth embodiment of the present invention.
Figure 16:
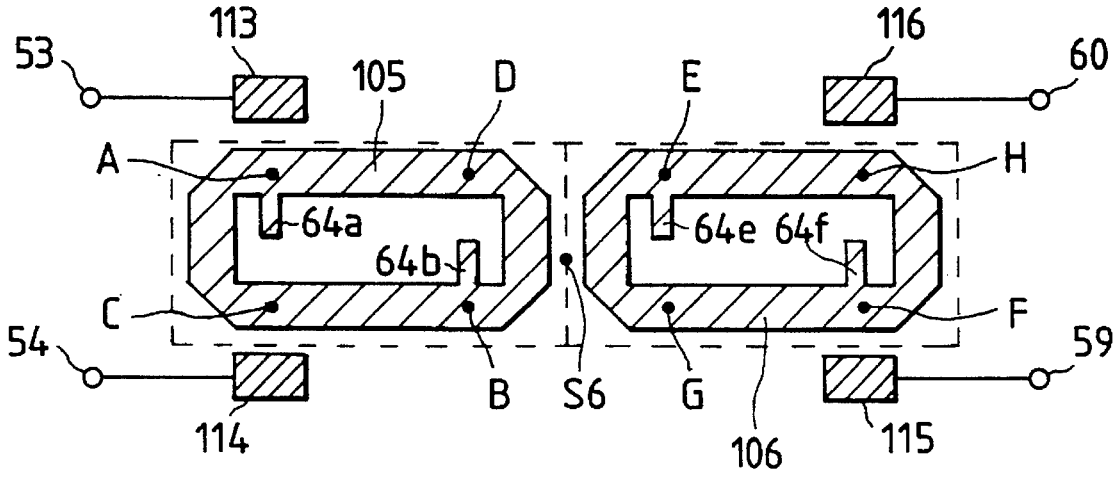
FIG. 16 is a plan view of a strip-line filter according to a modification of the fifth embodiment.
Figure 17:
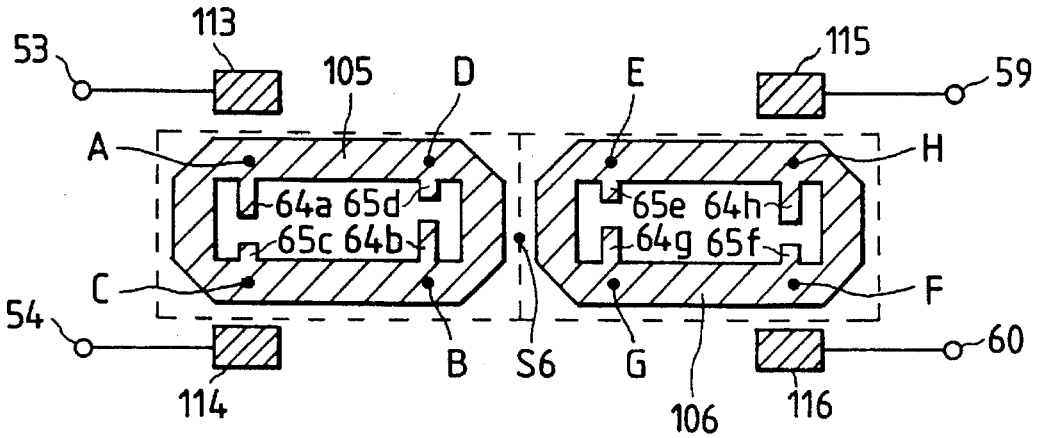
FIG. 17 is a plan view of a strip-line filter according to a modification of the fifth embodiment.
Figure 18:
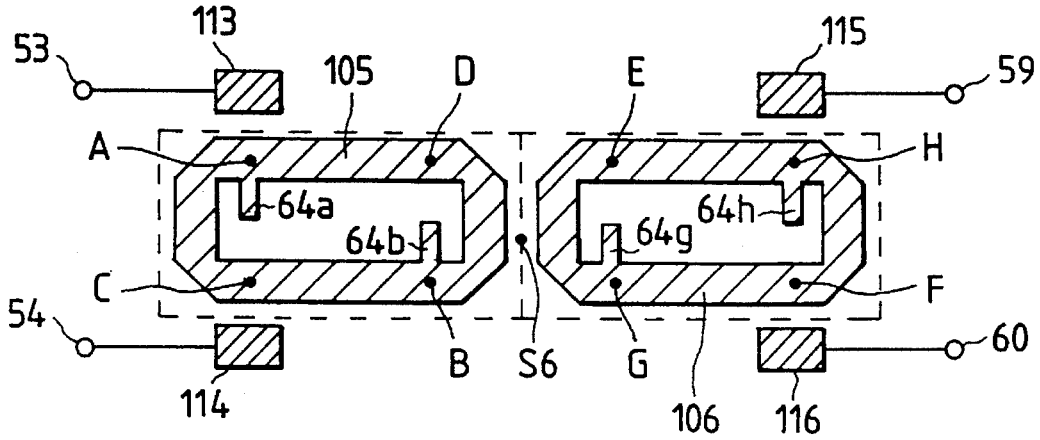
FIG. 18 is a plan view of a strip-line filter according to a modification of the fifth embodiment.
Figure 19:
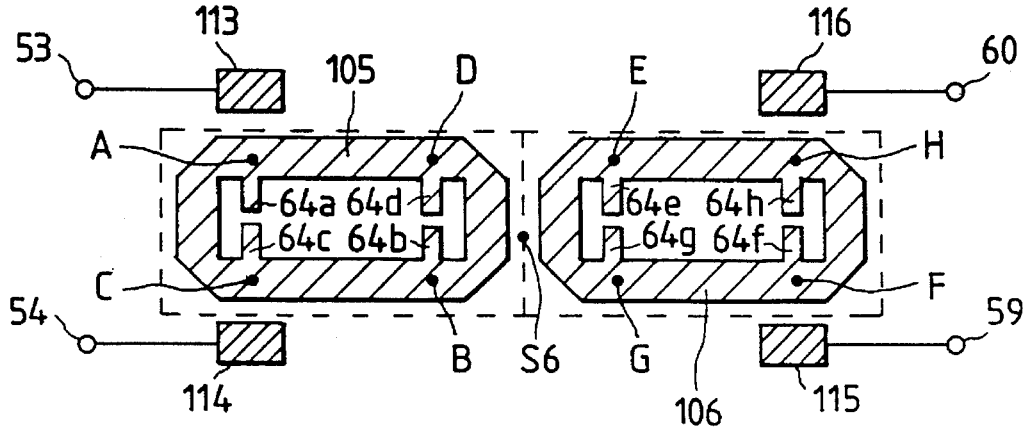
FIG. 19 is a plan view of a strip-line filter according to a modification of the fifth embodiment.

FIG. 15 is a plan view of a strip-line filter according to a fifth embodiment of the present invention.

As shown in FIG. 15, a strip-line filter 111 comprises an upper-stage filter 112*a* and a lower-stage filter 112*b* coupled to the upper-stage filter 112*a* through the parallel coupling space S6 in electromagnetic coupling. The upper-stage filter 102*a* comprises the first input terminal 53, the second input terminal 54, the upper-stage resonator 103, a first input parallel coupling strip line 113 for coupling the first input terminal 53 to the coupling point A of the upper-stage resonator 103, and a second input parallel coupling strip line 114 for coupling the second input terminal 54 to the coupling point C of the upper-stage resonator 103. The lower-stage filter 102*b* comprises the lower-stage resonator 104, the first output terminal 59, the second output terminal 60, a first output parallel coupling strip line 115 for coupling the first output terminal 59 to the coupling point F of the lower-stage resonator 104, a second output parallel coupling strip line 116 for coupling the second output terminal 60 to the coupling point H of the lower-stage resonator 104.

In the above configuration, when the first input terminal 53 is excited by microwaves having various frequencies in which a first signal having the resonance frequency f1 is included, the first input parallel coupling strip line 113 is coupled to a first parallel line L1 of the line resonator 105, and the microwaves are transferred to the upper-stage resonator 103. Thereafter, the first signal is resonated and filtered in the upper-stage resonator 103 and the lower-stage resonator 104 in the same manner as in the first embodiment. Thereafter, the first output parallel coupling strip line 115 is coupled to a first parallel line L1 of the line resonator 106. Therefore, the first signal is output to the first output terminal 59. In contrast, when the second input terminal 54 is excited by microwaves having various frequencies in which a second signal having the resonance frequency f2 is included, the second input parallel coupling strip line 114 is coupled to another first parallel line L1 of the line resonator 105, and the microwaves are transferred to the upper-stage resonator 103. Thereafter, the second signal is resonated and filtered in the upper-stage resonator 103 and the lower-stage resonator 104 in the same manner as in the first embodiment. Thereafter, the second output parallel coupling strip line 116 is coupled to another second parallel line L1 of the line resonator 106. Therefore, the second signal is output to the second output terminal 60.

Accordingly, because the input and output parallel coupling strip lines 113 to 116 are utilized to input and output the first and second signals, input and output elements of the strip-line filter 111 can be downsized and simplified, in addition to effects obtained in the fourth embodiment.

An inventive idea in the fifth embodiment is shown as compared with the strip-line filter 101. However, strip-line filters shown in FIGS. 16 to 19 are also applicable.

In the first to fifth embodiments, each of the strip-line filters is formed of two-stage filters. However, the number of stages in the strip-line filter is not limited to two stages. That is, a multi-stage type strip-line filter can be useful.

Next, a sixth embodiment is described with reference to FIGS. 20, 21.

Figure 20:
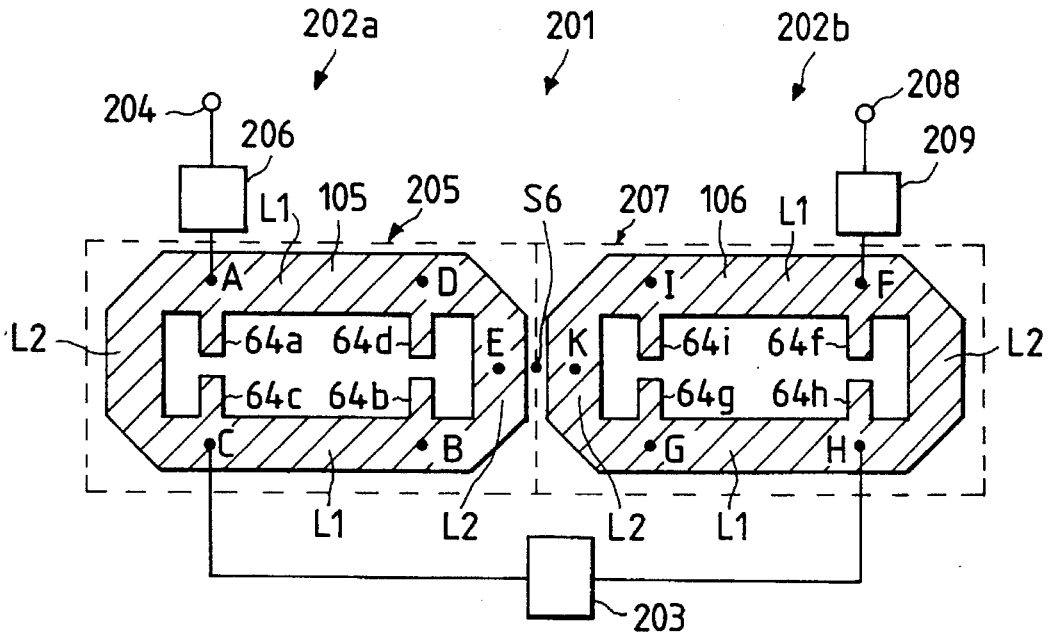
FIG. 20 is a plan view of a strip-line filter according to a sixth embodiment of the present invention.
Figure 21:
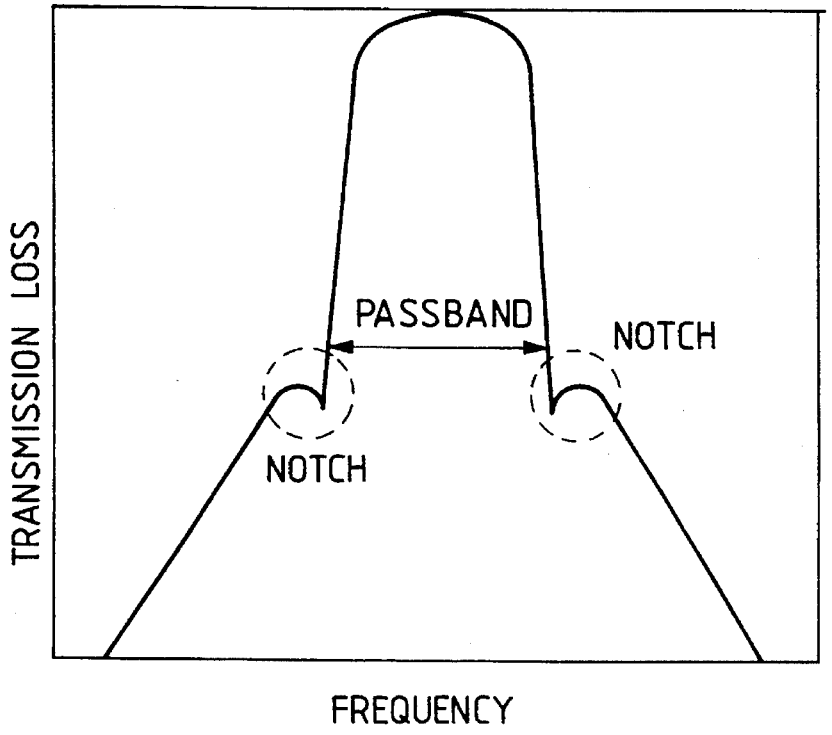
FIG. 21 shows frequency characteristics of a microwave output from the strip-line filter shown in FIG. 20.

FIG. 20 is a plan view of a strip-line filter according to a sixth embodiment of the present invention, and FIG. 21 shows frequency characteristics of a microwave output from the strip-line filter shown in FIG. 20.

As shown in FIG. 20, a strip-line filter 201 comprises an upper-stage filter 202*a*, a lower-stage filter 202*b* coupled to the upper-stage filter 202*a* through the parallel coupling space S6 in electromagnetic coupling, and an inter-stage coupling circuit 203 connecting a coupling point H of the lower-stage filter 202*b* to a coupling point C of the upper-stage filter 202*a*. The upper-stage filter 202*a* comprises an input terminal 204 excited by microwaves, an upper-stage resonator 205 for selectively resonating a propagating signal included in the microwaves, an input coupling circuit 206 for coupling the input terminal 204 to a coupling point A of the resonator 205. The lower-stage filter 202*b* comprises a lower-stage resonator 207 for selectively resonating the propagating signal, an output terminal 208 for outputting the propagating signal, and an output coupling circuit 209 for coupling the output terminal 208 to a coupling point F of the resonator 207. The shape of the upper-stage resonator 205 is the same as that of the lower-stage resonator 207.

The upper-stage resonator 205 comprises the one-wavelength rectangular-shaped strip line resonator 105 and the four open-end transmission lines 64*a* to 64*d* connected to coupling points A to D of the resonator 105. The coupling points A,C,B and D are placed at the first parallel lines L1 of the line resonator 105 and are spaced 90 degrees in the electric length in that order. The lower-stage resonator 207 comprises the one-wavelength rectangular-shaped strip line resonator 106 and the four open-end transmission lines 64*f* to 64*i* connected to coupling points F to I of the resonator 106. The coupling points I,G,H and F are placed at the first parallel lines L1 of the line resonator 106 and are spaced 90 degrees in electric length in that order. A midpoint E placed in the middle of the parallel coupling line L2 of the line resonator 105 is defined, and a midpoint K placed in the middle of the parallel coupling line L2 of the line resonator 106 is defined. An electric length between the coupling point D and the midpoint E, an electric length between the coupling point B and the midpoint E, an electric length between the coupling point I and the midpoint K and an electric length between the coupling point G and the midpoint K are the same value.

In the above configuration, when the input terminal 204 is excited by microwaves having various frequencies in which a propagating signal having a resonance frequency f1 (corresponding to a resonance wavelength $\lambda_1$) is included, the input terminal 204 is coupled to a first parallel line L1 of the line resonator 105, and the microwaves are transferred to the upper-stage resonator 205. Thereafter, the propagating signal is selectively resonated in the upper-stage resonator 205 at the resonance frequency f1 according to a first resonance mode. The resonance frequency f1 selectively resonated is determined by a characteristic impedance of the line resonator 105 and electromagnetic characteristics of the open-end transmission lines 64*a* and 64*b*. In this case, a half-wavelength $\lambda_1/2$ corresponding to the resonance frequency f1 is longer than a line length between the coupling points A and B because of the electromagnetic characteristics of the first open-end transmission lines 64*a* and 64*b*. Thereafter, electric voltages at the coupling points A and B reach a maximum value, and electric currents at the coupling points C and D reach a maximum value. That is, electric voltages at the coupling points C and D are zero.

Thereafter, the propagating signal resonated is transferred to the lower-stage resonator 207 through the parallel coupling space S6 because the upper-stage filter 202*a* is coupled to the lower-stage filter 202*b*, and the propagating signal is selectively resonated in the resonator 207 at the resonance frequency f1 according to the first resonance mode. Electric voltages at the coupling points H and I reach a maximum value, and electric currents at the coupling points F and G reach a maximum value. That is, electric voltages at the coupling points F and G are zero. In this case, because the coupling point D placed in the middle of the coupling points A and B is outside the parallel coupling line L2 of the line resonator 105 and because the coupling point G placed in the middle of the coupling points H and I is outside the parallel coupling line L2 of the line resonator 106, as shown in FIG. 21, a pair of notches occur in the neighborhood of a passband of the microwaves.

Thereafter, the propagating signal resonated in the resonator 207 is transferred from the coupling point H to the coupling point C through the inter-stage coupling circuit 203 because the electric voltage of the coupling point H is maximized. Thereafter, the propagating signal is selectively resonated in the upper-stage resonator 205 at the resonance frequency f1 according to a second resonance mode orthogonal to the first resonance mode. The resonance frequency f1 selectively resonated is determined by the characteristic impedance of the line resonator 105 and electromagnetics characteristics of the open-end transmission lines 64*c* and 64*d*. Electric voltages at the coupling points C and D reach a maximum value, and electric voltages at the coupling points A and B are zero. Thereafter, the propagating signal resonated is again transferred to the lower-stage resonator 207 through the parallel coupling space S6, and the propagating signal is selectively resonated in the resonator 207 at the resonance frequency f1 according to the second resonance mode. Electric voltages at the coupling points F and G reach a maximum value, and electric voltages at the coupling points H and I are zero. In this case, because the coupling point B placed in the middle of the coupling points C and D is outside the parallel coupling line L2 of the line resonator 105 and because the coupling point I placed in the middle of the coupling points F and G is outside the parallel coupling line L2 of the line resonator 106, as shown in FIG. 21, the notches occurring in the neighborhood of the passband of the microwaves are deepened. Thereafter, the propagating signal is output to the output terminal 208 through the output coupling circuit 209 because the electric voltage at the coupling point F is maximized.

Accordingly, because a pair of notches surrounding the passband of microwaves occur and is deepened in the strip-line filter 201, a filter having excellent attenuation characteristics can be manufactured even though the number of stages in the filter is low.

Also, because the half-wavelength $\lambda_1/2$ corresponding to the resonance frequency f1 is longer than a line length between the coupling points A and B, the resonance frequency f1 can be lower than an original resonance frequency f0 corresponding to a wavelength $\lambda_o$ of which a half value $\lambda_o/2$ is equal to the line length between the coupling points A and B (that is, the line length between the coupling points C and D). In other words, sizes of the line resonators 105, 106 can be smaller than that of a resonator in which any open-end transmission lines do not provided, so that the strip-line filter 201 can be manufactured in a small size.

Also, because electric lengths of the parallel coupling lines L2 of the resonators 105, 106 are respectively less than 90 degrees, the first-stage filter 202*a* can be arranged closely to the second-stage filter 202*b*, and unnecessary couplings and area occupied by the strip-line filter 201 can be reduced.

Also, the resonance frequency f1 can be arbitrarily set by setting the open-end transmission lines to a prescribed line length.

Also, the resonance frequency f1 can be accurately adjusted by trimming or overlaying end portions of the open-end transmission lines.

Also, because all of the open-end transmission lines are formed of strip lines and because the coupling circuits 203, 206 and 209 can be respectively formed of a pair of parallel coupling strip-lines, the strip-line filter 201 can be manufactured in a plane shape.

Next, a first modification of the sixth embodiment is described with reference to FIG. 22.

Figure 22:
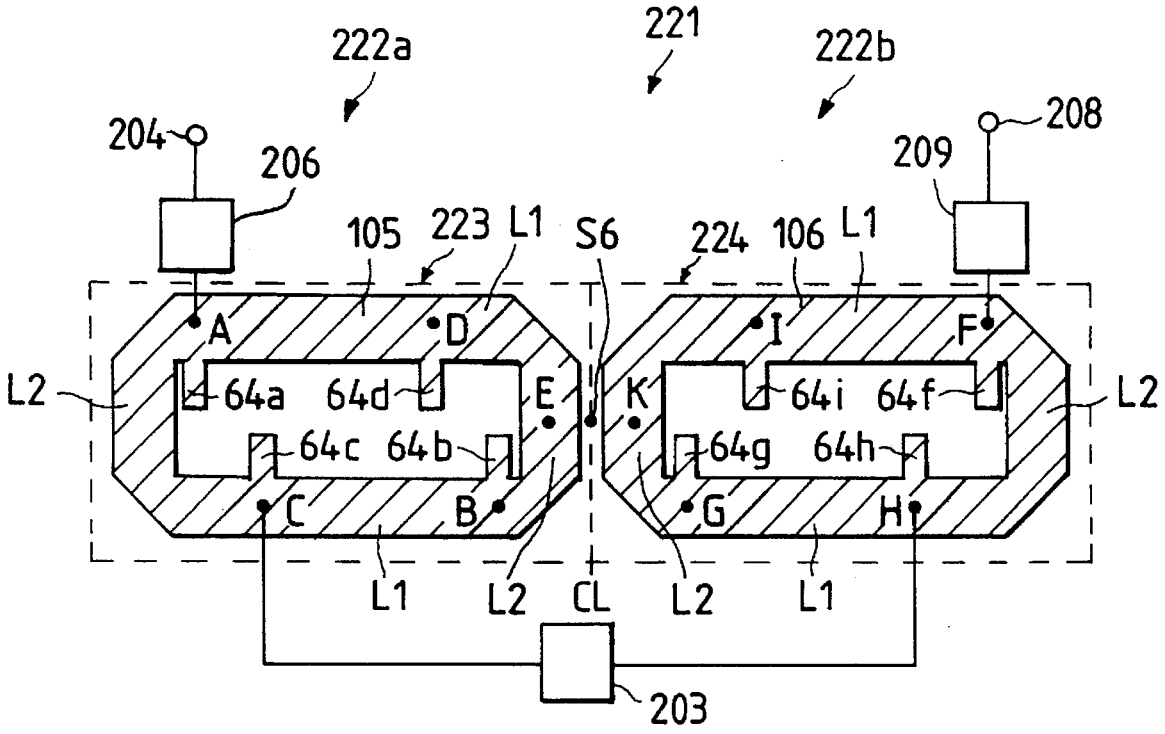
FIG. 22 is a plan view of a strip-line filter according to a first modification of the sixth embodiment.

FIG. 22 is a plan view of a strip-line filter according to a first modification of the sixth embodiment.

As shown in FIG. 22, a strip-line filter 221 comprises an upper-stage filter 222*a*, a lower-stage filter 222*b* coupled to the upper-stage filter 222*a* through the parallel coupling space S6 in electromagnetic coupling, and the inter-stage coupling circuit 203 connecting a coupling point H of the lower-stage filter 222*b* to a coupling point C of the upper-stage filter 222*a*. The upper-stage filter 222*a* comprises the input terminal 204, an upper-stage resonator 223 for selectively resonating a propagating signal included in the microwaves, the input coupling circuit 206 for coupling the input terminal 204 to a coupling point A of the resonator 223. The lower-stage filter 222*b* comprises a lower-stage resonator 224 for selectively resonating the propagating signal, the output terminal 208, and the output coupling circuit 209 for coupling the output terminal 208 to a coupling point F of the resonator 224.

The upper-stage resonator 223 comprises the one-wavelength rectangular-shaped strip line resonator 105 and the four open-end transmission lines 64*a* to 64*d* connected to the coupling points A to D of the line resonator 105. The coupling points A,C,B and D are spaced 90 degrees in the electric length in that order, the coupling points A and D are placed at a first parallel lines L1 of the line resonator 105, and the coupling points B and C are placed at another first parallel lines L1 of the line resonator 105. A midpoint E placed in the middle of the parallel coupling line L2 of the line resonator 105 is defined, and a first electric length between the coupling point D and the midpoint E is longer than a second electric length between the coupling point B and the midpoint E.

The lower-stage resonator 224 comprises the one-wavelength rectangular-shaped strip line resonator 106 and the the four open-end transmission lines 64*f* to 64*i* connected to the coupling points F to I of the line resonator 106. The coupling points I,G,H and F are spaced 90 degrees in the electric length in that order, the coupling points I and F are placed at a first parallel lines L1 of the line resonator 106, and the coupling points G and H are placed at another first parallel lines L1 of the line resonator 106. A midpoint K of the parallel coupling line L2 of the line resonator 106 is defined, and the first electric length between the coupling point I and the midpoint K is longer than the second electric length between the coupling point G and the midpoint K. The parallel coupling line L2 of the line resonator 105 closely faces the parallel coupling line L2 of the line resonator 106 through the parallel coupling space S6 to arrange the open-end transmission lines 64*a* to 64*d* of the line resonator 105 symmetrically to the open-end transmission lines 64*f* to 64*i* of the line resonator 106 with respect to an central line CL of the strip-line filter 221.

In the above configuration, a propagating signal is resonated and filtered in the strip-line filter 221 in the same manner as in the strip-line filter 201. In this case, the depth of the notches surrounding the passband of the microwave varies by changing a difference between the first electric length and the second electric length. Also, even though an electric length of the parallel coupling lines L2 and a gap width between the upper-stage filter 222*a* and the lower-stage filter 222*b* are fixed, a coupling strength between the upper-stage filter 222*a* and the lower-stage filter 222*b* varies by changing a difference between the first electric length and the second electric length.

Accordingly, the depth of the notches can be adjusted by adjusting a difference between the first electric length and the second electric length.

Also, a coupling strength between the upper-stage filter 222*a* and the lower-stage filter 222*b* can be adjusted without changing an electric length of the parallel coupling lines L2 or a gap width between the upper-stage filter 222*a* and the lower-stage filter 222*b*. Therefore, the strip-line filter 221 can be maintained in a small size.

Next, a second modification of the sixth embodiment is described with reference to FIG. 23.

Figure 23:
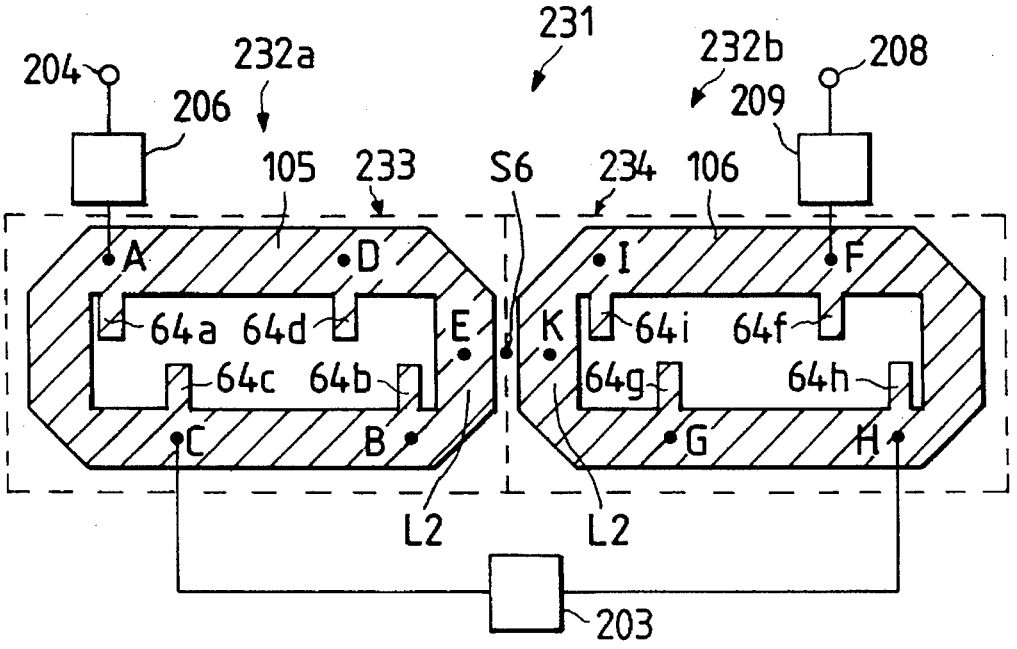
FIG. 23 is a plan view of a strip-line filter according to a second modification of the sixth embodiment.

FIG. 23 is a plan view of a strip-line filter according to a second modification of the sixth embodiment.

As shown in FIG. 23, a strip-line filter 231 comprises an upper-stage filter 232*a*, a lower-stage filter 232*b* coupled to the upper-stage filter 232*a* through the parallel coupling space S6 in electromagnetic coupling, and the inter-stage coupling circuit 203 connecting a coupling point H of the lower-stage filter 232*b* to a coupling point C of the upper-stage filter 232*a*. The upper-stage filter 232*a* comprises the input terminal 204, an upper-stage resonator 233 for selectively resonating a propagating signal included in the microwaves, the input coupling circuit 206 for coupling the input terminal 204 to a coupling point A of the resonator 233. The lower-stage filter 232*b* comprises a lower-stage resonator 234 for selectively resonating the propagating signal, the output terminal 208, and the output coupling circuit 209 for coupling the output terminal 208 to a coupling point F of the resonator 234.

The upper-stage resonator 233 comprises the one-wavelength rectangular-shaped strip line resonator 105 and the four open-end transmission lines 64*a* to 64*d* connected to the coupling points A to D of the line resonator 105. The coupling points A,C,B and D are spaced 90 degrees in the electric length in that order, the coupling points A and D are placed at a first parallel lines L1 of the line resonator 105, and the coupling points B and C are placed at another first parallel lines L1 of the line resonator 105. A midpoint E placed in the middle of the parallel coupling line L2 of the line resonator 105 is defined, and a first electric length between the coupling point D and the midpoint E is longer than a second electric length between the coupling point B and the midpoint E.

The lower-stage resonator 234 comprises the one-wavelength rectangular-shaped strip line resonator 106 and the the four open-end transmission lines 64*f* to 64*i* connected to the coupling points A to D of the line resonator 106. The coupling points I,G,H and F are spaced 90 degrees in the electric length in that order, the coupling points I and F are placed at a first parallel lines L1 of the line resonator 106, and the coupling points G and H are placed at another first parallel lines L1 of the line resonator 106. A midpoint K of the parallel coupling line L2 of the line resonator 106 is defined. A difference between the coupling point I and the midpoint K is set to the second electric length, and a difference between the coupling point G and the midpoint K is set to the first electric length. The parallel coupling line L2 of the line resonator 105 closely faces the parallel coupling line L2 of the line resonator 106 through the parallel coupling space S6 to arrange the open-end transmission lines 64*a* to 64*d* of the line resonator 105 symmetrically to the open-end transmission lines 64*f* to 64*i* of the line resonator 106 with respect to an central line CL of the strip-line filter 231.

In the above configuration, a propagating signal is resonated and filtered in the strip-line filter 231 in the same manner as in the strip-line filter 221.

Accordingly, the depth of the notches can be adjusted by adjusting a difference between the first electric length and the second electric length, in the same manner as in the strip-line filter 221.

Also, a coupling strength between the upper-stage filter 232*a* and the lower-stage filter 232*b* can be adjusted without changing an electric length of the parallel coupling lines L2 or a gap width between the upper-stage filter 232*a* and the lower-stage filter 232*b*, in the same manner as in the strip-line filter 221. Therefore, the strip-line filter 231 can be maintained in a small size.

Next, a third modification of the sixth embodiment is described with reference to FIG. 24.

Figure 24:
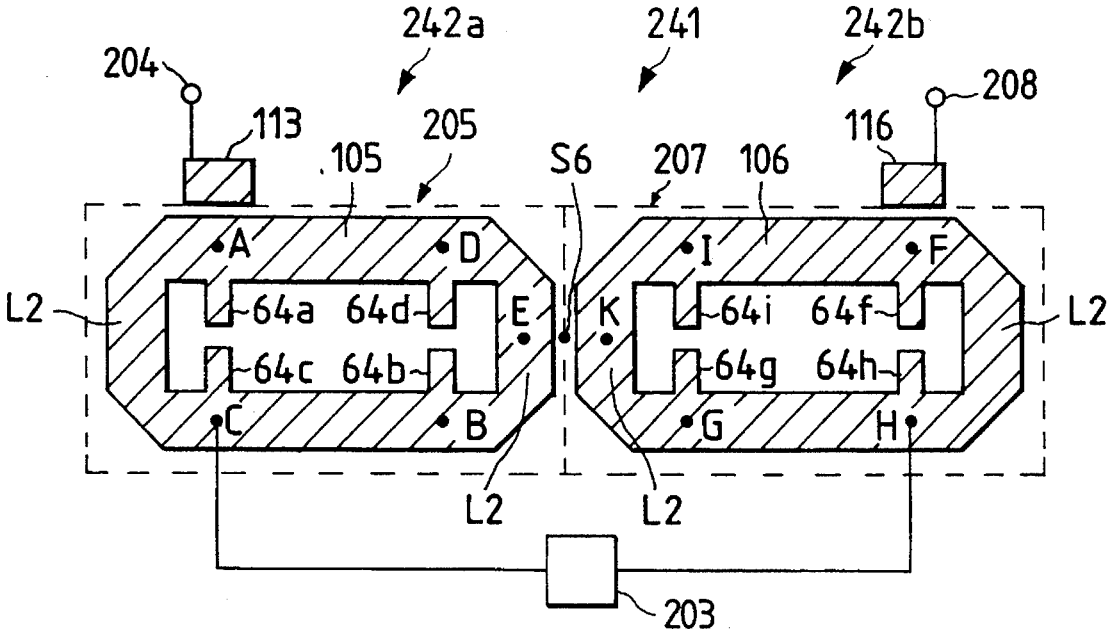
FIG. 24 is a plan view of a strip-line filter according to a third modification of the sixth embodiment.

FIG. 24 is a plan view of a strip-line filter according to a third modification of the sixth embodiment.

As shown in FIG. 24, a strip-line filter 241 comprises an upper-stage filter 242*a*, a lower-stage falter 242*b* coupled to the upper-stage filter 242*a* through the parallel coupling space S6 in electromagnetic coupling, and the inter-stage coupling circuit 203 connecting a coupling point H of the lower-stage filter 242*b* to a coupling point C of the upper-stage filter 242*a*. The upper-stage filter 242*a* comprises the input terminal 204, the upper-stage resonator 205, the input parallel coupling strip line 113. The lower-stage filter 242*b* comprises the lower-stage resonator 207, the output terminal 208, and the output parallel coupling strip line 116.

In the above configuration, a propagating signal is resonated and filtered in the strip-line filter 241 in the same manner as in the strip-line filter 201. Therefore, the same effects as in the strip-line filter 201 can be obtained.

Next, a fourth modification of the sixth embodiment is described with reference to FIG. 25.

Figure 25:
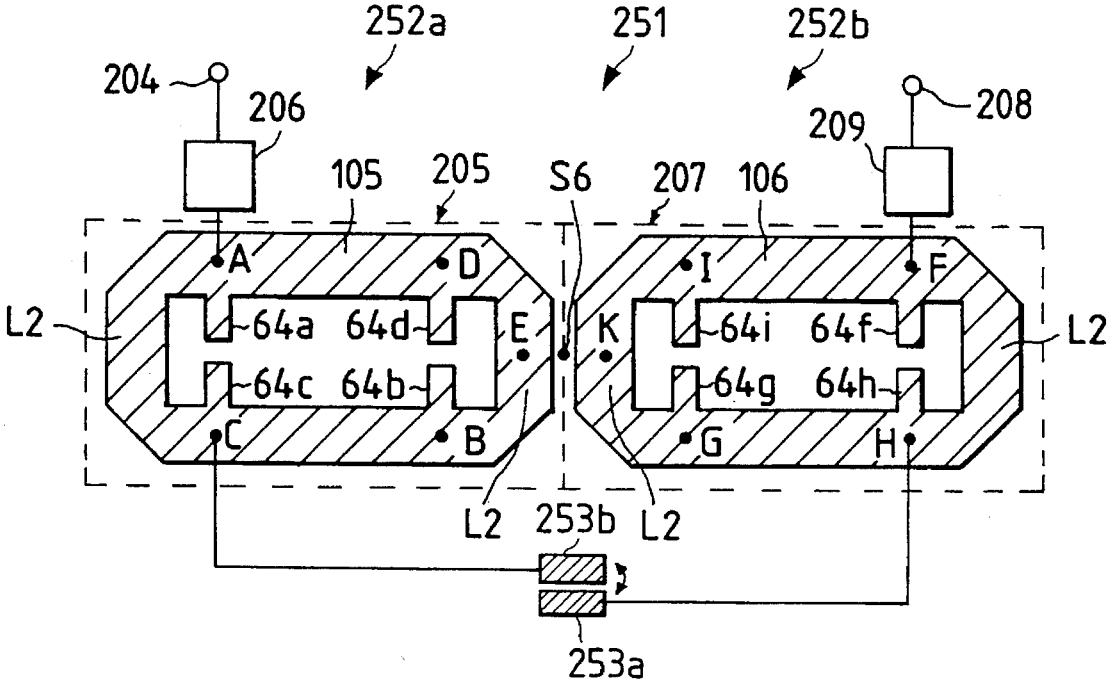
FIG. 25 is a plan view of a strip-line filter according to a fourth modification of the sixth embodiment.

FIG. 25 is a plan view of a strip-line filter according to a fourth modification of the sixth embodiment.

As shown in FIG. 25, a strip-line filter 251 comprises an upper-stage filter 252*a*, a lower-stage filter 252*b* coupled to the upper-stage filter 252*a* through the parallel coupling space S6 in electromagnetic coupling, and a pair of inter-stage paralleled coupling strip lines 253*a*, 253*b* coupled to each other for transferring a propagating signal from a coupling point H of the lower-stage filter 252*b* to a coupling point C of the upper-stage filter 252*a*. The upper-stage filter 252*a* comprises the input terminal 204, the upper-stage resonator 205, the input coupling circuit 206. The lower-stage filter 252*b* comprises the lower-stage resonator 207, the output terminal 208, and the output coupling circuit 209.

In the above configuration, a propagating signal is resonated and filtered in the strip-line filter 251 through the inter-stage paralleled coupling strip lines 253*a*, 253*b* in the same manner as in the strip-line filter 201. Therefore, the same effects as in the strip-line filter 201 can be obtained.

Next, a seventh embodiment is described with reference to FIG. 26.

Figure 26:
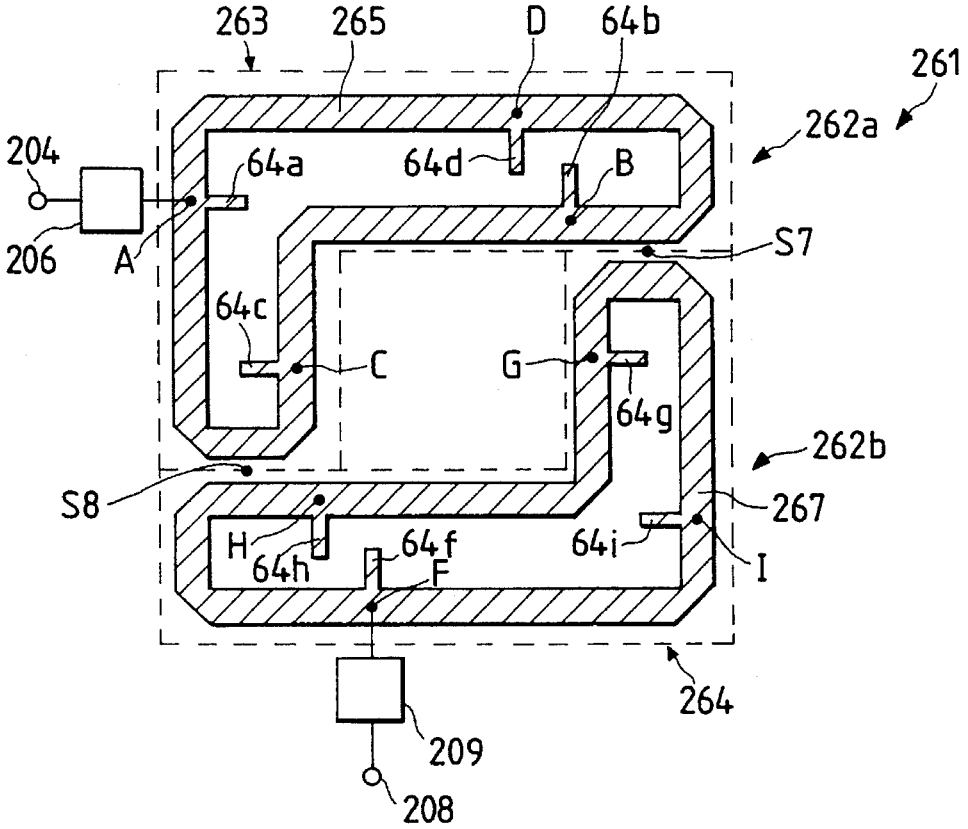
FIG. 26 is a plan view of a strip-line filter according to a seventh embodiment.

FIG. 26 is a plan view of a strip-line filter according to a seventh embodiment.

As shown in FIG. 26, a strip-line filter 261 comprises an upper-stage filter 262*a*, a lower-stage filter 262*b* coupled to the upper-stage filter 262*a* through a first parallel coupling space S7 and a second parallel coupling space S8 in electromagnetic coupling. The upper-stage filter 262*a* comprises the input terminal 204, an upper-stage resonator 263 for selectively resonating a propagating signal included in the microwaves, and the input coupling circuit 206 for coupling the input terminal 204 to the resonator 263. The lower-stage filter 262*b* comprises a lower-stage resonator 264 for selectively resonating the propagating signal, the output terminal 208 for outputting the propagating signal, and the output coupling circuit 209 for coupling the output terminal 208 to the resonator 264. The shape of the upper-stage resonator 263 is the same as that of the lower-stage resonator 264.

The upper-stage resonator 263 comprises an one-wavelength L-shaped strip line resonator 265 and the four open-end transmission lines 64*a* to 64*d* connected to coupling points A to D of the resonator 265. The one-wavelength L-shaped strip line resonator 265 represents a one-wavelength loop-shaped strip line resonator. The coupling points A,C,B and D are spaced 90 degrees in the electric length in that order, and the input terminal 204 is coupled to the coupling point A through the input coupling circuit 206. The lower-stage resonator 264 comprises an one-wavelength L-shaped strip line resonator 267 and four open-end transmission lines 64*f* to 64*i* connected to coupling points F to I of the resonator 267. The one-wavelength L-shaped strip line resonator 267 represents a one-wavelength loop-shaped strip line resonator. The coupling points F,G,H and I are spaced 90 degrees in the electric length in that order, and the output terminal 208 is coupled to the coupling point F through the output coupling circuit 209.

A portion of a strip line between the coupling points B and D closely faces a portion of a strip line between the coupling points G and I through the first parallel coupling space S7. The portion of the strip line between the coupling points B and D is called a first parallel coupling line, and the portion of the strip line between the coupling points G and I is called another first parallel coupling line. The coupling point B is nearer to the first parallel coupling line of the line resonator 265 than the coupling point D, and the coupling point G is nearer to the first parallel coupling line of the line resonator 267 than the coupling point I. A portion of a strip line between the coupling points A and C closely faces a portion of a strip line between the coupling points F and H through the second parallel coupling space S8. The portion of the strip line between the coupling points A and C is called a second parallel coupling line, and the portion of the strip line between the coupling points F and H is called another second parallel coupling line. The coupling point C is nearer to the second parallel coupling line of the line resonator 265 than the coupling point A, and the coupling point H is nearer to the second parallel coupling line of the line resonator 267 than the coupling point F.

In the above configuration, a propagating signal having a resonance frequency f1 transferred from the input terminal 204 is selectively resonated in the upper-stage resonator 263 at the resonance frequency f1 according to a first resonance mode. The resonance frequency f1 selectively resonated is determined by the electric length of the line resonator 265 and electromagnetic characteristics of the open-end transmission lines 64*a* and 64*b*. In this case, a half-wavelength $\lambda_1/2$ corresponding to the resonance frequency f1 is longer than a line length between the coupling points A and B because of the electromagnetic characteristics of the first open-end transmission lines 64*a* and 64*b*. Thereafter, electric voltages at the coupling points A and B reach a maximum value, and electric voltages at the coupling points C and D are zero. Thereafter, the propagating signal is transferred to the lower-stage resonator 264 through the first parallel coupling space S7 because the first parallel coupling lines are electromagnetically coupled.

Thereafter, the propagating signal is selectively resonated in the lower-stage resonator 264 at the resonance frequency f1 according to the first resonance mode. That is, electric voltages at the coupling points H and I reach a maximum value, and electric voltages at the coupling points F and G are zero. In this case, because the coupling point D placed in the middle of the coupling points A and B is outside the first parallel coupling line of the line resonator 265 and because the coupling point G placed in the middle of the coupling points H and I is outside the first parallel coupling line of the line resonator 267, a pair of notches occur in the neighborhood of a passband of microwaves including the propagating signal. Thereafter, the propagating signal is transferred to the upper-stage resonator 263 through the second coupling space S8 because the second parallel coupling lines are electromagnetically coupled.

Thereafter, the propagating signal is selectively resonated in the upper-stage resonator 263 at the resonance frequency f1 according to a second resonance mode orthogonal to the first resonance mode. That is, electric voltages at the coupling points C and D reach a maximum value, and electric voltages at the coupling points A and B are zero. In this case, because the coupling point A placed in the middle of the coupling points C and D is outside the first parallel coupling line of the line resonator 265 and because the coupling point F placed in the middle of the coupling points H and I is outside the first parallel coupling line of the line resonator 267, the notches occurring in the neighborhood of the passband are deepened. Thereafter, the propagating signal is transferred to the lower-stage resonator 264 through the first parallel coupling space S7 and is selectively resonated in the lower-stage resonator 264 at the resonance frequency f1 according to the second resonance mode. That is, electric voltages at the coupling points F and G reach a maximum value, and electric voltages at-the coupling points H and I are zero. Thereafter, the propagating signal is output to the output terminal 208.

The depth of the notches surrounding the passband varies by changing positions of the coupling points A to D and F to I. Also, even though electric lengths of the first and second parallel coupling lines and gap widths between the upper-stage filter 262*a* and the lower-stage filter 262*b* are fixed, a coupling strength between the upper-stage filter 262*a* and the lower-stage filter 262*b* varies by changing positions of the coupling points A to D and F to I.

Accordingly, because a pair of notches surrounding the passband of microwaves occur and is deepened in the strip-line filter 261, a filter having excellent attenuation characteristics can be manufactured even though the number of stages in the filter is low.

Also, the depth of the notches can be adjusted by adjusting positions of the coupling points A to D and F to I.

Also, because the half-wavelength $\lambda_1/2$ corresponding to the resonance frequency f1 is longer than a line length between the coupling points A and B, the resonance frequency f1 can be lower than an original resonance frequency f0 corresponding to a wavelength $\lambda_o$ of which a half value $\lambda_o/2$ is equal to the line length between the coupling points A and B (that is, the line length between the coupling points C and D). In other words, sizes of the line resonators 265, 267 can be smaller than that of a resonator in which any open-end transmission lines do not provided, so that the strip-line filter 261 can be manufactured in a small size.

Also, because electric lengths of the parallel coupling lines of the line resonators 265, 267 are respectively less than 90 degrees, the first-stage filter 202*a* can be arranged closely to the second-stage filter 202*b*, and unnecessary couplings and area occupied by the strip-line filter 261 can be reduced.

Also, the resonance frequency f1 can be arbitrarily set by setting the open-end transmission lines to a prescribed line length.

Also, the resonance frequency f1 can be accurately adjusted by trimming or overlaying open-end portions of the open-end transmission lines.

Also, because all of the open-end transmission lines are formed of strip lines, the strip-line filter 201 can be manufactured in a plane shape.

Also, a coupling strength between the upper-stage filter 222*a* and the lower-stage filter 222*b* can be adjusted without changing an electric length of the parallel coupling lines L2 or a gap width between the upper-stage filter 222*a* and the lower-stage filter 222*b*. Therefore, the strip-line filter 221 can be maintained in a small size.

Next, an eighth embodiment is described with reference to FIG. 27.

Figure 27:
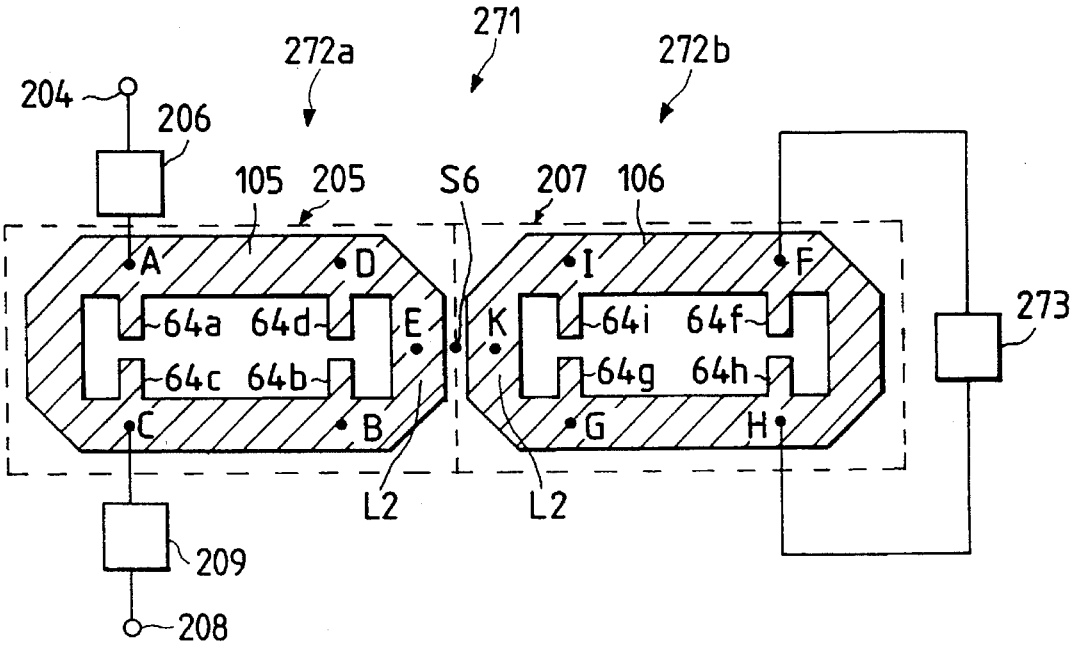
FIG. 27 is a plan view of a strip-line filter according to an eighth embodiment.
Figure 28:
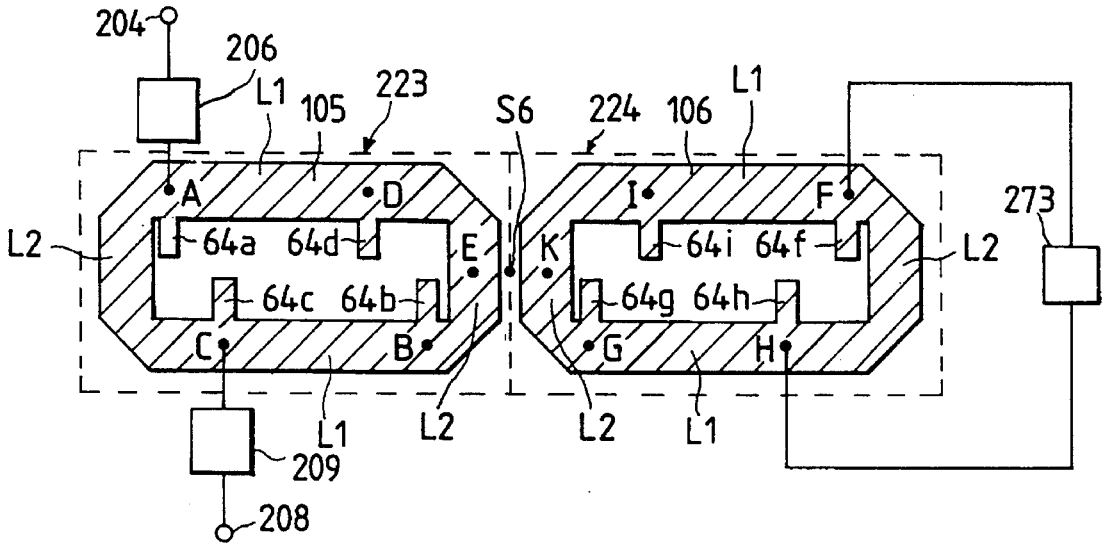
FIGS. 28 to 31 are respectively a plan view of a strip-line filter according to a modification of the eighth embodiment.
Figure 29:
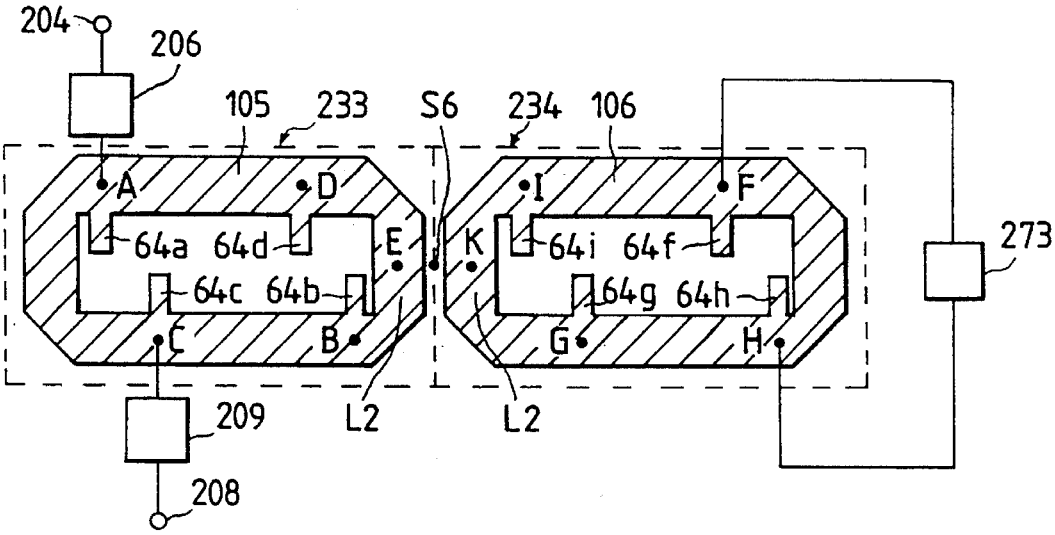
Figure 30:
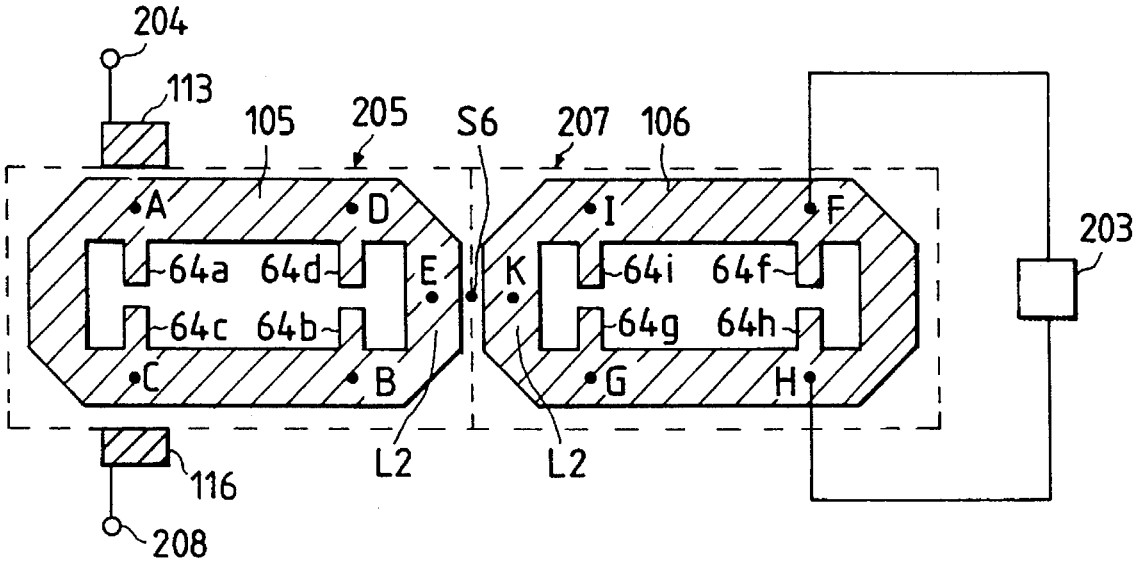
Figure 31:
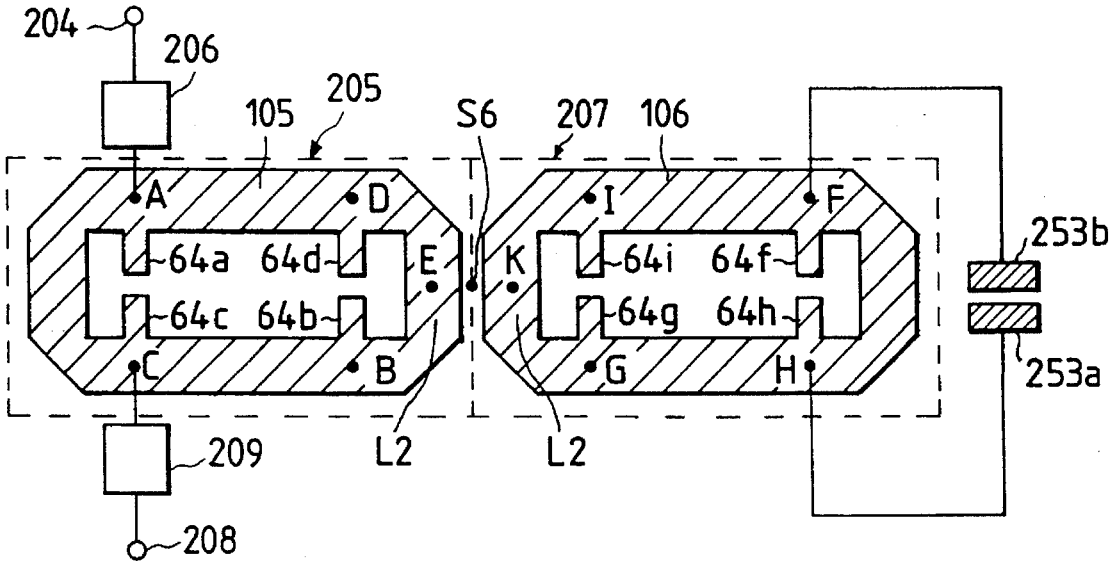

FIG. 27 is a plan view of a strip-line filter according to an eighth embodiment.

As shown in FIG. 27, a strip-line filter 271 comprises an upper-stage filter 272*a* and a lower-stage filter 272*b* coupled to the upper-stage filter 272*a* through the parallel coupling space S6 in electromagnetic coupling. The upper-stage filter 272*a* comprises the input terminal 204, the upper-stage resonator 205, the input coupling circuit 206 for coupling the input terminal 204 to the coupling point A of the resonator 205, the output terminal 208, and the output coupling circuit 209 for coupling the output terminal 208 to the coupling point C of the resonator 205. The lower-stage filter 272*b* comprises the lower-stage resonator 207 and an internal coupling circuit 273 for transferring a propagating signal from the coupling point H to the coupling point F of the resonator 207 to change a phase of the propagating signal.

In the above configuration, a propagating signal having a resonance frequency f1 is selectively resonated in the upper-stage resonator 205 and the lower-stage resonator 207 at the resonance frequency f1 according to the first resonance mode. In this case, because the coupling point D placed in the middle of the coupling points A and B is outside the parallel coupling line L2 of the line resonator 105 and because the coupling point G placed in the middle of the coupling points H and I is outside the parallel coupling line L2 of the line resonator 106, as shown in FIG. 21, a pair of notches occur in the neighborhood of a passband of microwaves including the propagating signal.

Thereafter, the propagating signal is transferred. From the coupling point H to the coupling point F through the internal coupling circuit 273 because the electric voltage of the coupling point H is maximized. Thereafter, the propagating signal is selectively resonated in the lower-stage resonator 207 at the resonance frequency f1 according to the second resonance mode. That is, electric voltages at the coupling points F and G reach a maximum value, and electric voltages at the coupling points H and I are zero. Thereafter, the propagating signal is transferred to the upper-stage resonator 205 through the parallel coupling space S6 and is selectively resonated at the resonance frequency f1 according to the second resonance mode. That is, electric voltages at the coupling points D and C reach a maximum value, and electric voltages at the coupling points A and B are zero. In this case, because the coupling point I placed in the middle of the coupling points F and G is outside the parallel coupling line L2 of the line resonator 106 and because the coupling point B placed in the middle of the coupling points C and D is outside the parallel coupling line L2 of the line resonator 105, the notches occurring in the neighborhood of the passband of the microwaves are deepened. Thereafter, the propagating signal is output to the output terminal 208 through the output coupling circuit 209 because the electric voltage at the coupling point C is maximized.

Accordingly, the same effects as those obtained in the strip-line filter 201 can be obtained in the strip-line filter 271.

An inventive idea in the ninth embodiment includes another inventive idea shown in the strip-line filter 201. However, as shown in FIGS. 28 to 31, strip-line filters including inventive ideas shown in the strip-line filters 221, 231, 241 and 251 are also applicable.

In the sixth to eighth embodiments, each of the strip-line filters is formed of two-stage filters. However, the number of stages in the strip-line filter is not limited to two stages. That is, a multi-stage type strip-line filter can be useful.

Next, a ninth embodiment is described with reference to FIG. 32.

Figure 32:
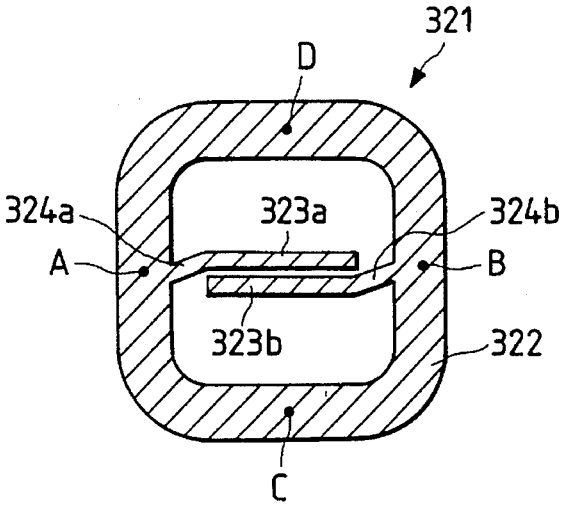
FIG. 32 is a plan view of a dual mode resonator according to a ninth embodiment.

FIG. 32 is a plan view of a dual mode resonator according to a ninth embodiment.

As shown in FIG. 32, a dual mode resonator 321 comprises a one-wavelength ring-shaped strip line 322 for resonating first and second microwaves having first and second wavelengths $\lambda_1$ and $\lambda_2$, a pair of open-end coupling lines 323*a*, 323*b* having the same shape for functioning as a capacitor having a distributed capacity to electromagnetically influence the first microwave, and a pair of lead-in lines 324*a*, 324*b* having the same shape for connecting the open-end coupling lines 323*a*, 323*b* to coupling points A and B of the ring-shaped strip line 322. The one-wavelength ring-shaped strip line resonator 322 represents a one-wavelength loop-shaped strip line resonator. A first input element for inputting the first microwave to the coupling point A of the strip line 322, a first output element for outputting the first microwave from the coupling point B of the strip line 322, a second input element for inputting the second microwave to a coupling point C of the strip line 322, and a second output element for outputting the second microwave from a coupling point D of the strip line 322 are not shown.

The ring-shaped strip line 322 has a uniform characteristic line impedance. Also, the ring-shaped strip line 322 has a first electric length equivalent to the resonance wavelength $\lambda_1$ for the first microwave and has a second electric length equivalent to the resonance wavelength $\lambda_2$ for the second microwave. A line length of the ring-shaped strip line 322 is equal to the resonance wavelength $\lambda_2$ which is lower than the resonance wavelength $\lambda_1$. The coupling point B is spaced 180 degrees in electric length apart from the coupling point A, the coupling point C is spaced 90 degrees in electric length apart from the coupling point A, and the coupling point D is spaced 180 degrees in electric length apart from the coupling point C. The open-end coupling lines 323*a*, 323*b* and the lead-in lines 324*a*, 824*b* are respectively formed of a straight strip line and are placed at an inside open space surrounded by the ring-shaped strip line 322. The open-end coupling lines 323*a*, 323*b* are arranged closely to each other to couple to each other.

In the above configuration, a first microwave having a wavelength $\lambda_1$ input to the coupling point A is circulated in the ring-shaped strip line 322 while the first microwave is electromagnetically influenced by the open-end coupling lines 323*a*, 323*b* because electric voltages of the first microwave at the coupling points A and B are maximized. Therefore, even though the wavelength $\lambda_1$ is longer than a line length of the ring-shaped strip line 322, the first microwave is resonated in the ring-shaped strip line 322 according to a first resonance mode and is output from the coupling point B. In contrast, a second microwave having a wavelength $\lambda_2$ input to the coupling point C is circulated in the ring-shaped strip line 322 without electromagnetically influencing the second microwave with the open-end coupling lines 323*a*, 323*b* because electric voltages of the first microwave at the coupling points A and B are zero. Therefore, the second microwave is resonated in the ring-shaped strip line 322 according to a second resonance mode orthogonal to the first resonance mode and is output from the coupling point D.

Accordingly, because the open-end coupling lines 323*a*, 323*b* and the lead-in lines 324*a*, 324*b* are arranged at an inside open space surrounded by the ring-shaped strip line 322, the dual mode resonator 321 can be manufactured at a low cost and in a small size.

Also, in cases where an electric capacity required to the open-end coupling lines 323*a*, 323*b* is low, a coupling distance between the open-end coupling lines 323*a*, 323*b* is widened. Therefore, the reproductivity of the dual mode resonator 321 can be enhanced. In other words, the resonance frequency $\lambda_1$ of the first microwave can be accurately reproduced.

Also, because the open-end coupling lines 323*a*, 323*b* are utilized as a capacitor having a distributed capacity, electric field induced by the open-end coupling lines 323*a*, 323*b* can be dispersed as compared that electric field induced by a lumped constant capacitor is concentrated. Therefore, loss of the electric field occurring in the open-end coupling lines 323*a*, 323*b* can be remarkably reduced, so that a no-loaded Q factor ($Q=\omega_o/2\Delta\omega$, $\omega_o$ denotes a resonance angular frequency and $\Delta\omega$ denotes a full width at half maximum) can be increased.

Also, even though the resonance frequency $\lambda_1$ of the first microwave obtained in the dual mode resonator 321 differs from a desired resonance frequency, the resonance frequency $\lambda_1$ can agree with the desired resonance frequency by trimming open-end portions of the open-end coupling lines 323*a*, 323*b*. Therefore, the resonance frequency $\lambda_1$ of the first microwave can be easily adjusted.

Also, because the open-end coupling lines 323*a*, 323*b* are formed of strip lines, the strip-line filter 321 can be manufactured in a plane shape.

Next, a tenth embodiment is described with reference to FIG. 33.

Figure 33:
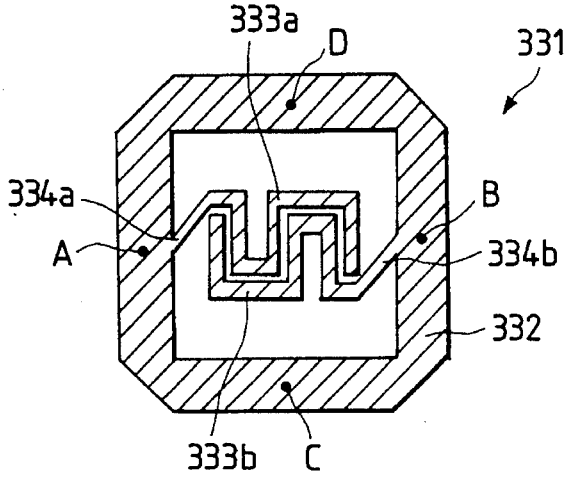
FIG. 33 is a plan view of a dual mode resonator according to a tenth embodiment.

FIG. 33 is a plan view of a dual mode resonator according to a tenth embodiment.

As shown in FIG. 33, a dual mode resonator 331 comprises a one-wavelength rectangular-shaped strip line 332 having a uniform characteristic line impedance for resonating first and second microwaves having first and second wavelengths $\lambda_1$ and $\lambda_2$, a pair of open-end coupling lines 333*a*, 333*b* for functioning as a capacitor having a distributed capacity to electromagnetically influence the first microwave, and a pair of lead-in lines 334*a*, 334*b* for connecting the open-end coupling lines 333*a*, 333*b* to coupling points A and B of the rectangular-shaped strip line 332. The one-wavelength ring-shaped strip line resonator 332 represents a one-wavelength loop-shaped strip line resonator. A first input element for inputting the first microwave to the coupling point A of the strip line 332, a first output element for outputting the first microwave from the coupling point B of the strip line 332, a second input element for inputting the second microwave to a coupling point C of the strip line 332, and a second output element for outputting the second microwave from a coupling point D of the strip line 332 are not shown.

Four corners of the rectangular-shaped strip line 332 are cut off so that the strip line 332 has a uniform characteristic line impedance. Also, the rectangular-shaped strip line 332 has the same electric characteristics as those of the strip line 322. The coupling points A,C,B and D of the strip line 332 are spaced 90 degrees in electric length apart in that order. The open-end coupling lines 333*a*, 333*b* and the lead-in lines 334*a*, 334*b* are respectively formed of a strip line and are placed at an inside open space surrounded by the rectangular-shaped strip line 332. The open-end coupling lines 333*a*, 333*b* are respectively formed in a comb-teeth shape and are arranged closely to each other to couple to each other.

In the above configuration, first and second microwaves having first and second wavelengths are resonated in the dual mode resonator 331 in the same manner as in the dual mode resonator 321.

Accordingly, because the strip line 332 is in a rectangular shape, a large number of dual mode resonators 331 can be orderly arranged without any useless space as compared with the arrangement of a plurality of dual mode resonators 321 having the ring-shaped strip lines 322.

Also, because the open-end coupling lines 333*a*, 333*b* are respectively formed in a comb-teeth shape, the open-end coupling lines 333*a*, 333*b* can be lengthened. Therefore, electric capacity of the open-end coupling lines 333*a*, 333*b* can be increased Without shortening a coupling distance between the open-end coupling lines 333*a*, 333*b*. Also, to obtain a desired electric capacity, a coupling distance between the open-end coupling lines 333*a*, 333*b* can be widened more than that between the open-end coupling lines 323*a*, 323*b*. Therefore, the reproductivity of the dual mode resonator 331 can be enhanced. In other words, the resonance frequency $\lambda_1$ of the first microwave can be accurately reproduced.

Figure 34:
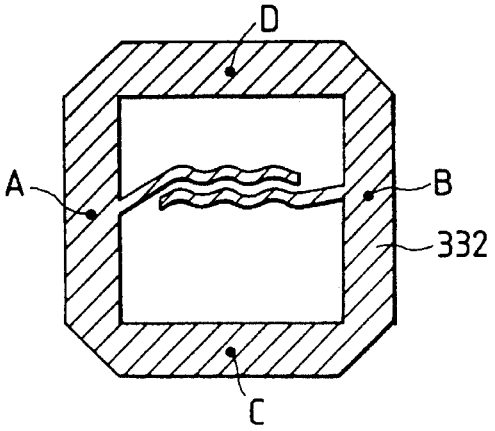
FIG. 34 is a plan view of a dual mode resonator according to a modification of the tenth embodiment.

In the tenth embodiment, the open-end coupling lines 33*a*, 333*b* are respectively formed in a comb-teeth shape. However, it is applicable that the open-end coupling lines 333*a*, 333*b* be formed in a curved shape. For example, as shown in FIG. 34, a dual mode resonator having wave-shaped open-end coupling lines can be useful.

Next, an eleventh embodiment is described with reference to FIG. 35.

Figure 35:
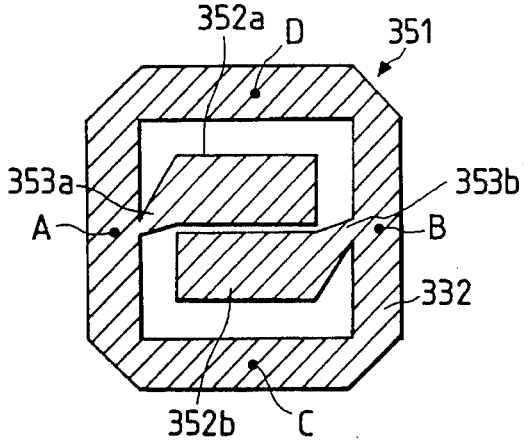
FIG. 35 is a plan view of a dual mode resonator according to an eleventh embodiment.

FIG. 35 is a plan view of a dual mode resonator according to an eleventh embodiment.

As shown in FIG. 35, a dual mode resonator 351 comprises the rectangular-shaped strip line 332, a pair of open-end coupling lines 352*a*, 352*b* for functioning as a capacitor having a distributed capacity to electromagnetically influence the first microwave, and a pair of lead-in lines 353*a*, 353*b* for connecting the open-end coupling lines 352*a*, 352*b* to coupling points A and B of the rectangular-shaped strip line 332. A width of each of the open-end coupling lines 352*a*, 352*b* is widened to form the open-end coupling lines 352*a*, 352*b* in a plate shape, so that a characteristic impedance of the open-end coupling lines 352*a*, 352*b* determined by a square root of a product obtained by multiplying an odd mode impedance $Z_o$o and an even mode impedance $Z_o$e together is decreased. The open-end coupling lines 352*a*, 352*b* are arranged closely to each other to couple to each other.

Accordingly, because the characteristic impedance of the open-end coupling lines 352*a*, 352*b* is decreased, a grounding capacity between the open-end coupling lines 352*a*, 352*b* and the ground can be increased. Therefore, an electric capacity of the open-end coupling lines 352*a*, 352*b* is determined as a summed value of the distributed capacity and the grounding capacity, so that the electromagnetic characteristics of the open-end coupling lines 352*a*, 352*b* influencing on the first signal can be considerably increased. As a result, a line length of the rectangular-shaped strip line 332 can be considerably shortened, and the dual mode resonator 351 can be remarkably downsized.

Next, a twelfth embodiment is described with reference to FIG. 36.

Figure 36:
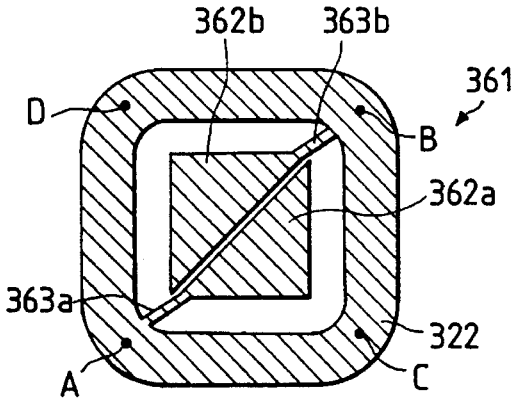
FIG. 36 is a plan view of a dual mode resonator according to a twelfth embodiment.

FIG. 36 is a plan view of a dual mode resonator according to a twelfth embodiment.

As shown in FIG. 36, a dual mode resonator 361 comprises the ring-shaped strip line 322, a pair of open-end coupling lines 362*a*, 362*b* for functioning as a capacitor having a distributed capacity to electromagnetically influence the first microwave, and a pair of lead-in lines 363*a*, 363*b* for connecting the open-end coupling lines 323*a*, 323*b* to coupling points A and B of the ring-shaped strip line 322. The coupling points A,C,B and D are placed at four corners of the ring-shaped strip line 322 in that order. Each of the open-end coupling lines 362*a*, 362*b* is formed in a triangular shape, and the width of each of the open-end coupling lines 362*a*, 362*b* gradually vary. The open-end coupling lines 362*a*, 362*b* are arranged closely to each other to couple to each other.

Accordingly, because the open-end coupling lines 362*a*, 362*b* are coupled to the corners of the ring-shaped strip line 322, the open-end coupling lines 362*a*, 362*b* can be lengthened, so that the distributed capacity of the open-end coupling lines 362*a*, 362*b* can be increased.

Also, because the width of each of the open-end coupling lines 362*a*, 362*b* is not uniform, a grounding capacity between the open-end coupling lines 362*a*, 362*b* and the ground can be increased, so that the dual mode resonator 361 can be remarkably downsized.

Next, an thirteenth embodiment is described with reference to FIG. 37A.

Figure 37A:
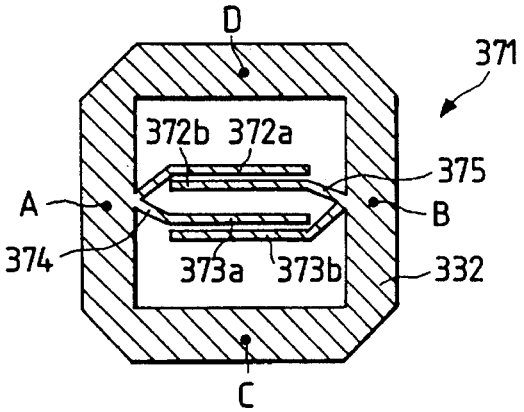
FIG. 37A is a plan view of a dual mode resonator according to a thirteenth embodiment.

FIG. 37A is a plan view of a dual mode resonator according to a thirteenth embodiment.

As shown in FIG. 37A, a dual mode resonator 371 comprises the rectangular-shaped strip line 332, a pair of first open-end coupling lines 372*a*, 372*b* having the same shape for functioning as a first capacitor having a distributed capacity to electromagnetically influence the first microwave, a pair of second open-end coupling lines 373*a*, 373*b* having the same shape for functioning as a second capacitor having the distributed capacity to electromagnetically influence the first microwave, a lead-in line 374 for connecting the open-end coupling lines 372*a*, 373*a* to the coupling point A of the rectangular-shaped strip line 332, and a lead-in line 375 having the same shape as that of the lead-in line 374 for connecting the open-end coupling lines 372*b*, 373*b* to the coupling point B of the rectangular-shaped strip line 332.

The open-end coupling lines 372*a*, 372*b*, 373*a* and 373*b* are respectively formed of a straight strip line and are placed at an inside open space surrounded by the ring-shaped strip line 332. The first open-end coupling lines 372*a*, 372*b* are arranged closely to each other to couple to each other, and the second open-end coupling lines 373*a*, 373*b* are arranged closely to each other to couple to each other. The lead-in lines 374, 375 are formed of strip lines.

Accordingly, because a first capacity composed of the first open-end coupling lines 372*a*, 372*b* and a second capacity composed of the second open-end coupling lines 373*a*, 373*b* are provided for the dual mode resonator 371, the electromagnetic characteristics of the open-end coupling lines 372*a*, 372*b*, 373*a* and 373*b* are two times as large as those of the open-end coupling lines 323*a*, 323*b* shown in FIG. 32. Therefore, a line length of the rectangular-shaped strip line 332 can be considerably shortened, and the dual mode resonator 371 can be remarkably downsized.

Also, to obtain a desired electric capacity, a coupling distance between the open-end coupling lines 372*a* and 372*b* (or 373*a* and 373*b*) can be widened more than that between the open-end coupling lines 323*a*, 323*b*. Therefore, the reproductivity of the dual mode resonator 331 can be enhanced. In other words, the resonance frequency $\lambda_1$ of the first microwave can be accurately reproduced as compared with that in the dual mode resonator 321.

In the thirteenth embodiment, two distributed capacitors are arranged. However, it is applicable that a large number of distributed capacitors be arranged.

Figure 37B:
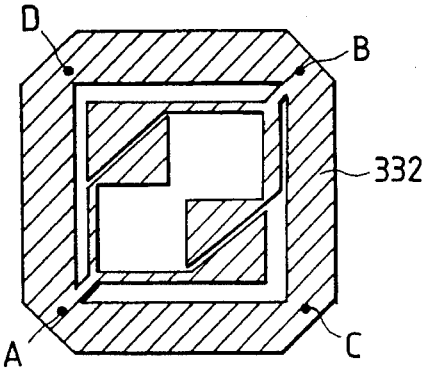
FIG. 37B is a plan view of a dual mode resonator according to a modification of the thirteenth embodiment.

Also, the open-end coupling lines 372*a*, 372*b*, 373*a* and 373*b* are respectively formed of a straight strip line having a uniform width. However, as shown in FIG. 37B, it is preferred that the open-end coupling lines 372*a*, 372*b*, 373*a* and 373*b* be respectively formed of a triangular-shaped strip line having a different width.

Next, a fourteenth embodiment is described with reference to FIGS. 38A to 38D.

Figure 38A:
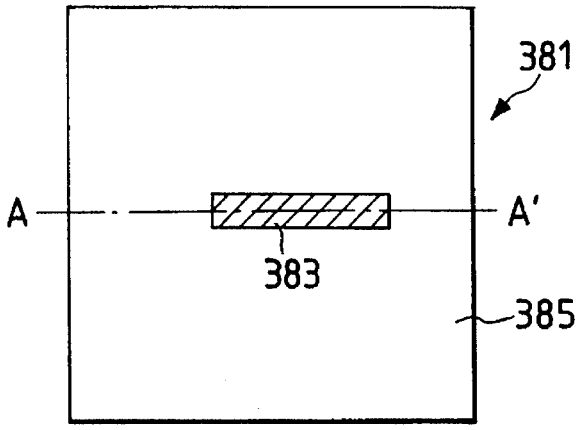
FIG. 38A is a plan view of a dual mode resonator according to a fourteenth embodiment to show an upper open-end coupling line placed at a surface level of the dual mode resonator.
Figure 38C:
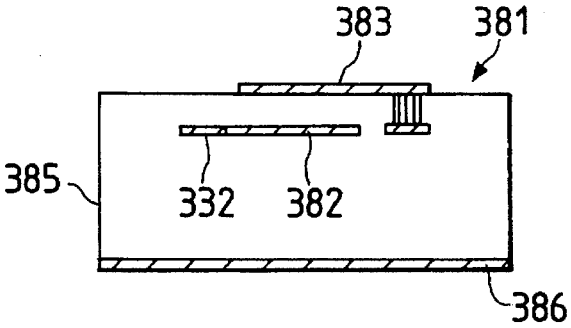
FIG. 38C is a cross sectional view taken generally along lines A—A' of FIGS. 38A, 38B.
Figure 38B:
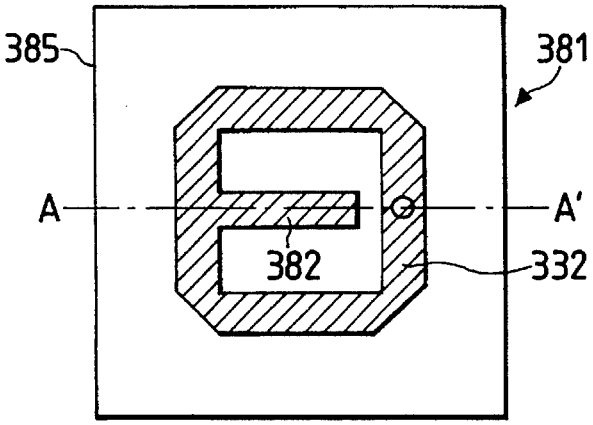
FIG. 38B is an internal plan view of the dual mode resonator shown in FIG. 38A to show a lower open-end coupling line placed at an internal level of the dual mode resonator.
Figure 38D:
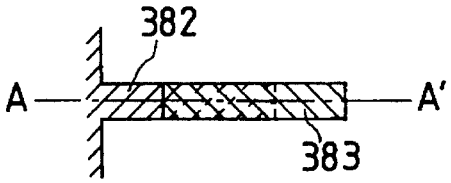
FIG. 38D is a perspective view showing the upper open-end coupling line lying on the lower open-end coupling line through a dielectric substance.

FIG. 38A is a plan view of a dual mode resonator according to a fourteenth embodiment to show an upper open-end coupling line placed at a surface level of the dual mode resonator, FIG. 38B is an internal plan view of the dual mode resonator shown in FIG. 38A to show a lower open-end coupling line placed at an internal level of the dual mode resonator, FIG. 38C is a cross sectional view taken generally along lines A—A' of FIGS. 38A, 38B, and FIG. 38D is a perspective view showing the upper open-end coupling line lying on the lower open-end coupling line through a dielectric substance.

As shown in FIGS. 38A to 38C, a dual mode resonator 381 comprises the rectangular-shaped strip line 332 placed at an internal level, a lower open-end coupling line 382 connected to the coupling point A of the strip line 332 at the internal level, an upper open-end coupling line 383 placed at a surface level, a conductive connecting line 384 for connecting the upper open-end coupling line 383 to the coupling point B of the strip line 332, a dielectric substance 385 having a high dielectric constant $\epsilon$ for mounting the upper open-end coupling line 383 and burying the rectangular-shaped strip line 332, the lower open-end coupling line 382 and the conductive connecting line 384, and a grounded conductive element 386 For mounting the dielectric substance 385. The lower and upper open-end coupling lines 382, 383 overlaps with each other by a prescribed length through the dielectric substance 385 in a longitudinal direction of the coupling lines 382, 383.

In the above configuration, in cases where microwaves are circulated in the rectangular-shaped strip line 332, the lower and upper open-end coupling lines 382 and 383 are electromagnetically coupled to function as a capacitor having a distributed capacity. Therefore, a microwave having a wavelength $\lambda_1$ longer than a line length of the rectangular-shaped strip line 332 is selectively resonated. Thereafter, the microwave resonated is output from the coupling point B.

A value of the distributed capacity determined by the lower and upper open-end coupling lines 382 and 383 and the dielectric substance 385 is adjusted by varying an overlapping degree of the lower and upper open-end coupling lines 382 and 383 through the dielectric substance 385, as shown in FIG. 38D.

Accordingly, because a dielectric constant $\epsilon$ of the dielectric substance 385 is high, the distributed capacity can be heightened even though a gap distance between the lower and upper open-end coupling lines 382 and 383 is large. In other words, a high distributed capacity can be easily obtained without accurately setting the gap distance to a low value. Therefore, the dual mode resonator 381 can be easily manufactured in a small size.

Also, because a high distributed capacity can be easily obtained, a resonance frequency of the microwave can be accurately set at a good reproductivity.

Also, because the distributed capacity is adjusted by varying an overlapping degree of the lower and upper open-end coupling lines 382 and 383 or by trimming or overlaying open-end portions of the upper open-end coupling line 383, frequency adjustment of the microwave can be easily performed.

Figure 39:
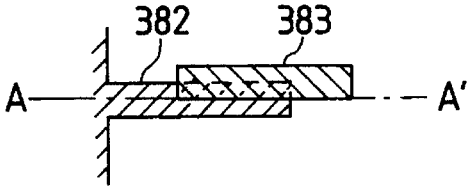
FIGS. 39 and 40 are respectively a perspective view showing an upper open-end coupling line lying on a lower open-end coupling line through a dielectric substance according to a modification of the fourteenth embodiment.
Figure 40:
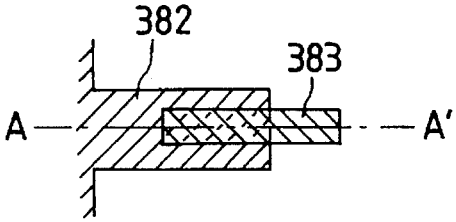

In the fourteenth embodiment, as shown in FIG. 38D, a central line of the lower open-end coupling line 382 in its longitudinal direction agrees with that of the upper open-end coupling line 383. However, as shown in FIG. 39, it is applicable that a central line of the lower open-end coupling line 382 in its longitudinal direction do not agree with that of the upper open-end coupling line 383 to overlap portions of the lower and upper open-end coupling lines 382, 383 with each other. Also, as shown in FIG. 40, it is applicable that a width of the upper open-end coupling line 383 be narrower than that of the lower open-end coupling line 382.

Next, a fifteenth embodiment is described with reference to FIG. 41.

In the ninth to fourteenth embodiments, a direction of an open-end of the open-end coupling line 323*a*, 333*a*, 353*a*, 362*a*, 372*a*, 373*a* or 382 is opposite to that of an open-end of the open-end coupling line 323*b*, 333*b*, 353*b*, 362*b*, 372*b*, 373*b* or 383. Therefore, open-ends of a pair of open-end coupling lines cannot be simultaneously trimmed or overlaid. In this case, it is difficult to trim or overlay the open-ends of a pair of open-end coupling lines at the same line length. In cases where a line length of one open-end coupling line trimmed or overlaid differs from that of the other open-end coupling line trimmed or overlaid, there is a drawback that a degree of separation between the first and second microwaves is lowered even though the coupling points A,C,B and D are spaced 90 degrees in that order to maintain the symmetry of the dual mode resonator. In the fifteenth embodiment, the drawback is solved.

Figure 41:
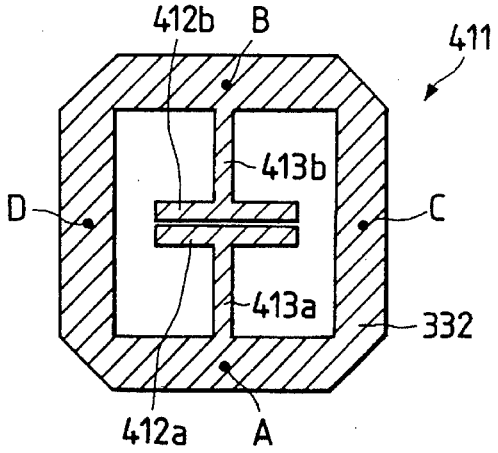
FIG. 41 is a plan view of a dual mode resonator according to a fifteenth embodiment.

FIG. 41 is a plan view of a dual mode resonator according to a fifteenth embodiment.

As shown in FIG. 41, a dual mode resonator 411 comprises the rectangular-shaped strip line 332, a pair of open-end coupling lines 412*a*, 412*b* respectively having both open-ends for functioning as a capacitor having a distributed capacity to electromagnetically influence the first microwave, and a pair of lead-in lines 413*a*, 413*b* for connecting the open-end coupling lines 412*a*, 412*b* to the coupling points A and B of the rectangular-shaped strip line 332.

The open-end coupling lines 412*a*, 412*b* are respectively formed of a straight strip line, are placed at an inside space surrounded by the ring-shaped strip line 332, and are arranged closely to each other to couple to each other. First open-ends of the open-end coupling lines 412*a*, 412*b* are directed in the same direction, and second open-ends of the open-end coupling lines 412*a*, 412*b* are directed in the same direction. The lead-in lines 413*a*, 413*b* are formed of strip lines.

Accordingly, because directions of the first and second open-ends of the open-end coupling line 412*a* are the same as those of the first and second open-ends of the open-end coupling line 412*b*, the first open-ends of the open-end coupling lines 412*a*, 412*b* can be simultaneously trimmed or overlaid, and the second open-ends of the open-end coupling lines 412*a*, 412*b* can be simultaneously trimmed or overlaid. Therefore, a line length of the open-end coupling line 412*a* trimmed or overlaid can be reliably set to the same as that of the open-end coupling line 412*b* trimmed or overlaid. As a result, the resonance frequency of the first microwave can be reliably adjusted while maintaining a degree of separation between the first and second microwaves at a high level. Also, even though the coupling points A,C,B and D are not spaced 90 degrees in that order, a degree of separation between the first and second microwaves can be maintained at a high level by adjusting a difference in line lengths between the lead-in line 413*a* and the lead-in line 412*b*. Therefore, positions of input and output elements for the first and second microwaves can be arbitrarily set.

Figure 42:
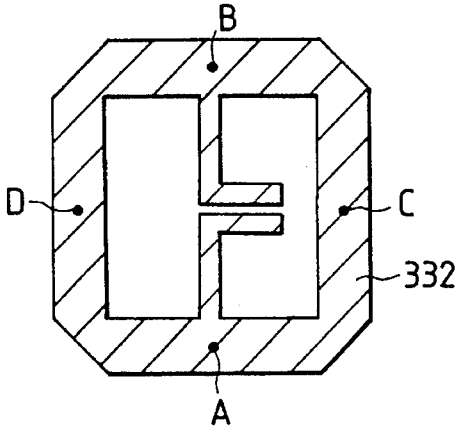
FIG. 42 is a plan view of a dual mode resonator according to a modification of the fifteenth embodiment.
Figure 43A:
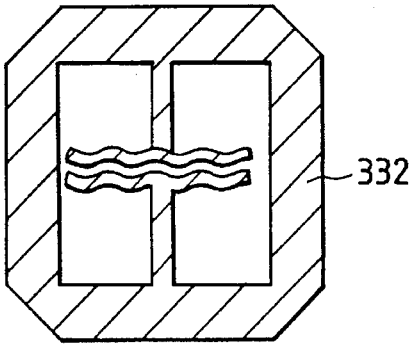
Figure 43B:
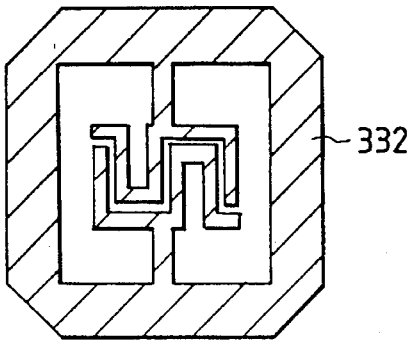

In the fifteenth embodiment, each of the open-end coupling lines 412*a*, 412*b* has two open-ends. However, as shown in FIG. 42, it is applicable that each of the open-end coupling lines 412*a*, 412*b* have an open-end. Also, it is not required that the open-end coupling lines 412*a*, 412*b* are straight. For example, as shown in FIG. 48A, it is applicable that the open-end coupling lines 412*a*, 412*b* be respectively in a comb-teeth shape. Also, as shown in FIG. 43B, it is applicable that the open-end coupling lines 412*a*, 412*b* be respectively in a wave shape.

Next, a sixteenth embodiment is described with reference to FIGS. 44A to 44C.

Figure 44A:
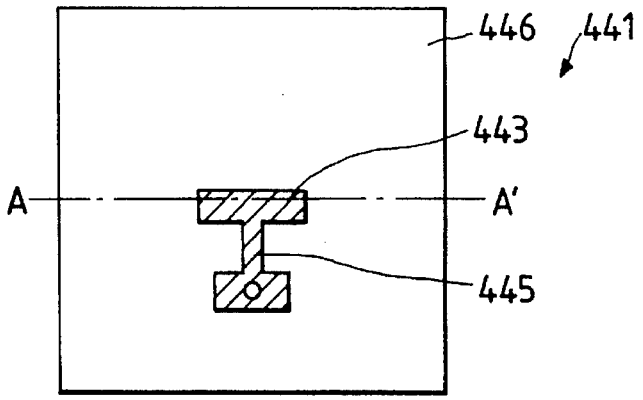
FIG. 44A is a plan view of a dual mode resonator according to a sixteenth embodiment to show an upper open-end coupling line placed at a surface level of the dual mode resonator.
Figure 44B:
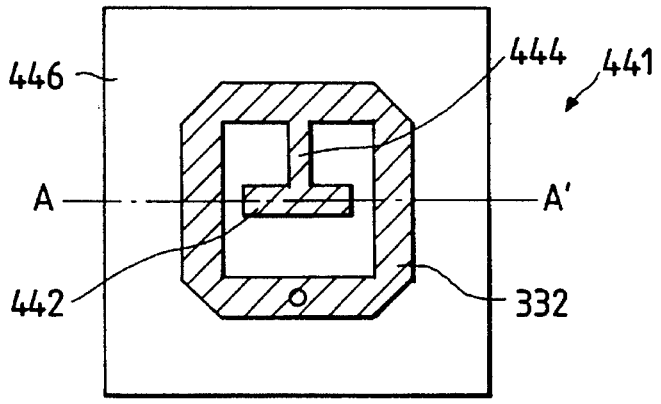
FIG. 44B is an internal plan view of the dual mode resonator shown in FIG. 44A to show a lower open-end coupling line placed at an internal level of the dual mode resonator.
Figure 44C:
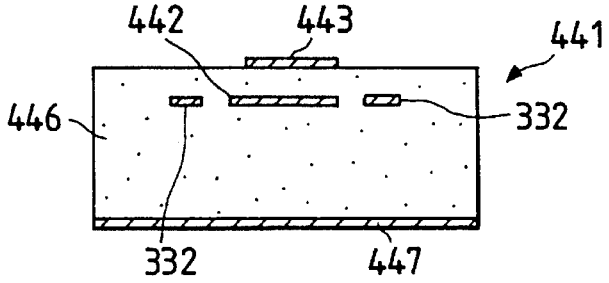
FIG. 44C is a cross sectional view taken generally along lines A—A' of FIGS. 44A, 44B.

FIG. 44A is a plan view of a dual mode resonator according to a sixteenth embodiment to show an upper open-end coupling line placed at a surface level of the dual mode resonator, FIG. 44B is an internal plan view of the dual mode resonator shown in FIG. 44A to show a lower open-end coupling line placed at an internal level of the dual mode resonator, FIG. 44C is a cross sectional view taken generally along lines A—A' of FIGS. 44A, 44B.

As shown in FIGS. 44A to 44C, a dual mode resonator 441 comprises the rectangular-shaped strip line 332 placed at an internal level, a lower open-end coupling line 442 having both open-ends at the internal level, an upper open-end coupling line 443 having both open-ends at a surface level, a lead-in line 444 for connecting the lower open-end coupling line 442 to the coupling point A of the rectangular-shaped strip line 332, a lead-in line 445 having the same shape as that of the lead-in line 444 for connecting the upper open-end coupling line 443 to the coupling point B of the rectangular-shaped strip line 332, a dielectric substance 446 for mounting the upper open-end coupling line 443 and burying the rectangular-shaped strip line 332, the lower open-end coupling line 442 and the lead-in lines 444 and 445, and a grounded conductive element 447 for mounting the dielectric substance 446.

The open-end coupling lines 442, 443 are respectively formed of a straight strip line, are placed at an inside open space surrounded by the ring-shaped strip line 332, and are arranged closely to each other to function as a capacitor having a distributed capacity. First open-ends of the open-end coupling lines 442, 443 are directed in the same direction, and second open-ends of the open-end coupling lines 442, 443 are directed in the same direction. The lead-in lines 444, 445 are formed of strip lines.

A value of the distributed capacity determined by the lower and upper open-end coupling lines 442, 443 and the dielectric substance 446 is set by varying an overlapping degree of the lower and upper open-end coupling lines 442, 443 through the dielectric substance 446.

Accordingly, because a dielectric constant $\epsilon$ of the dielectric substance 446 is high, the distributed capacity can be heightened even though a gap distance between the lower and upper open-end coupling lines 442, 443 is large. In other words, a high distributed capacity can be easily obtained without accurately setting the gap distance to a low value. Therefore, the dual mode resonator 441 can be easily manufactured in a small size.

Also, because a high distributed capacity can be easily obtained, a resonance frequency of the microwave can be accurately set at a good reproductivity.

Also, because the distributed capacity is adjusted by varying an overlapping degree of the lower and upper open-end coupling lines 442, 443 or by trimming or overlaying the upper open-end coupling line 443, a resonance frequency of the first microwave can be easily adjusted.

In the sixteenth, a width of the upper open-end coupling line 443 is the same as that of the lower open-end coupling line 442. However, it is applicable that a width of the upper open-end coupling line 443 differ from that of the lower open-end coupling line 442.

Next, a seventeenth embodiment is described with reference to FIG. 45.

Figure 45:
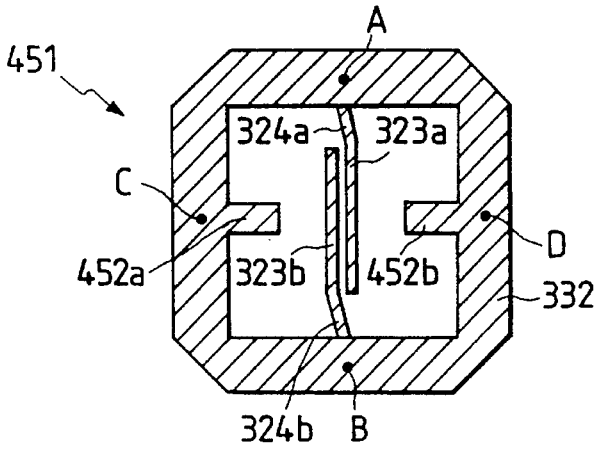
FIG. 45 is a plan view of a dual mode resonator according to a seventeenth embodiment.

FIG. 45 is a plan view of a dual mode resonator according to a seventeenth embodiment.

As shown in FIG. 45, a dual mode resonator 451 comprises the rectangular-shaped strip line 332 for resonating first and third microwaves having first and third wavelengths $\lambda_1$ and $\lambda_3$, the open-end coupling line 323*a*, 323*b*, the lead-in lines 324*a*, 324*b*, and a pair of open-end line 452*a*, 452*b* connected to the coupling points C and D of the strip line 332 for functioning as a capacitor having a distributed capacity to electromagnetically influence the third microwave. The open-end line 452*a*, 452*b* are formed of strip lines and are not coupled to each other.

In the above configuration, the first microwave is resonated in the dual mode resonator 451 in the same manner as in the dual mode resonator 321. In contrast, a third microwave having a wavelength $\lambda_3$ input to the coupling point C is circulated in the ring-shaped strip line 332 while the third microwave is electromagnetically influenced by the open-end lines 452*a*, 452*b* because electric voltages of the third microwave at the coupling points C and D are maximized. Therefore, even though the wavelength $\lambda_3$ is longer than a line length of the ring-shaped strip line 332, the first microwave is resonated in the ring-shaped strip line 332 according to a third resonance mode orthogonal to the first resonance mode and is output from the coupling point D.

Accordingly, the third microwave having the wavelength $\lambda_3$ determined by the distributed capacity of the open-end lines 452*a*, 452*b* can be resonated in the dual mode resonator 451 as well as the first microwave having the wavelength $\lambda_1$ determined by the distributed capacity of the open-end coupling line 323*a*, 323*b*.

Also, in cases where the wavelength $\lambda_3$ differs from the wavelength $\lambda_1$, two types of microwaves can be simultaneously resonated in the dual mode resonator 451. In cases where the wavelength $\lambda_3$ is equal to the wavelength $\lambda_1$, the microwaves having the same wavelength can be resonated in two paralleled stages.

Next, an eighteenth embodiment is described with reference to FIGS. 46A to 46C.

Figure 46A:
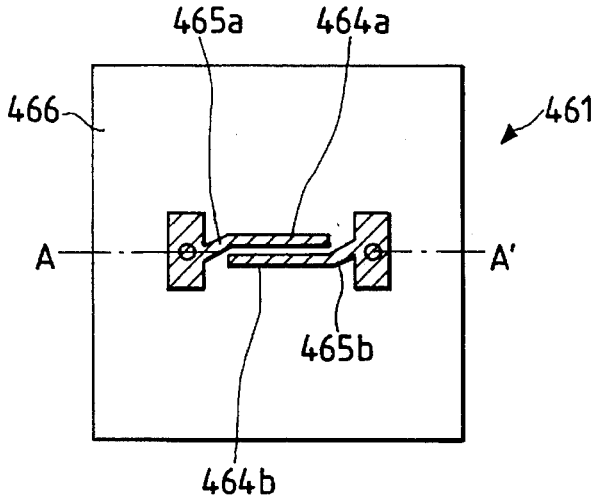
FIG. 46A is a plan view of a dual mode resonator according to an eighteenth embodiment to show an upper open-end coupling line placed at a surface level of the dual mode resonator.
Figure 46B:
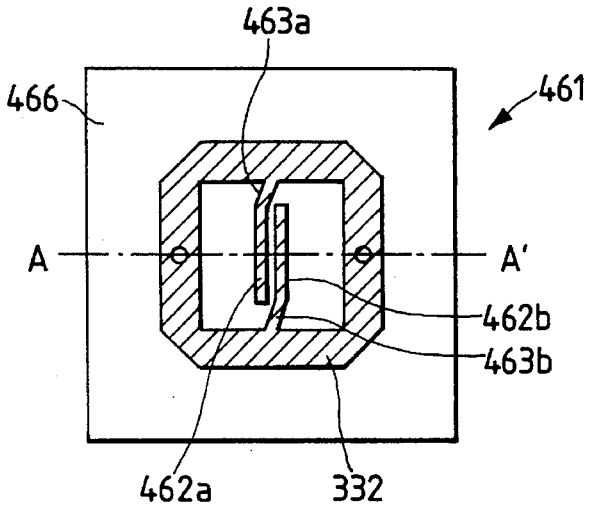
FIG. 46B is an internal plan view of the dual mode resonator shown in FIG. 46A to show a lower open-end coupling line placed at an internal level of the dual mode resonator.
Figure 46C:
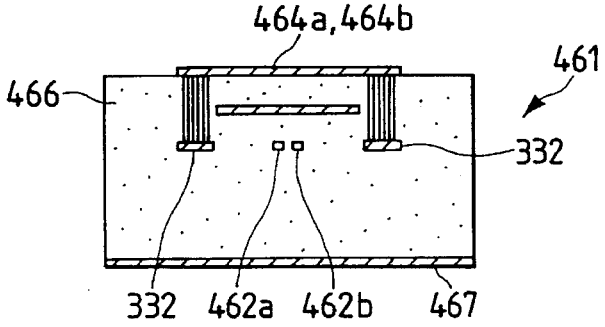
FIG. 46C is a cross sectional view taken generally along lines A—A' of FIGS. 46A, 46B.

FIG. 46A is a plan view of a dual mode resonator according to an eighteenth embodiment to show an upper open-end coupling line placed at a surface level of the dual mode resonator, FIG. 46B is an internal plan view of the dual mode resonator shown in FIG. 46A to show a lower open-end coupling line placed at an internal level of the dual mode resonator, FIG. 46C is a cross sectional view taken generally along lines A—A' of FIGS. 46A, 46B.

As shown in FIGS. 46A to 46C, a dual mode resonator 461 comprises the rectangular-shaped strip line 332 placed at an internal level for resonating first and third microwaves having first and third wavelengths $\lambda_1$ and $\lambda_3$, a pair of lower open-end coupling lines 462*a*, 462*b* having the same shape at the internal level for functioning as a capacitor having a distributed capacity to electromagnetically influence the first microwave, a pair of lead-in lines 463*a*, 463*b* having the same shape at the internal level for connecting the lower open-end coupling lines 462*a*, 462*b* to the coupling points A and B of the strip line 332, a pair of upper open-end coupling lines 464*a*, 464*b* having the same shape at a surface level for functioning as a capacitor having a distributed capacity to electromagnetically influence the third microwave, a pair of lead-in lines 465*a*, 465*b* having the same shape at the surface level for connecting the upper open-end coupling lines 464*a*, 464*b* to the coupling points C and D of the strip line 332, a dielectric substance 466 for mounting the upper open-end coupling lines 464*a*, 464*b* and burying the rectangular-shaped strip line 332, the lower open-end coupling lines 462*a*, 462*b* and the lead-in lines 463*a*, 468*b*, and a grounded conductive element 467 for mounting the dielectric substance 466.

The open-end coupling lines 462*a*, 462*b*, 464*a* and 464*b* and the lead-in lines 463*a*, 463*b*, 465*a* and 465*b* are respectively formed of a straight strip line and are placed at an inside open space surrounded by the strip line 332. The open-end coupling lines 462*a*, 462*b* are arranged closely to each other to couple to each other, and the open-end coupling lines 464*a*, 464*b* are arranged closely to each other to couple to each other.

In the above configuration, a first signal is resonated according to a first resonance mode at a first resonance wavelength $\lambda_1$ which is determined by electromagnetic characteristics of the strip line 332 and the lead-in lines 463*a*, 463*b* and the distributed capacity of the lower open-end coupling lines 462*a*, 462*b*. Also, a third signal is resonated according to a third resonance mode orthogonal to the first resonance mode at a third resonance wavelength $\lambda_3$ which is determined by electromagnetic characteristics of the strip line 332 and the lead-in lines 465*a*, 465*b* and the distributed capacity of the upper open-end coupling lines 464*a*, 464*b*.

Accordingly, the third microwave having the wavelength $\lambda_3$ determined by the distributed capacity of the open-end coupling lines 462*a*, 462*b* can be resonated in the dual mode resonator 461 as well as the first microwave having the wavelength $\lambda_1$ determined by the distributed capacity of the open-end coupling line 464*a*, 464*b*.

Also, in cases where the wavelength $\lambda_3$ differs from the wavelength $\lambda_1$, two types of microwaves can be simultaneously resonated in the dual mode resonator 461. In cases where the wavelength $\lambda_3$ is equal to the wavelength $\lambda_1$, the microwaves having the same wavelength can be resonated in two paralleled stages.

Also, because a dielectric constant $\epsilon$ of the dielectric substance 466 is high, the distributed capacity can be heightened even though a gap distance between the lower open-end coupling lines 462*a* and 462*b* is large. In other words, a high distributed capacity can be easily obtained without accurately setting the gap distance to a low value. Therefore, the dual mode resonator 461 can be easily manufactured in a small size.

Also, because a high distributed capacity can be easily obtained, a resonance frequency of the first microwave can be accurately set at a good reproductivity.

Also, because the distributed capacity is adjusted by trimming or overlaying open-end portions of the upper open-end coupling lines 464*a* and 464*b*, frequency adjustment of the third microwave can be easily performed.

In the dual mode resonators 381, 441 and 461, the rectangular strip line 332 is buried in the dielectric substance. However, it is applicable that the rectangular-shaped strip line 332 be placed at the surface level.

In the dual mode resonators 321, 331, 351, 361, 371, 381, 411 and 441, any strip lines are not connected to the coupling points C and D. However, it is applicable that a pair of strip lines be connected to the coupling points C and D to influence a microwave circulating in the strip line 322 or 332.

Next, a nineteenth embodiment is described with reference to FIGS. 47A and 47B.

Figure 47A:
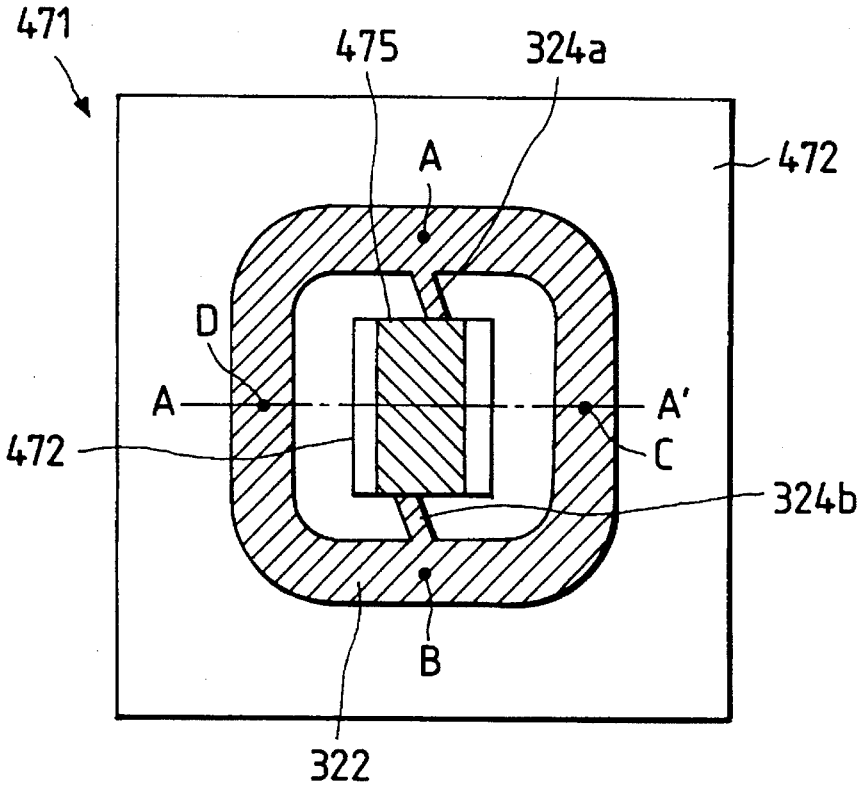
FIG. 47A is a plan view of a dual mode resonator according to an eighteenth embodiment.
Figure 47B:
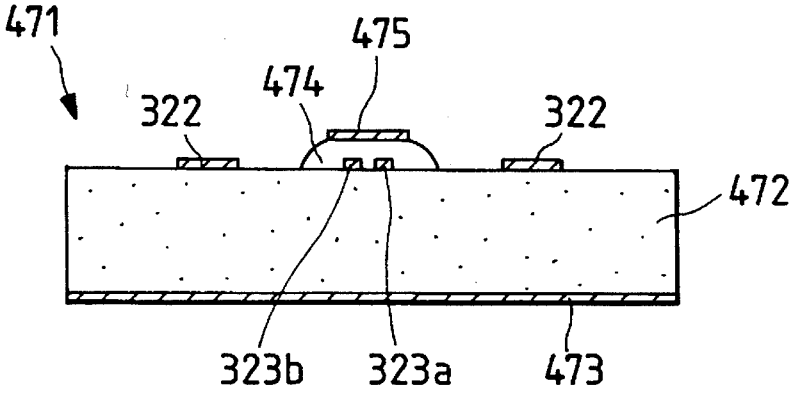
FIG. 47B is a cross sectional view taken generally along lines A—A' of FIGS. 47A.

FIG. 47A is a plan view of a dual mode resonator according to an eighteenth embodiment, and FIG. 47B is a cross sectional view taken generally along lines A—A' of FIGS. 47A.

As shown in FIGS. 47A and 47B, a dual mode resonator 471 comprises the ring-shaped strip line 322, the open-end coupling lines 323*a*, 323*b*, the lead-in lines 324*a*, 324*b*, a dielectric substance 472 for mounting the strip line 322, the open-end coupling lines 323*a*, 323*b* and the lead-in lines 324*a*, 324*b*, a grounded conductive element 473 for mounting the dielectric substance 472, an over-laying dielectric layer 474 overlaying the open-end coupling lines 323*a*, 323*b* for heightening a distributed capacity of the open-end coupling lines 323*a*, 323*b*, and an over-laying metal layer 475 mounted on the over-laying dielectric layer 474 for heightening the distributed capacity of the open-end coupling lines 323*a*, 323*b* in cooperation with the over-laying dielectric layer 474.

In the above configuration, because a dielectric constant $\epsilon$ of the over-laying dielectric layer 474 is high, a distributed capacity of the open-end coupling lines 323*a*, 323*b* is heightened. Therefore, a coupling degree of the open-end coupling lines 323*a*, 323*b* is increased by the open-end coupling lines 323*a*, 323*b* in, cooperation with the over-laying dielectric layer 474.

Accordingly, a distributed capacity of the open-end coupling lines 323*a*, 323*b* can be heightened by an overlaying structure composed of the over-laying dielectric layer 474 and the over-laying dielectric layer 474. Therefore, the dual mode resonator 471 can be manufactured in a small size.

Also, to obtain a desired distributed capacity, a gap distance between the open-end coupling lines 323*a*, 323*b* can be widened as compared with that in the dual mode resonator 321. Therefore, the dual mode resonator 471 can be manufactured in a good reproductivity, and a desired resonance frequency can be reliably obtained.

Also, a resonance frequency can be easily adjusted by trimming the over-laying metal layer 475.

In the nineteenth embodiment, the over-laying metal layer 475 is provided. However, the over-laying metal layer 475 is not necessarily required. In cases where any over-laying metal layer is not provided, a resonance frequency is adjusted by varying a thickness or a dielectric constant $\epsilon$ of the overlaying dielectric layer 474.

Having illustrated and described the principles of our invention in a preferred embodiment thereof, it should be readily apparent to those skilled in the art that the invention can be modified in arrangement and detail without departing from such principles. We claim all modifications coming within the spirit and scope off the accompanying claims.

What is claimed is:

1. A strip-line filter in which two microwaves are resonated and filtered, comprising:

a first one-wavelength loop-shaped strip line resonator having a uniform line impedance for selectively resonating a first microwave according to a first resonance mode and selectively resonating a second microwave according to a second resonance mode orthogonal to the first resonance mode, the first one-wavelength loop-shaped strip line resonator having a first parallel coupling line, and a first coupling point A, a second coupling point B spaced 180 degrees in electric length apart from the first coupling point A, a third coupling point C spaced 90 degrees in electric length apart from the first coupling point A and a fourth coupling point D spaced 180 degrees in electric length apart from the third coupling point C being placed in the first one-wavelength loop-shaped strip line resonator;

a first microwave inputting element for inputting the first microwave to the first one-wavelength loop-shaped strip line resonator to maximize a first electric voltage induced in the first one-wavelength loop-shaped strip line resonator by the first microwave at the coupling points A and B;

a second microwave inputting element for inputting the second microwave to the first one-wavelength loop-shaped strip line resonator to maximize a second electric voltage induced in the first one-wavelength loop-shaped strip line resonator by the second microwave at the coupling points C and D;

a pair of first open-end transmission lines connected to the coupling points A and B of the first one-wavelength loop-shaped strip line resonator for electromagnetically influencing the first microwave resonated in the first one-wavelength loop-shaped strip line resonator, the first open-end transmission lines having the same electromagnetic characteristics, and a first wavelength of the first microwave being determined by the line impedance of the first one-wavelength loop-shaped strip line resonator and the electromagnetic characteristics of the first open-end transmission lines;

a second one-wavelength loop-shaped strip line resonator having the same uniform line impedance as that of the first one-wavelength loop-shaped strip line resonator for selectively resonating the first microwave resonated in the first one-wavelength loop-shaped strip line resonator according to the first resonance mode and selectively resonating the second microwave resonated in the first one-wavelength loop-shaped strip line resonator according to the second resonance mode, the second one-wavelength loop-shaped strip line resonator having a second parallel coupling line which faces the first parallel coupling line of the first one-wavelength loop-shaped strip line resonator in parallel through a parallel coupling space to couple the second one-wavelength loop-shaped strip line resonator to the first one-wavelength loop-shaped strip line resonator, and a fifth coupling point E, a sixth coupling point F spaced 180 degrees in electric length apart from the fifth coupling point E, a seventh coupling point G spaced 90 degrees in electric length apart from the fifth coupling point E and an eighth coupling point H spaced 180 degrees in electric length apart from the seventh coupling point G being placed in the second one-wavelength loop-shaped strip line resonator;

a pair of second open-end transmission lines connected to two coupling points selected from among the coupling points E,F,G,H of the second one-wavelength loop-shaped strip line resonator for electromagnetically influencing the first microwave resonated in the second one-wavelength loop-shaped strip line resonator, the second open-end transmission lines respectively having the same electromagnetic characteristics as those of the first open-end transmission lines;

a first microwave outputting element for outputting the first microwave resonated in the second one-wavelength loop-shaped strip line resonator from a coupling point at which one of the second open-end transmission lines is connected; and a second microwave outputting element for outputting the second microwave resonated in the second one-wavelength loop-shaped strip line resonator from another coupling point at which any second open-end transmission line is not connected.

2. A strip-line filter according to claim 1 in which the first parallel coupling line of the first one-wavelength loop-shaped strip line resonator is placed between the coupling points B and D, and the second parallel coupling line of the second one-wavelength loop-shaped strip line resonator is placed between the coupling points E and G.

3. A strip-line filter according to claim 1 in which the second open-end transmission lines are connected to the coupling points E and F of the second one-wavelength loop-shaped strip line resonator, the first microwave outputting element is connected to the coupling point F, and the second microwave outputting element is connected to the coupling point H.

4. A strip-line filter according to claim 1 in which the second open-end transmission lines are connected to the coupling points G and H of the second one-wavelength loop-shaped strip line resonator, the first microwave outputting element is connected to the coupling point H, and the second microwave outputting element is connected to the coupling point F.

5. A strip-line filter according to claim 1 in which the first and second open-end transmission lines are respectively formed of a strip line, the first and second microwave inputting elements are respectively formed of a strip line, and the first and second microwave outputting elements are respectively formed of a strip line.

6. A strip-line filter according to claim 1 in which the first and second microwave inputting elements are respectively formed of a parallel coupling strip line arranged in parallel to the first one-wavelength loop-shaped strip line resonator, and the first and second microwave outputting elements are respectively formed of a parallel coupling strip line arranged in parallel to the second one-wavelength loop-shaped strip line resonator.

7. A strip-line filter according to claim 1, additionally including:

a pair of third open-end transmission lines connected to the coupling points C and D of the first one-wavelength loop-shaped strip line resonator for electromagnetically influencing the second microwave resonated in the first one-wavelength loop-shaped strip line resonator, the third open-end transmission lines having the same electromagnetic characteristics, and a second wavelength of the second microwave being determined by the line impedance of the first one-wavelength loop-shaped strip line resonator and the electromagnetic characteristics of the third open-end transmission lines; and a pair of fourth open-end transmission lines for electromagnetically influencing the second microwave resonated in the second one-wavelength loop-shaped strip line resonator, the fourth open-end transmission lines respectively having the same electromagnetic characteristics as those of the third open-end transmission lines, and the fourth open-end transmission lines being connected to two coupling points of the second one-wavelength loop-shaped strip line resonator at which the second open-end transmission lines are not connected.

8. A strip-line filter according to claim 7 in which the second open-end transmission lines are connected to the coupling points E and F of the second one-wavelength loop-shaped strip line resonator, the fourth open-end transmission lines are connected to the coupling points G and H of the second one-wavelength loop-shaped strip line resonator, the first microwave outputting element is connected to the coupling point F, and the second microwave outputting element is connected to the coupling point H.

9. A strip-line filter according to claim 7 in which the second open-end transmission lines are connected to the coupling points G and H of the second one-wavelength loop-shaped strip line resonator, the fourth open-end transmission lines are connected to the coupling points E and F of the second one-wavelength loop-shaped strip line resonator, the first microwave outputting element is connected to the coupling point H, and the second microwave outputting element is connected to the coupling point F.

10. A strip-line filter according to claim 7 in which the first, second, third and fourth open-end transmission lines are respectively formed of a strip line, the first and second microwave inputting elements are respectively formed of a strip line, and the first and second microwave outputting elements are respectively formed of a strip line.

11. A strip-line filter according to claim 7 in which the first and second microwave inputting elements are respectively formed of a parallel coupling strip line arranged in parallel to the first one-wavelength loop-shaped strip line resonator, and the first and second microwave outputting elements are respectively formed of a parallel coupling strip line arranged in parallel to the second one-wavelength loop-shaped strip line resonator.

12. A strip-line filter according to claim 7 in which the third and fourth open-end transmission lines have the same electromagnetic characteristics as those of the first and second open-end transmission lines.

13. A strip-line filter according to claim 1 in which the first and second one-wavelength loop-shaped strip line resonators are respectively in a square shape, the coupling points A,B,C and D are placed at four corners of the first one-wavelength loop-shaped strip line resonator, and the coupling points E,F,G and H are placed at four corners of the second one-wavelength loop-shaped strip line resonator.

14. A strip-line filter according to claim 1 in which the first and second one-wavelength loop-shaped strip line resonators are respectively in a rectangular shape, the first and second one-wavelength loop-shaped strip line resonators respectively have two first parallel lines longer than 90 degrees in electric length and two second parallel lines shorter than 90 degrees in electric length, the coupling points A, B,C,D,E,F,G and H are placed at the first parallel lines of the first and second one-wavelength loop-shaped strip line resonators, the first parallel coupling line is formed of one of the second parallel lines of the first one-wavelength loop-shaped strip line resonator, and the second parallel coupling line is formed of one of the second parallel lines of the second one-wavelength loop-shaped strip line resonator.

* * * * *

UNITED STATES PATENT AND TRADEMARK OFFICE

CERTIFICATE OF CORRECTION

PATENT NO. : 5,534,831

DATED : July 7, 1996

INVENTOR(S) : Hiroyuki YABUKI et al.

It is certified that error appears in the above-identified patent and that said Letters Patent is hereby corrected as shown below:

ON THE TITLE PAGE

Item [73] Assignee should read --MATSUSHITA ELECTRIC INDUSTRIAL CO., LTD.--.

Signed and Sealed this

Seventeenth Day of June, 1997

*Attest:*

BRUCE LEHMAN

*Attesting Officer*

*Commissioner of Patents and Trademarks*